US009684277B2

(12) United States Patent
Yamamoto et al.

(10) Patent No.: US 9,684,277 B2
(45) Date of Patent: Jun. 20, 2017

(54) PROCESS CARTRIDGE AND IMAGE-FORMING METHOD

(71) Applicant: CANON KABUSHIKI KAISHA, Tokyo (JP)

(72) Inventors: Yuki Yamamoto, Tokyo (JP); Atsushi Okuda, Yokohama (JP); Yuka Ishiduka, Suntou-gun (JP); Shuhei Moribe, Mishima (JP); Koji Nishikawa, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/941,537

(22) Filed: Nov. 13, 2015

(65) Prior Publication Data

US 2016/0139556 A1 May 19, 2016

(30) Foreign Application Priority Data

Nov. 19, 2014 (JP) ..... 2014-234934

(51) Int. Cl.

| | |
|---|---|
| ***G03G 5/00*** | (2006.01) |
| ***G03G 21/18*** | (2006.01) |
| ***G03G 5/05*** | (2006.01) |
| ***G03G 9/097*** | (2006.01) |
| ***G03G 5/07*** | (2006.01) |

(Continued)

(52) U.S. Cl.

CPC ..... *G03G 21/1814* (2013.01); *G03G 5/0546* (2013.01); *G03G 5/0564* (2013.01); *G03G 5/0589* (2013.01); *G03G 5/078* (2013.01); *G03G 5/14752* (2013.01); *G03G 5/14756* (2013.01); *G03G 5/14773* (2013.01); *G03G 9/097* (2013.01); *G03G 9/09716* (2013.01); *G03G 9/09725* (2013.01); *G03G 15/75* (2013.01); *G03G 2215/00957* (2013.01)

(58) Field of Classification Search

CPC ..... G03G 21/1814; G03G 5/0546; G03G 5/0564; G03G 5/078; G03G 5/0589; G03G 5/14756; G03G 9/097

USPC ..... 430/58.2

See application file for complete search history.

(56) References Cited

U.S. PATENT DOCUMENTS

| | | | |
|---|---|---|---|
| 7,645,547 | B2 | 1/2010 | Okuda et al. |
| 7,655,370 | B2 | 2/2010 | Kitamura et al. |

(Continued)

FOREIGN PATENT DOCUMENTS

| | | | |
|---|---|---|---|
| JP | 2002-318467 | A | 10/2002 |
| JP | 2005-202131 | A | 7/2005 |

(Continued)

OTHER PUBLICATIONS

Maruyama, et al., U.S. Appl. No. 14/656,272, filed Mar. 12, 2015.

*Primary Examiner* — Mark A Chapman

(74) *Attorney, Agent, or Firm* — Fitzpatrick, Cella, Harper & Scinto

(57) ABSTRACT

Provided are a process cartridge and an image-forming method each of which has a satisfactory cleaning property even at the initial stage of the use of a brand-new process cartridge or electrophotographic apparatus, and hence can suppress a reduction in image quality due to the contamination of a charging member. The charge transporting layer of an electrophotographic photosensitive member contains a specific polyarylate resin or polycarbonate resin, and a toner contains a specific fine particle on the surface of a toner particle.

20 Claims, 1 Drawing Sheet

(51) Int. Cl.
*G03G 15/00* (2006.01)
*G03G 5/147* (2006.01)

(56) References Cited

U.S. PATENT DOCUMENTS

| | | | |
|---|---|---|---|
| 7,803,508 | B2 | 9/2010 | Ishii et al. |
| 8,669,027 | B2 | 3/2014 | Anezaki et al. |
| 8,753,789 | B2 | 6/2014 | Ogaki et al. |
| 8,815,479 | B2 | 8/2014 | Shida et al. |
| 8,846,281 | B2 | 9/2014 | Okuda et al. |
| 8,921,020 | B2 | 12/2014 | Murai et al. |
| 8,980,508 | B2 | 3/2015 | Okuda et al. |
| 8,980,509 | B2 | 3/2015 | Noguchi et al. |
| 9,034,545 | B2 | 5/2015 | Maruyama et al. |
| 9,188,888 | B2 | 11/2015 | Okuda et al. |
| 9,235,144 | B2 | 1/2016 | Yamamoto et al. |
| 2014/0154618 | A1 | 6/2014 | Maruyama et al. |
| 2015/0056547 | A1 | 2/2015 | Murakami et al. |
| 2015/0277244 | A1 | 10/2015 | Sato et al. |
| 2015/0277248 | A1 | 10/2015 | Maruyama et al. |

FOREIGN PATENT DOCUMENTS

| | | | |
|---|---|---|---|
| JP | 2007-279702 | A | 10/2007 |
| WO | 2013/063291 | A1 | 5/2013 |

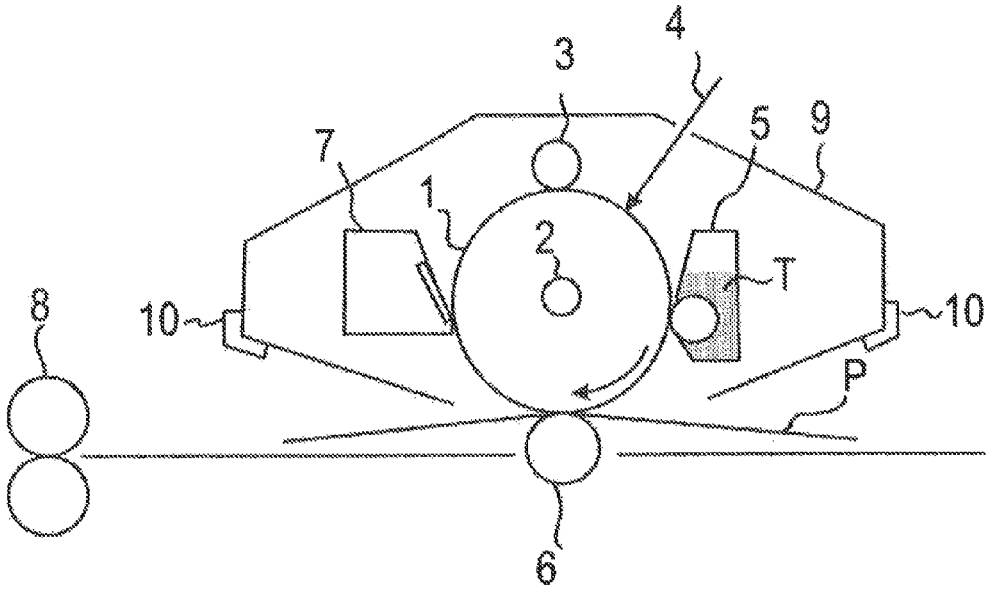
4
3
7
5
9
1
2
T
8
10
10
P
6

PROCESS CARTRIDGE AND IMAGE-FORMING METHOD

BACKGROUND OF THE INVENTION

Field of the Invention

The present invention relates to a process cartridge and an image-forming method.

Description of the Related Art

The following method has been known as a general electrophotographic process that is an image-forming method. An electric latent image is formed on an electrophotographic photosensitive member (hereinafter sometimes simply referred to as "photosensitive member"), a toner is supplied to the latent image to visualize the latent image, and the toner image is transferred onto a transfer material, such as paper, followed by the fixation of the toner image onto the transfer material with heat or a pressure to provide a copy.

After the transferring step, cleaning for removing the toner remaining on the electrophotographic photosensitive member (transfer residual toner) is performed. A means that has been most widely used as a cleaning method is blade cleaning. The blade cleaning is a method involving pressing a blade-shaped member having elasticity, such as a rubber, against the surface of the electrophotographic photosensitive member to scrape off the toner.

In the blade cleaning, the toner to be removed from the surface of the photosensitive member contains not only a toner particle but also an external additive that has migrated from the toner particle to the surface of the photosensitive member. In many cases, the external additive that has migrated to the surface of the photosensitive member is more difficult to clean out than the toner particle is. One possible cause for the foregoing is as described below. The particle diameter of the external additive is smaller than the particle diameter of the toner particle, and hence the external additive enters deeper into an contacting nip between the blade and the photosensitive member, thereby increasing the probability that the external additive slips through the blade.

When the external additive that has migrated to the surface of the photosensitive member is not sufficiently cleaned out (a cleaning property is low), charging member contamination in which the external additive adheres to a charging member is liable to occur. In a region where the charging member has been contaminated, a charging process for the photosensitive member is not normally performed and hence image quality is liable to reduce. Accordingly, a mechanism for removing the external additive that has adhered to the charging member needs to be arranged, and the necessity complicates the entire mechanism, or is responsible for an increase in size of a process cartridge or in cost.

In particular, at the initial stage of the use of a brand-new process cartridge or electrophotographic apparatus, the external additive that has migrated to the surface of the photosensitive member cannot be sufficiently cleaned out in some cases. One possible cause for the foregoing is as described below. At the initial stage of the use of the brand-new process cartridge or electrophotographic apparatus, the amount of an inclusion, such as the toner, present in the contacting nip portion between the blade and the photosensitive member is small, and hence a state in which the stick-slip motion of the blade is liable to be instable is established.

In order to stabilize the stick-slip motion of the blade from the initial stage of the use of the brand-new process cartridge or electrophotographic apparatus, an attempt has been made to apply a particle of the toner, carbon fluoride, silica, or the like as a lubricant to the edge portion of the cleaning blade at the time of the production of the process cartridge or the electrophotographic apparatus. However, a measure based on the application of the lubricant to the blade leads to the complication of a production process, and hence a means of suppressing the occurrence of a cleaning failure without applying the lubricant has been required.

As a means of improving the property by which the external additive that has migrated to the surface of the photosensitive member is cleaned out, for example, an attempt has been made to increase the linear pressure at which the edge portion of the blade is pressed against the surface of the photosensitive member to prevent the slip-through of the external additive. However, a means based on the mere increase in linear pressure may cause problems such as the acceleration of the chipping of the blade edge portion, the occurrence of an abnormal noise due to the chattering vibration of the blade, and the acceleration of the abrasion of the photosensitive member.

Japanese Patent Application Laid-Open No. 2007-279702 proposes an approach to improving the cleaning property through the use of a large-particle diameter silica particle that is nonspherical and amorphous as the external additive. However, the use of a large-particle diameter inorganic external additive may impair the low-temperature fixability of the toner. Accordingly, there is a possibility that the power consumption in a fixing step may increase.

Japanese Patent Application Laid-Open No. 2002-318467 proposes an approach to improving the cleaning property through the formation of a layer, in which a large-particle diameter amorphous or abrasive particle is retained, on the blade edge portion. However, with the approach proposed in Japanese Patent Application Laid-Open No. 2002-318467, it is difficult to suppress the slip-through of a small-particle diameter external additive, though a toner particle larger than the large-particle diameter amorphous or abrasive particle can be cleaned out. In addition, in order to form a stable retention layer on the blade edge portion, the large-particle diameter amorphous or abrasive particle needs to be sufficiently supplied to the blade edge portion by activating an electrophotographic process to some extent. Accordingly, it is assumed that in the first place, an improving effect on the cleaning property by the formation of the retention layer is not sufficiently obtained at the initial stage of the use of the brand-new process cartridge or electrophotographic apparatus.

SUMMARY OF THE INVENTION

According to one aspect of the present invention, there is provided a process cartridge detachably mountable to a main body of an electrophotographic apparatus, including: an electrophotographic photosensitive member; a charging device configured to contact with the electrophotographic photosensitive member to charge the electrophotographic photosensitive member; and a developing device configured to supply a toner onto the electrophotographic photosensitive member to form a toner image. The electrophotographic photosensitive member comprises a support, a charge generating layer, and a charge transporting layer in this order; the charge transporting layer is adjacent to the charge generating layer and is an outermost surface layer of the electrophotographic photosensitive member. The charge transporting layer contains at least one kind of resin selected from a polyarylate resin and a polycarbonate resin, and the resin contains, in a structure thereof, a polysiloxane structure represented by the formula (1). The toner contains a toner particle and an organic-inorganic composite fine particle present on a surface of the toner particle. The organic-inorganic composite fine particle contains an inorganic fine particle and a resin particle, and the inorganic fine particle is present so that a protrusion derived from a particle shape of the inorganic fine particle is formed on a surface of the resin particle.

(1)

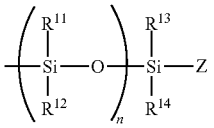

In the formula (1), $R^{11}$ to $R^{14}$ each independently represent an alkyl group, a fluoroalkyl group, or a phenyl group, Z represents a hydrogen atom, a halogen atom, an alkyl group, or an aryl group, and n represents 10 or more and 200 or less.

Further features of the present invention will become apparent from the following description of exemplary embodiments with reference to the attached drawing.

BRIEF DESCRIPTION OF THE DRAWINGS

FIGURE is a view for illustrating an example of the schematic construction of an electrophotographic apparatus including a process cartridge of the present invention.

DESCRIPTION OF THE EMBODIMENTS

Preferred embodiments of the present invention will now be described in detail in accordance with the accompanying drawing.

In order to obtain satisfactory image quality, not only a toner particle but also an external additive that has migrated to the surface of a photosensitive member needs to be sufficiently removed in a cleaning process. In particular, there has been required a means of improving a cleaning property at the initial stage of the use of a brand-new process cartridge or electrophotographic apparatus without the application of a lubricant to a blade to suppress the slip-through of the external additive that has migrated to the surface of the photosensitive member.

The present invention is directed to providing a process cartridge and an image-forming method each of which has a high property by which an external additive that has migrated to the surface of a photosensitive member is cleaned out even at the initial stage of the use of a brand-new process cartridge or electrophotographic apparatus, and hence can provide satisfactory image quality.

A process cartridge of the present invention is a process cartridge detachably mountable to the main body of an electrophotographic apparatus, and includes an electrophotographic photosensitive member, a charging device, and a developing device. The charging device contacts with the electrophotographic photosensitive member to charge the electrophotographic photosensitive member. The developing device supplies a toner onto the electrophotographic photosensitive member to form a toner image. In addition, the electrophotographic photosensitive member and the toner have the following characteristics.

The electrophotographic photosensitive member includes a support, a charge generating layer, and a charge transporting layer that is adjacent to the charge generating layer and serves as an outermost surface layer of the electrophotographic photosensitive member in the stated order.

The charge transporting layer contains at least one kind of resin selected from a polyarylate resin and a polycarbonate resin, and the resin contains, in a structure thereof, a polysiloxane structure represented by the formula (1).

The toner contains a toner particle and an organic-inorganic composite fine particle present on a surface of the toner particle.

The organic-inorganic composite fine particle contains an inorganic fine particle and a resin particle, and the inorganic fine particle is present so that a protrusion derived from a particle shape of the inorganic fine particle is formed on a surface of the resin particle.

(1)

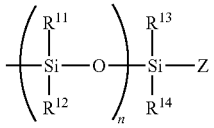

(In the formula (1), $R^{11}$ to $R^{14}$ each independently represent an alkyl group, a fluoroalkyl group, or a phenyl group, Z represents a hydrogen atom, a halogen atom, a substituted or unsubstituted alkyl group, or a substituted or unsubstituted aryl group, and n represents 10 or more and 200 or less.)

<Electrophotographic Photosensitive Member>

The electrophotographic photosensitive member to be used in the present invention is described in more detail.

The electrophotographic photosensitive member to be used in the present invention includes the support, the charge generating layer, and the charge transporting layer that is adjacent to the charge generating layer and serves as the outermost surface layer of the electrophotographic photosensitive member.

In general, a cylindrical electrophotographic photosensitive member obtained by forming photosensitive layers (a charge generating layer and a charge transporting layer) on a cylindrical support is widely used as the electrophotographic photosensitive member, but the electrophotographic photosensitive member can be of a shape such as a belt shape or a sheet shape.

A support having conductivity (conductive support) is preferred as the support, and a support made of a metal, such as aluminum, an aluminum alloy, or stainless steel, can be used. In the case of a support made of aluminum or an aluminum alloy, an ED tube or an EI tube, or a support obtained by subjecting any such tube to cutting, composite electrolytic polishing, or a wet or dry honing treatment can be used. In addition, a product obtained by forming a coating film on a metal support or a resin support through the vacuum deposition of aluminum, an aluminum alloy, or an indium oxide-tin oxide alloy can be used. The surface of the support may be subjected to a cutting treatment, a roughening treatment, an alumite treatment, or the like.

In addition, a support obtained by impregnating a conductive particle, such as carbon black, a tin oxide particle, a titanium oxide particle, or a silver particle, with a resin or the like, or a plastic having a conductive resin can be used.

A conductive layer may be arranged between the support and an undercoat layer to be described later or the charge generating layer for the purpose of suppressing interference fringes due to the scattering of laser light or the like, or covering a flaw in the support. The layer is formed by using a conductive layer coating liquid obtained by dispersing a conductive particle in a resin. Examples of the conductive particle include: carbon black; acetylene black; metal powders, such as aluminum, nickel, iron, Nichrome, copper, zinc, and silver; and metal oxide powders, such as conductive tin oxide and ITO.

Examples of the resin to be used in the conductive layer include a polyarylate resin, a polycarbonate resin, a polyvinyl butyral resin, an acrylic resin, a silicone resin, an epoxy resin, a melamine resin, a urethane resin, a phenol resin, and an alkyd resin.

Examples of the solvent of the conductive layer coating liquid include an ether-based solvent, an alcohol-based solvent, a ketone-based solvent, and an aromatic hydrocarbon solvent.

The thickness of the conductive layer is preferably 0.2 μm or more and 40 μm or less, more preferably 1 μm or more and 35 μm or less, still more preferably 5 μm or more and 30 μm or less.

In the electrophotographic photosensitive member to be used in the present invention, the undercoat layer may be arranged between the support or the conductive layer and the charge generating layer.

The undercoat layer can be formed by: applying an undercoat layer coating liquid containing a resin onto the support or the conductive layer; and drying or curing the coating liquid.

Examples of the resin to be used in the undercoat layer include polyacrylic acids, methylcellulose, ethylcellulose, a polyamide resin, a polyimide resin, a polyamide imide resin, a polyamic acid resin, a melamine resin, an epoxy resin, a polyurethane resin, and a polyolefin resin.

The thickness of the undercoat layer is preferably 0.05 μm or more and 7 μm or less, more preferably 0.1 μm or more and 2 μm or less.

In addition, a semiconductive particle, an electron transporting substance, or an electron accepting substance may be incorporated into the undercoat layer.

The charge generating layer is arranged on the support, the conductive layer, or the undercoat layer.

As a charge generating substance to be used in the charge generating layer, there are given, for example, an azo pigment, a phthalocyanine pigment, an indigo pigment, and a perylene pigment. One kind of those charge generating substances may be used alone, or two or more kinds thereof may be used in combination. Of those, a metallophthalocyanine, such as oxytitanium phthalocyanine, hydroxygallium phthalocyanine, or chlorogallium phthalocyanine, is particularly preferred because of its high sensitivity.

As a resin to be used in the charge generating layer, there are given, for example, a polycarbonate resin, a polyarylate resin, a butyral resin, a polyvinyl acetal resin, an acrylic resin, a vinyl acetate resin, and a urea resin. Of those, a butyral resin is particularly preferred. One kind of those resins can be used alone, or two or more kinds thereof can be used as a mixture or a copolymer.

The charge generating layer can be formed by: applying a charge generating layer coating liquid obtained by dispersing the charge generating substance together with the resin and a solvent; and drying the resultant applied film.

A method for the dispersion is, for example, a method involving using a homogenizer, an ultrasonic wave, a ball mill, a sand mill, an attritor, or a roll mill.

A ratio between the charge generating substance and the resin preferably falls within the range of from 1:10 to 10:1 (mass ratio), and particularly preferably falls within the range of from 1:1 to 3:1 (mass ratio).

Examples of the solvent to be used in the charge generating layer coating liquid include an alcohol-based solvent, a sulfoxide-based solvent, a ketone-based solvent, an ether-based solvent, an ester-based solvent, and an aromatic hydrocarbon solvent.

The thickness of the charge generating layer is preferably 0.01 μm or more and 5 μm or less, more preferably 0.1 μm or more and 2 μm or less.

In addition, various sensitizers, antioxidants, UV absorbers, plasticizers, and the like can each be added to the charge generating layer as required. In addition, an electron transporting substance or an electron accepting substance may be incorporated into the charge generating layer for preventing the flow of charge in the charge generating layer from stagnating.

The charge transporting layer is arranged on the charge generating layer.

In the present invention, the charge transporting layer contains at least one kind of resin selected from a polyarylate resin containing, in its structure, the polysiloxane structure represented by the formula (1) (hereinafter sometimes referred to as "polyarylate resin A") and a polycarbonate resin containing, in its structure, the polysiloxane structure represented by the formula (1) (hereinafter sometimes referred to as "polycarbonate resin B").

(i) When Polysiloxane Structure is Introduced into at Least Part of Terminal of Resin In the present invention, the polysiloxane structure represented by the formula (1) is preferably introduced into at least part of a terminal of the polyarylate resin A or the polycarbonate resin B. Further, a polysiloxane structure represented by the following formula (2) is more preferably introduced as the polysiloxane structure represented by the formula (1).

(2)

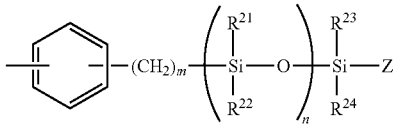

The formula (2) represents a monovalent group, and the group is introduced into at least part of the terminal of the resin at the left end of the formula. In the formula (2), $R^{21}$ to $R^{24}$ each independently represent an alkyl group, a fluoroalkyl group, or a phenyl group. Of those, an alkyl group or a phenyl group is preferred, and a methyl group or a phenyl group is more preferred.

Z in the formula (2) represents an alkyl group having 1 to 4 carbon atoms or a phenyl group.

n in the formula (2) represents the number of repetitions of a structure in parentheses, and represents or more and 200 or less from the viewpoint that compatibility between a satisfactory cleaning property and a satisfactory electrical characteristic can be achieved.

m in the formula (2) represents the number of repetitions of a structure in parentheses, and represents 1 or more and 3 or less.

Specific examples of the structure represented by the formula (2) are shown below, but the structure is not limited thereto.

(2-1)
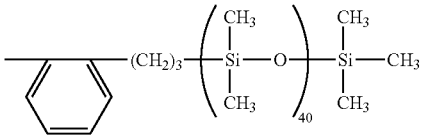
(2-2)
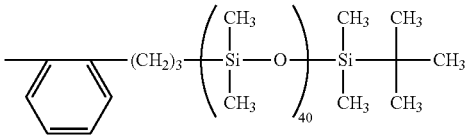
(2-3)
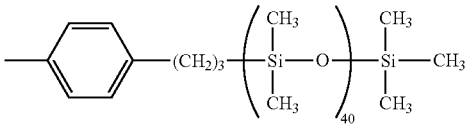
(2-4)
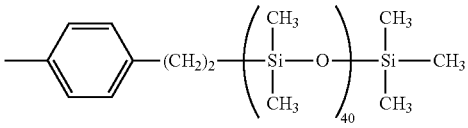
(2-5)
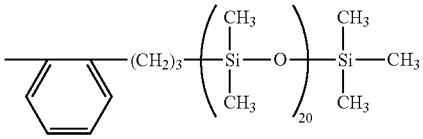
(2-6)
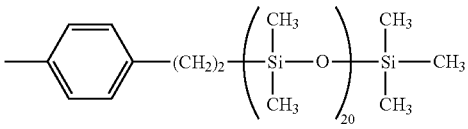
(2-7)
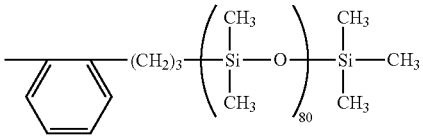
(2-8)
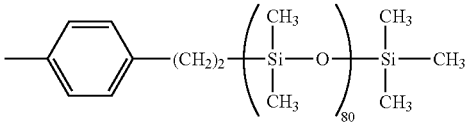
(2-9)
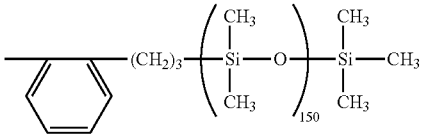
(2-10)
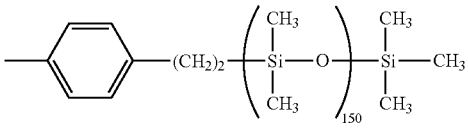
-continued
(2-11)
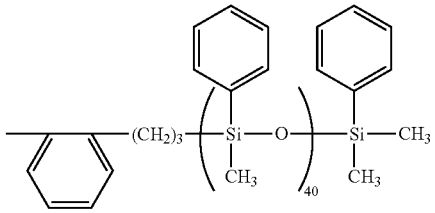
(2-12)
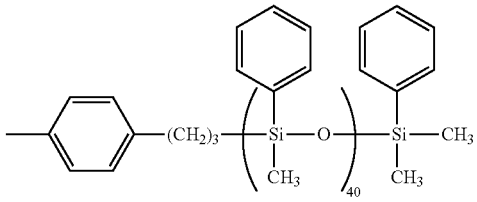
(2-13)
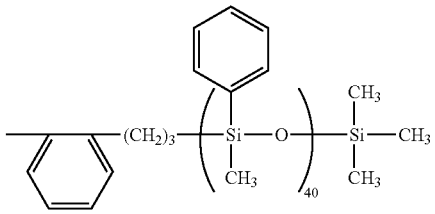
(2-14)
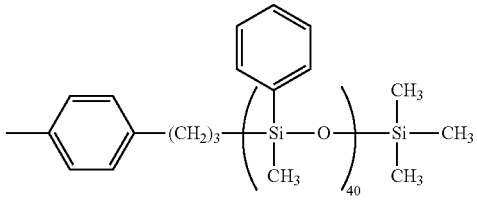
(2-15)
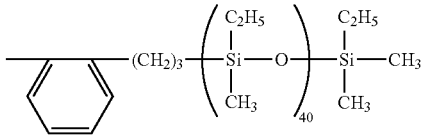
(2-16)
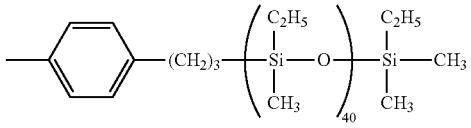
(2-17)
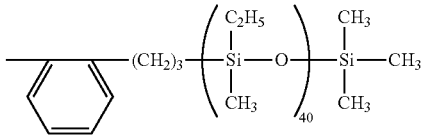
(2-18)
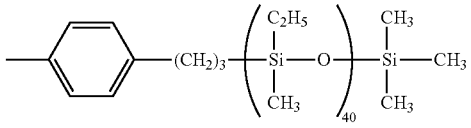
Of those, a structure represented by the formula (2-1), (2-2), (2-5), (2-7), (2-11), or (2-13) is preferred. In addition, only one kind of the structures may be used, or two or more kinds thereof may be used in combination.

(i-1) Polyarylate Resin A

In the polyarylate resin having the polysiloxane structure represented by the formula (2) in at least part of a terminal thereof, a structural unit constituting its main chain whose terminal has bonded thereto the polysiloxane structure represented by the formula (2) is, for example, a structural unit represented by the formula (9) or (10) to be described later. That is, in the present invention, the polyarylate resin containing, in its structure, the polysiloxane structure represented by the formula (1) is preferably the following resin: the resin contains at least one kind of structural unit selected from the structural unit represented by the formula (9) and the structural unit represented by the formula (10), and the polysiloxane structure represented by the formula (2) is introduced into at least part of a terminal of the resin.

(i-2) Polycarbonate Resin B

In the polycarbonate resin having the polysiloxane structure represented by the formula (2) in at least part of a terminal thereof, a structural unit constituting its main chain whose terminal has bonded thereto the polysiloxane structure represented by the formula (2) is, for example, a structural unit represented by the formula (11) or (12) to be described later. That is, in the present invention, the polycarbonate resin containing, in its structure, the polysiloxane structure represented by the formula (1) is preferably the following resin: the resin contains at least one kind of structural unit selected from the structural unit represented by the formula (11) and the structural unit represented by the formula (12), and the polysiloxane structure represented by the formula (2) is introduced into at least part of a terminal of the resin.

(ii) When Resin Contains Structural Unit Containing Polysiloxane Structure

In the present invention, the polyarylate resin A or the polycarbonate resin B is preferably a resin containing a structural unit containing the polysiloxane structure represented by the formula (1).

Further, the polysiloxane structure represented by the formula (1) or the formula (2) may be introduced into at least part of a terminal of the polyarylate resin A or the polycarbonate resin B containing the structural unit containing the polysiloxane structure represented by the formula (1).

(ii-1) Polyarylate Resin A

In the present invention, the polyarylate resin A is preferably a resin containing at least one kind of structural unit selected from a structural unit represented by the formula (3), a structural unit represented by the formula (4), and a structural unit represented by the formula (5). The resin is more preferably a resin containing the structural unit represented by the formula (5) out of the structural units.

In addition, the polyarylate resin containing at least one kind of structural unit selected from the structural units represented by the formula (3), the formula (4), and the formula (5) may further have, as a structural unit constituting its main chain, a structural unit represented by the formula (9) or (10) to be described later.

Structural Unit represented by Formula (3)

(3)

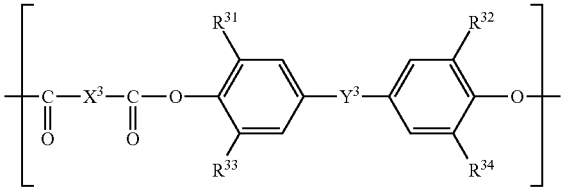

In the formula (3), at least one group of $R^{31}$ to $R^{34}$ is a polysiloxane structure represented by the formula (3-A) and other groups are each independently a hydrogen atom, an alkyl group, or a fluoroalkyl group.

$X^3$ represents a m-phenylene group, a p-phenylene group, or a divalent group obtained by bonding two p-phenylene groups through an oxygen atom.

$Y^3$ represents a single bond, a methylene group, an ethylidene group, a propylidene group, or a phenylethylidene group.

(3-A)

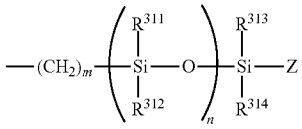

In the formula (3-A), $R^{311}$ to $R^{314}$ each independently represent an alkyl group, a fluoroalkyl group, or a phenyl group. Of those, an alkyl group or a phenyl group is preferred, and a methyl group is more preferred.

Z represents an alkyl group having 1 to 4 carbon atoms or a phenyl group.

n represents the number of repetitions of a structure in parentheses, and represents 10 or more and 200 or less from the viewpoint that compatibility between a satisfactory cleaning property and a satisfactory electrical characteristic can be achieved.

m represents the number of repetitions of a structure in parentheses, and represents 0 or more and 5 or less.

Specific examples of the structure represented by the formula (3-A) are shown below, but the structure is not limited thereto.

(3-A-1)

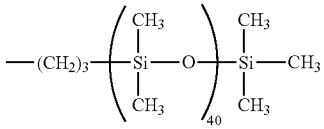

(3-A-2)

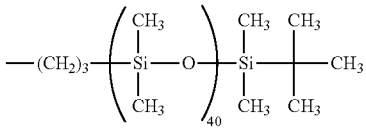

(3-A-3)

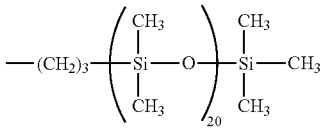

(3-A-4)

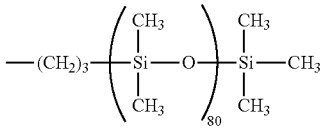

-continued (3-A-5)

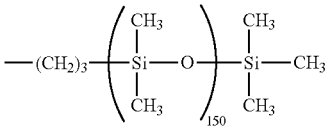

(3-A-6)

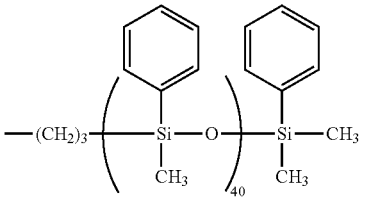

(3-A-7)

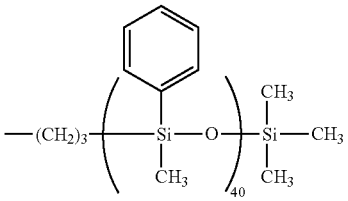

-continued (3-A-8)

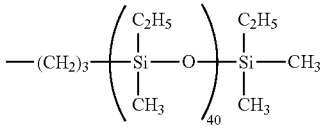

(3-A-9)

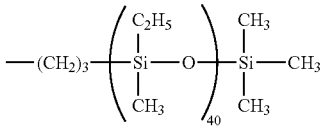

Of those, a structure represented by the formula (3-A-1), (3-A-2), (3-A-4), or (3-A-7) is preferred. In addition, only one kind of the structures may be used, or two or more kinds thereof may be used in combination.

Specific examples of the structural unit represented by the formula (3) are shown below, but the structural unit is not limited thereto. In the formulae (3-1) to (3-14), A represents the formula (3-A).

(3-1)

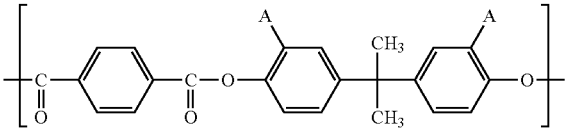

(3-2)

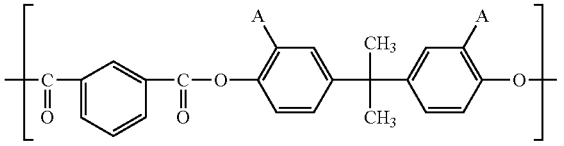

(3-3)

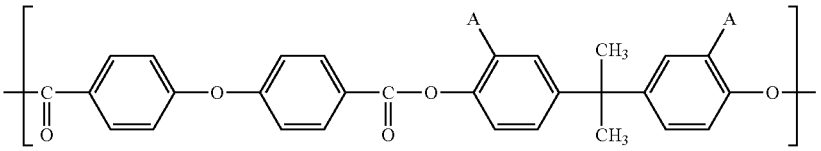

(3-4)

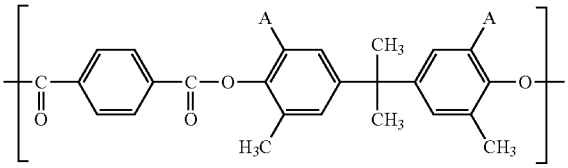

(3-5)

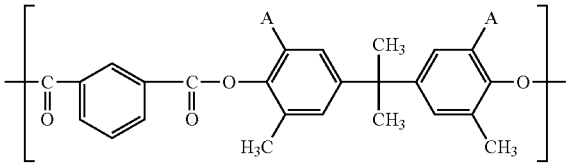

(3-6)

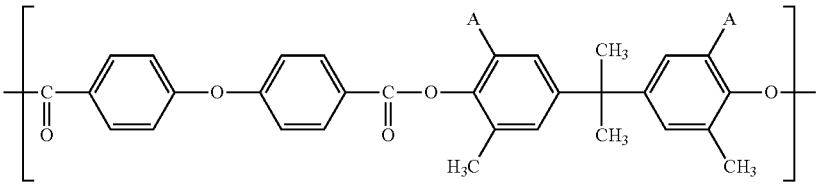

(3-7)

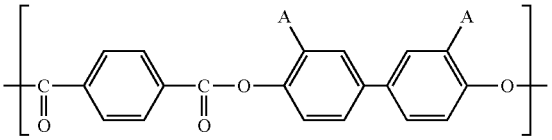

(3-8)

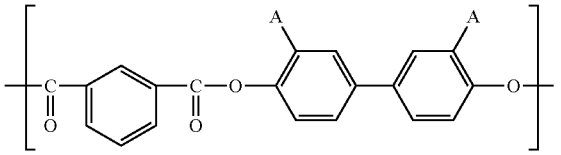

-continued (3-9)

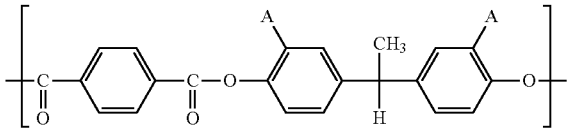

(3-10)

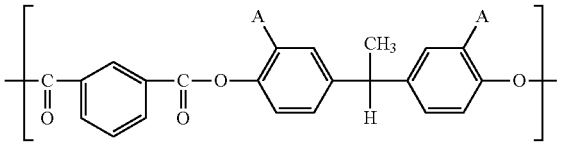

(3-11)

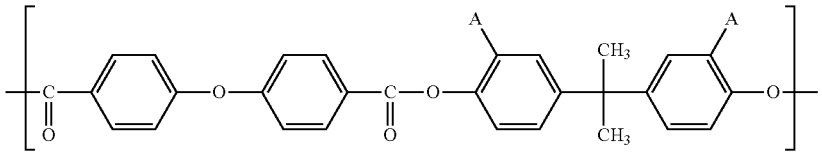

(3-12)

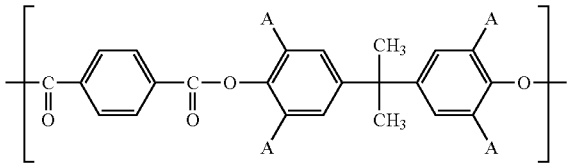

(3-13)

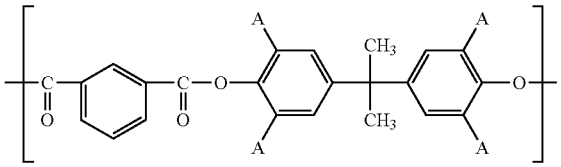

(3-14)

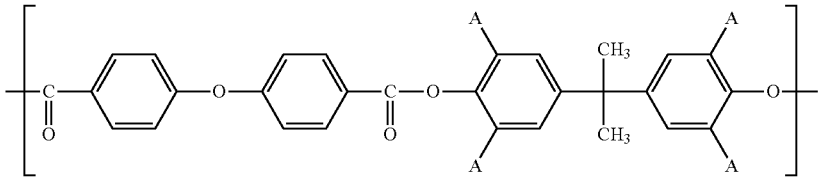

Of those, a structural unit represented by the formula (3-1), (3-2), (3-3), (3-4), (3-5), (3-6), (3-7), or (3-11) is preferred. In addition, only one kind of the structural units may be used, or two or more kinds thereof may be used in combination.

Structural Unit represented by Formula (4)

(4)

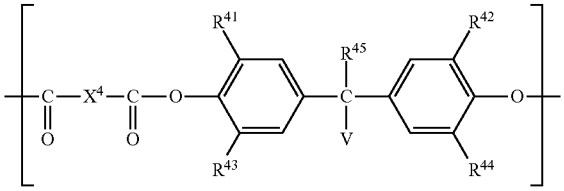

In the formula (4), $R^{41}$ to $R^{44}$ each independently represent a hydrogen atom, an alkyl group, or a fluoroalkyl group. Of those, a hydrogen atom or a methyl group is preferred.

$R^{45}$ represents a hydrogen atom, an alkyl group, a fluoroalkyl group, or a phenyl group. Of those, a hydrogen atom, a methyl group, or a phenyl group is preferred.

$X^4$ represents a m-phenylene group, a p-phenylene group, or a divalent group obtained by bonding two p-phenylene groups through an oxygen atom.

V represents a polysiloxane structure represented by the formula (4-A) or a polysiloxane structure represented by the formula (4-B).

(4-A)

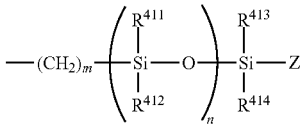

In the formula (4-A), $R^{411}$ to $R^{414}$ each independently represent an alkyl group, a fluoroalkyl group, or a phenyl group. Of those, a methyl group is preferred.

Z represents an alkyl group having 1 to 4 carbon atoms or a phenyl group.

n represents the number of repetitions of a structure in parentheses, and represents 10 or more and 200 or less from the viewpoint that compatibility between a satisfactory cleaning property and a satisfactory electrical characteristic can be achieved.

m represents the number of repetitions of a structure in parentheses, and represents 3 or more and 20 or less from the viewpoint of obtaining a satisfactory cleaning property. Further, a difference between the maximum and minimum of m is preferably 0 or more and 3 or less.

(4-B)

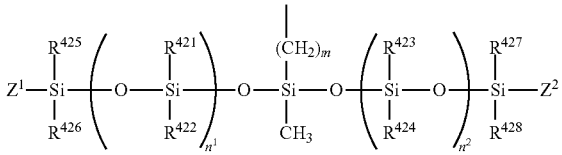

In the formula (4-B), $R^{421}$ to $R^{428}$ each independently represent an alkyl group, a fluoroalkyl group, or a phenyl group. Of those, a methyl group is preferred.

$Z^1$ and $Z^2$ each independently represent an alkyl group having 1 to 4 carbon atoms or a phenyl group.

$n^1$ and $n^2$ each represent the number of repetitions of a structure in parentheses, and each independently represent 10 or more and 200 or less, preferably 10 or more and 100 or less from the viewpoint that compatibility between a satisfactory cleaning property and a satisfactory electrical characteristic can be achieved. Further, the total value of $n^1$ and $n^2$ is 20 or more and 250 or less.

m represents 3 or more and 20 or less. Further, a difference between the maximum and minimum of m is preferably 0 or more and 3 or less.

Specific examples of the structural unit represented by the formula (4) are shown below, but the structural unit is not limited thereto. In the formulae (4-1) to (4-12), V represents the formula (4-A) or (4-B).

(4-1)

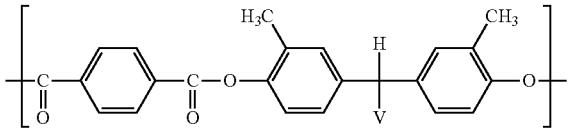

(4-2)

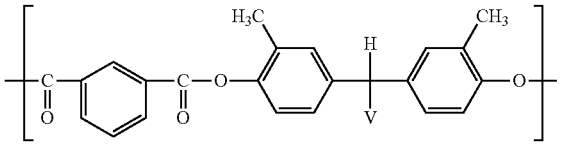

(4-3)

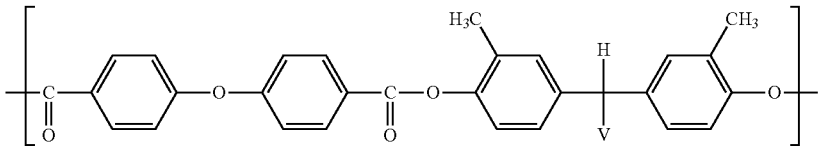

(4-4)

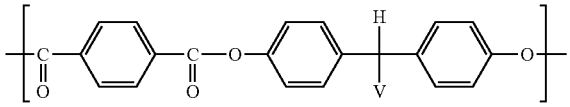

(4-5)

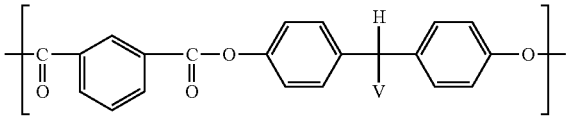

(4-6)

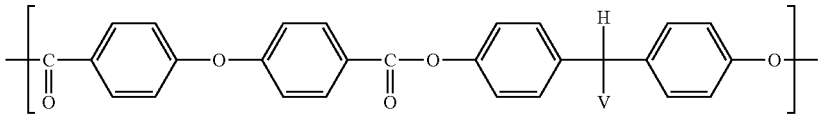

(4-7)

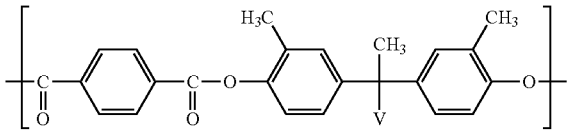

(4-8)

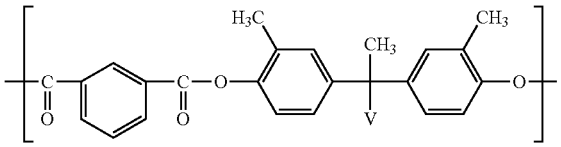

(4-9)

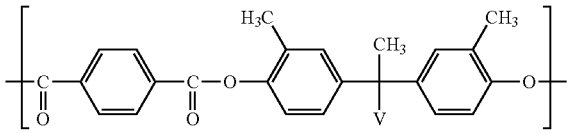

(4-10)

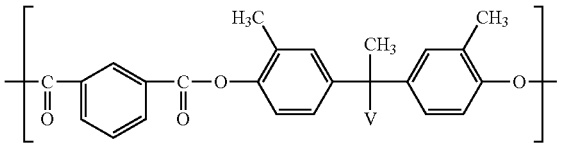

(4-11)

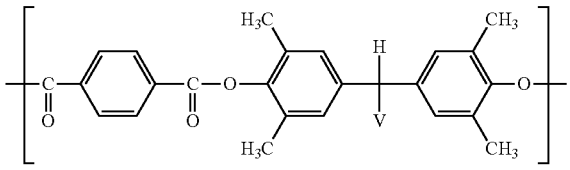

(4-12)

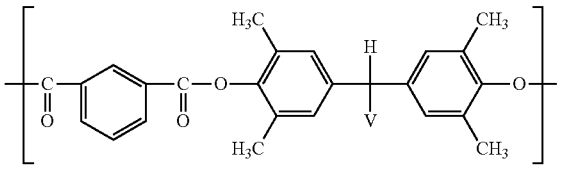

Of those, a structural unit represented by the formula (4-1), (4-2), (4-3), (4-4), (4-5), or (4-6) is preferred. In addition, only one kind of the structural units may be used, or two or more kinds thereof may be used in combination.

Structural Unit represented by Formula (5)

(5)

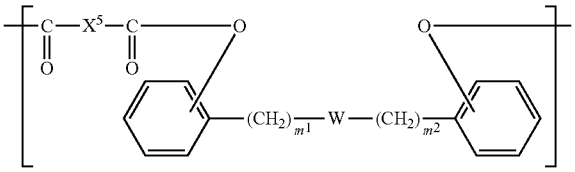

In the formula (5), $X^5$ represents a m-phenylene group, a p-phenylene group, or a divalent group obtained by bonding two p-phenylene groups through an oxygen atom.

$m^1$ and $m^2$ each independently represent 1 or more and 3 or less.

W represents a polysiloxane structure represented by the formula (5-A).

(5-A)

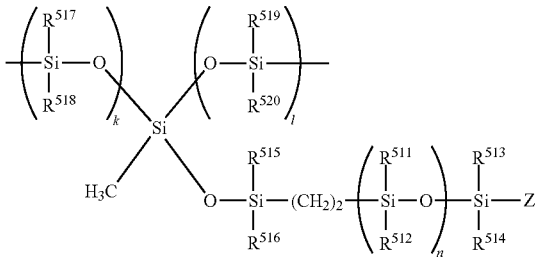

In the formula (5-A), $R^{511}$ to $R^{520}$ each independently represent an alkyl group, a fluoroalkyl group, or a phenyl group. Of those, a methyl group is preferred.

Z represents an alkyl group having 1 to 4 carbon atoms or a phenyl group.

n represents the number of repetitions of a structure in parentheses, and represents 10 or more and 200 or less, preferably 10 or more and 150 or less from the viewpoint that compatibility between a satisfactory cleaning property and a satisfactory electrical characteristic can be achieved.

k and l each independently represent 1 or more and 10 or less. Further, a difference between the maximum and minimum of k is preferably 0 or more and 3 or less. A difference between the maximum and minimum of 1 is preferably 0 or more and 3 or less.

Specific examples of the structural unit represented by the formula (5) are shown below, but the structural unit is not limited thereto. In the formulae (5-1) to (5-6), W represents the formula (5-A).

(5-1)

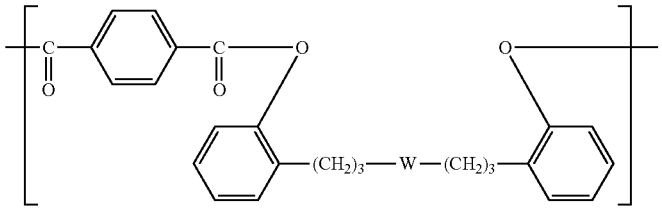

(5-2)

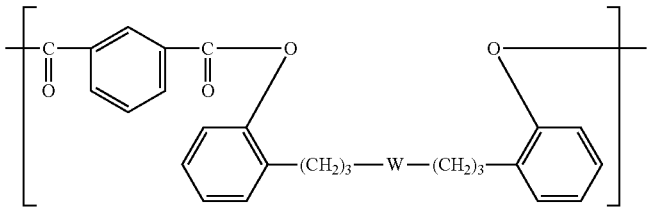

(5-3)

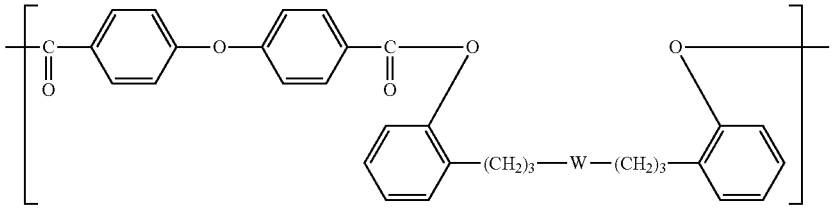

(5-4)

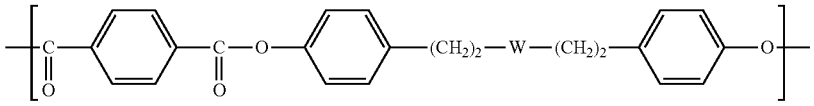

-continued (5-5)

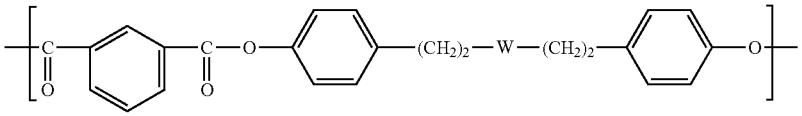

(5-6)

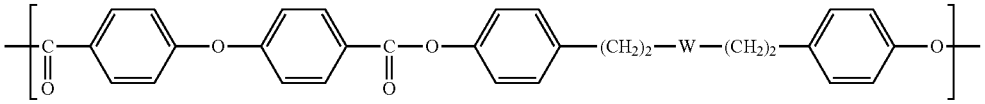

Of those, a structural unit represented by the formula (5-1), (5-2), or (5-3) is preferred. In addition, only one kind of the structural units may be used, or two or more kinds thereof may be used in combination.

(ii-2) Polycarbonate Resin B

The polycarbonate resin B is preferably a resin containing at least one kind of structural unit selected from a structural unit represented by the formula (6), a structural unit represented by the formula (7), and a structural unit represented by the formula (8). The resin is more preferably a resin containing the structural unit represented by the formula (8) out of the structural units.

In addition, the polycarbonate resin containing at least one kind of structural unit selected from the structural units represented by the formula (6), the formula (7), and the formula (8) may further have, as a structural unit constituting its main chain, a structural unit represented by the formula (11) or (12) to be described later.

Structural Unit represented by Formula (6)

(6)

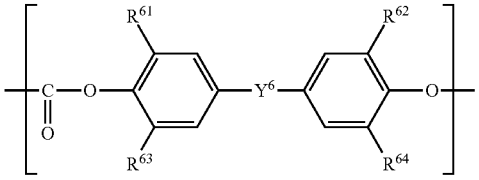

In the formula (6), at least one group of $R^{61}$ to $R^{64}$ is a polysiloxane structure represented by the formula (6-A) and other groups are each independently a hydrogen atom, an alkyl group, a fluoroalkyl group, or a phenyl group.

$Y^6$ represents a single bond, a methylene group, an ethylidene group, a propylidene group, a phenylethylidene group, a cyclohexylidene group, or an oxygen atom.

(6-A)

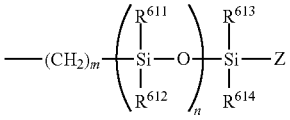

In the formula (6-A), $R^{611}$ to $R^{614}$ each independently represent an alkyl group, a fluoroalkyl group, or a phenyl group. Of those, an alkyl group or a phenyl group is preferred, and a methyl group is more preferred.

Z represents an alkyl group having 1 to 4 carbon atoms or a phenyl group.

n represents the number of repetitions of a structure in parentheses, and represents 10 or more and 200 or less from the viewpoint that compatibility between a satisfactory cleaning property and a satisfactory electrical characteristic can be achieved.

m represents the number of repetitions of a structure in parentheses, and represents 0 or more and 5 or less.

Specific examples of the group represented by the formula (6-A) are the same as those of the formulae (3-A-1) to (3-A-9). However, the group is not limited thereto. In addition, only one kind of the structures may be used, or two or more kinds thereof may be used in combination.

Specific examples of the structural unit represented by the formula (6) are shown below, but the structural unit is not limited thereto. In the formulae (6-1) to (6-9), A represents the formula (6-A).

(6-1)

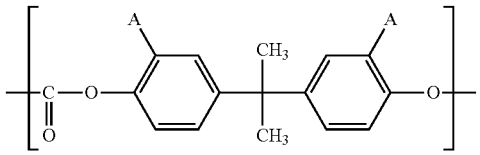

(6-2)

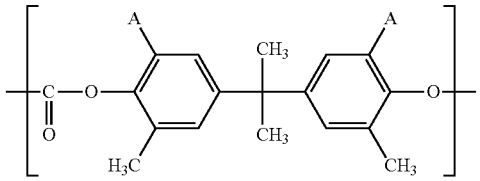

(6-3)

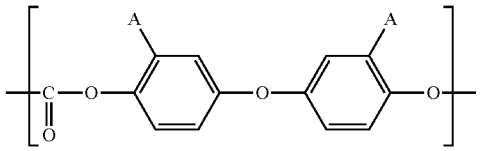

(6-4)

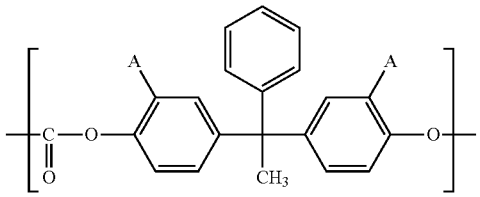

(6-5)

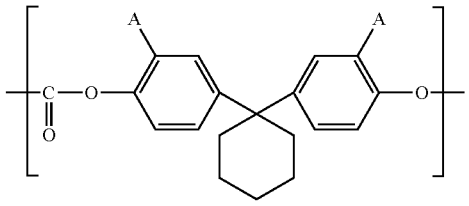

-continued (6-6)

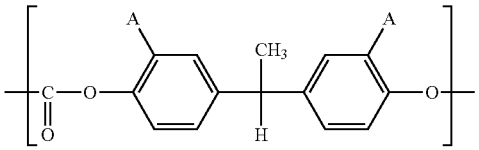

(6-7)

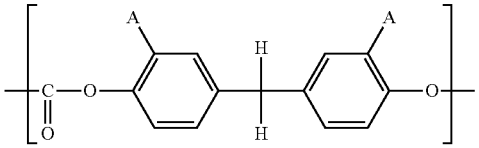

(6-8)

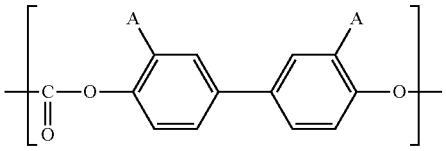

(6-9)

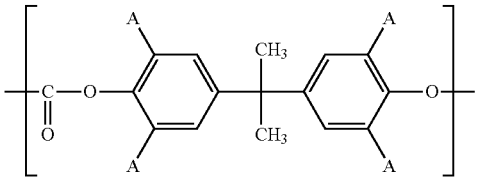

Of those, a structural unit represented by the formula (6-1), (6-3), (6-5), (6-6), or (6-8) is preferred. In addition, only one kind of the structural units may be used, or two or more kinds thereof may be used in combination.

Structural Unit represented by Formula (7)

(7)

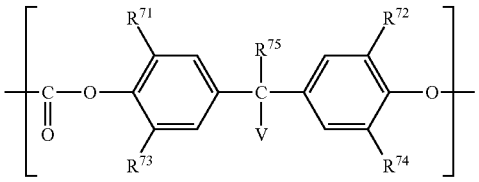

In the formula (7), $R^{71}$ to $R^{74}$ each independently represent a hydrogen atom, an alkyl group, a fluoroalkyl group, or a phenyl group. Of those, a hydrogen atom, an alkyl group having 1 to 4 carbon atoms, or a phenyl group is preferred.

$R^{75}$ represents a hydrogen atom, an alkyl group, a fluoroalkyl group, or a phenyl group. Of those, a hydrogen atom or a methyl group is preferred.

V represents a polysiloxane structure represented by the formula (7-A) or a polysiloxane structure represented by the formula (7-B).

(7-A)

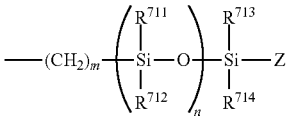

In the formula (7-A), $R^{711}$ to $R^{714}$ each independently represent an alkyl group, a fluoroalkyl group, or a phenyl group. Of those, a methyl group is preferred.

Z represents an alkyl group having 1 to 4 carbon atoms or a phenyl group.

n represents the number of repetitions of a structure in parentheses, and represents 10 or more and 200 or less from the viewpoint that compatibility between a satisfactory cleaning property and a satisfactory electrical characteristic can be achieved.

m represents the number of repetitions of a structure in parentheses, and represents 3 or more and 20 or less. Further, a difference between the maximum and minimum of m is preferably 0 or more and 3 or less.

(7-B)

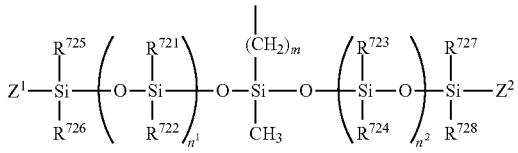

In the formula (7-B), $R^{721}$ to $R^{728}$ each independently represent an alkyl group, a fluoroalkyl group, or a phenyl group. Of those, a methyl group is preferred.

$Z^1$ and $Z^2$ each independently represent an alkyl group having 1 to 4 carbon atoms or a phenyl group.

$n^1$ and $n^2$ each represent the number of repetitions of a structure in parentheses, and each independently represent 10 or more and 200 or less, preferably 10 or more and 100 or less from the viewpoint that compatibility between a satisfactory cleaning property and a satisfactory electrical characteristic can be achieved. In addition, the total value of $n^1$ and $n^2$ is 20 or more and 250 or less.

m represents the number of repetitions of a structure in parentheses, and represents 3 or more and 20 or less. Further, a difference between the maximum and minimum of m is preferably 0 or more and 3 or less.

Specific examples of the structural unit represented by the formula (7) are shown below, but the structural unit is not limited thereto. In the formulae (7-1) to (7-4), V represents the formula (7-A) or (7-B).

(7-1)

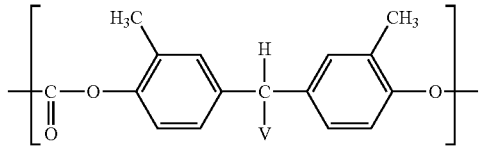

(7-2)

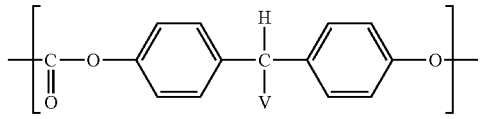

(7-3)

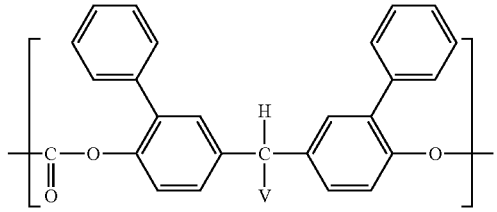

-continued (7-4)

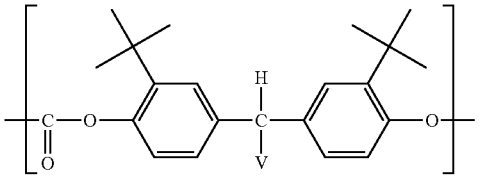

Of those, a structural unit represented by the formula (7-1) or (7-2) is preferred. In addition, only one kind of the structural units may be used, or two or more kinds thereof may be used in combination.

Structural Unit represented by Formula (8)

(8)

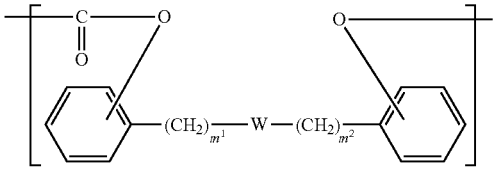

In the formula (8), $m^1$ and $m^2$ each represent the number of repetitions of a structure in parentheses, and each independently represent 1 or more and 3 or less.

W represents a polysiloxane structure represented by the formula (8-A).

(8-A)

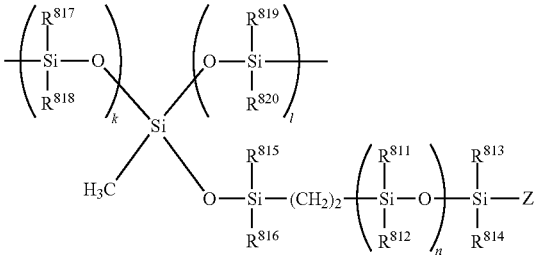

In the formula (8-A), $R^{811}$ to $R^{820}$ each independently represent an alkyl group, a fluoroalkyl group, or a phenyl group. Of those, a methyl group is preferred.

Z represents an alkyl group having 1 to 4 carbon atoms or a phenyl group.

n represents the number of repetitions of a structure in parentheses, and represents 10 or more and 200 or less, preferably 10 or more and 150 or less from the viewpoint that compatibility between a satisfactory cleaning property and a satisfactory electrical characteristic can be achieved.

k and l each independently represent 1 or more and 10 or less. Further, a difference between the maximum and minimum of k is preferably 0 or more and 3 or less. A difference between the maximum and minimum of 1 is preferably 0 or more and 3 or less.

Specific examples of the structural unit represented by the formula (8) are shown below, but the structural unit is not limited thereto. In the formulae (8-1) and (8-2), W represents the formula (8-A).

(8-1)

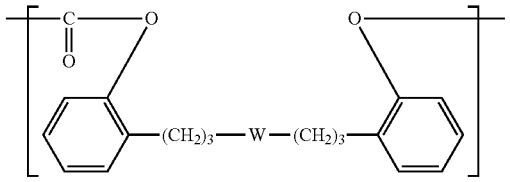

(8-2)

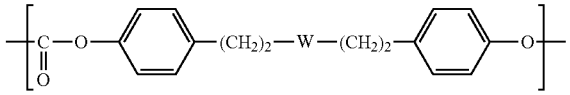

Of those, a structural unit represented by the formula (8-1) is preferred. In addition, only one kind of the structural units may be used, or two or more kinds thereof may be used in combination.

(iii) Structure Except Polysiloxane Structure (iii-1) Polyarylate Resin

In the present invention, the polyarylate resin A may further have, as a structural unit constituting its main chain, a structural unit represented by the formula (9) or (10). Only one kind of the structural units may be used, or two or more kinds thereof may be used in combination.

(9)

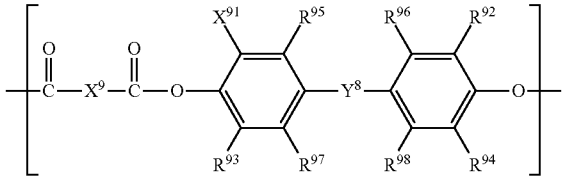

In the formula (9), $R^{91}$ to $R^{98}$ each independently represent a hydrogen atom, a substituted or unsubstituted alkyl group, or a substituted or unsubstituted aryl group. Of those, a hydrogen atom or a methyl group is preferred. $X^9$ represents a m-phenylene group, a p-phenylene group, or a divalent group obtained by bonding two p-phenylene groups through an oxygen atom. $Y^9$ represents a single bond, an oxygen atom, a sulfur atom, or a divalent organic group. Of those, a single bond or a divalent organic group having 1 to 3 carbon atoms is preferred.

(10)

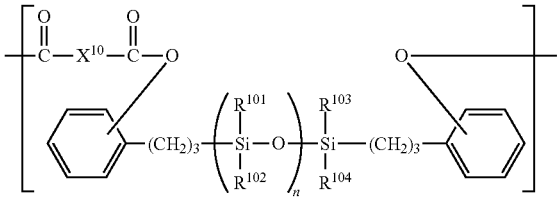

In the formula (10), $R^{101}$ to $R^{104}$ each independently represent a methyl group, an ethyl group, or a phenyl group, $X^{10}$ represents a m-phenylene group, a p-phenylene group, or a divalent group obtained by bonding two p-phenylene groups through an oxygen atom, and n represents the number of repetitions of a structure in parentheses, and preferably represents 10 or more and 150 or less.

Specific examples of the structural units represented by the formula (9) and the formula (10) are shown below, but the structural units are not limited thereto.

(9-1)
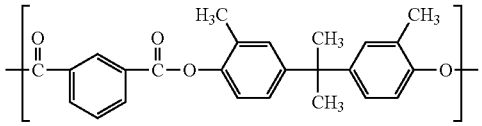
(9-2)
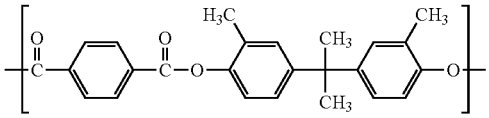
(9-3)
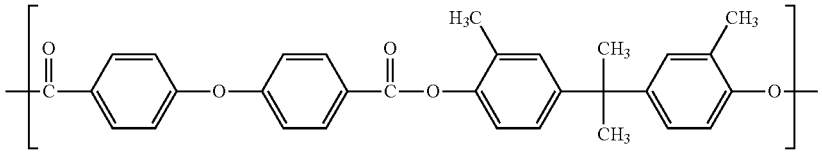
(9-4)
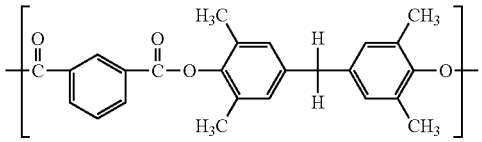
(9-5)
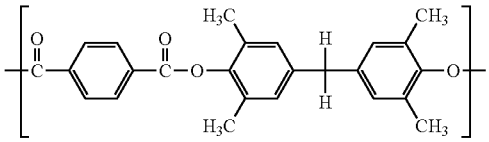
(9-6)
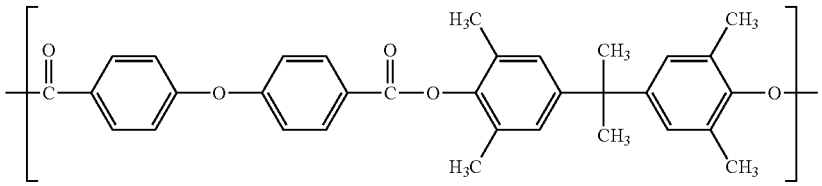
(9-7)
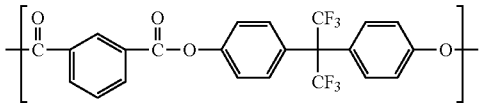
(9-8)
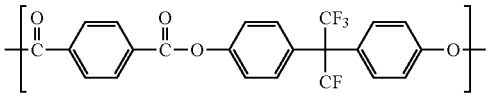
(9-9)
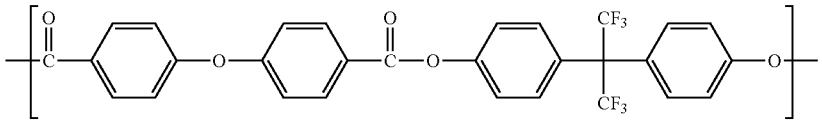
(9-10)
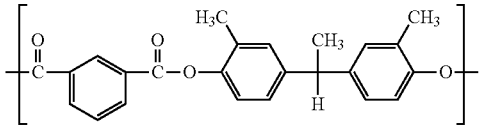
(9-11)
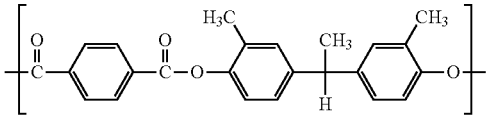
(9-12)
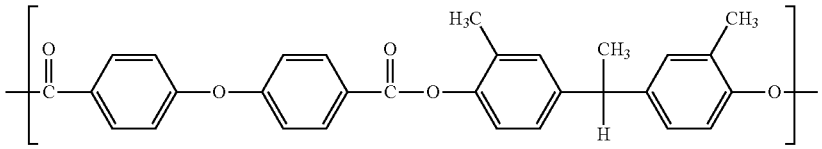
(9-13)
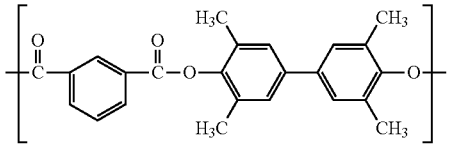
(9-14)
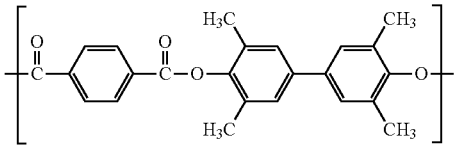
(9-15)
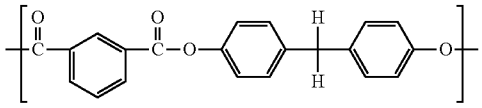
(9-16)
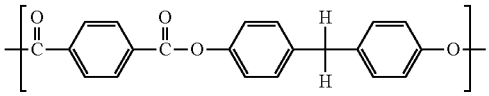

-continued
(10-1)
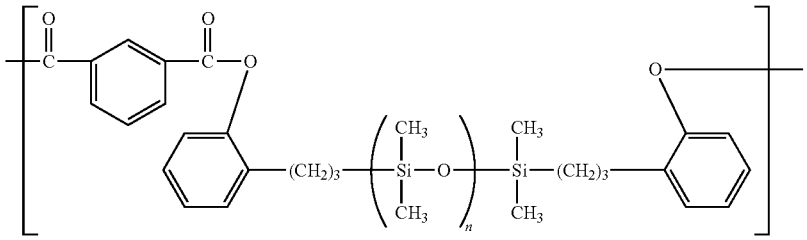
(10-2)
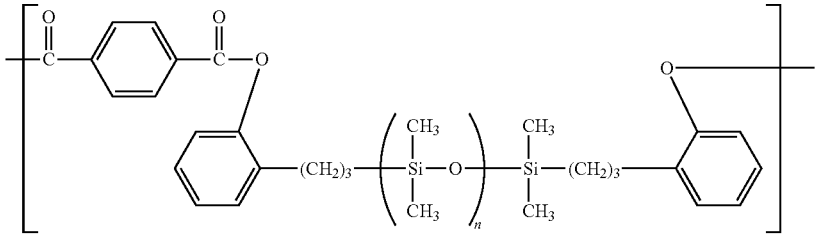
(10-3)
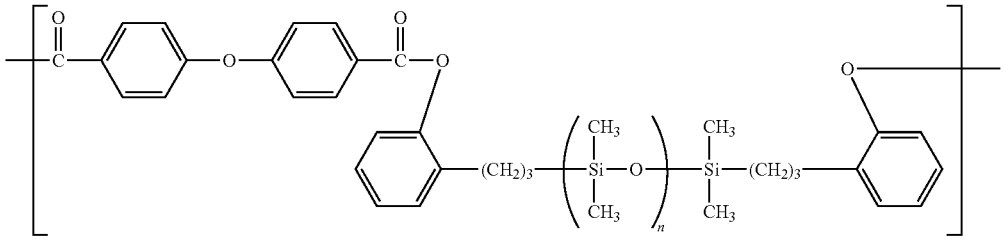
(10-4)
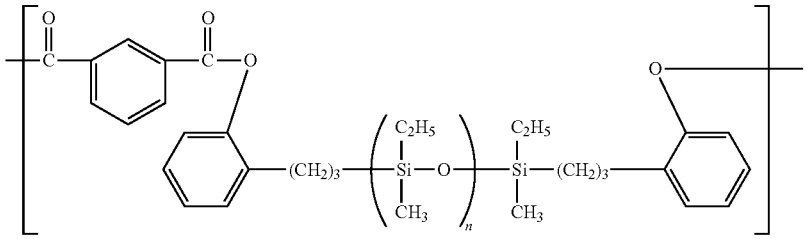
(10-5)
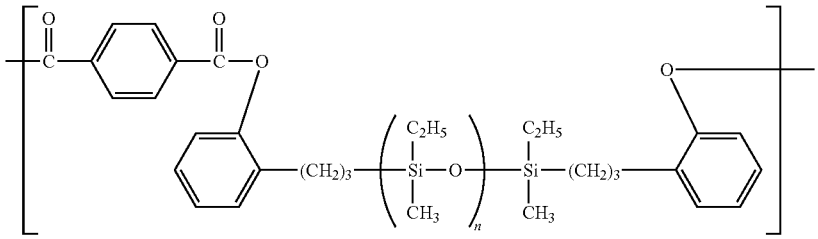
(10-6)
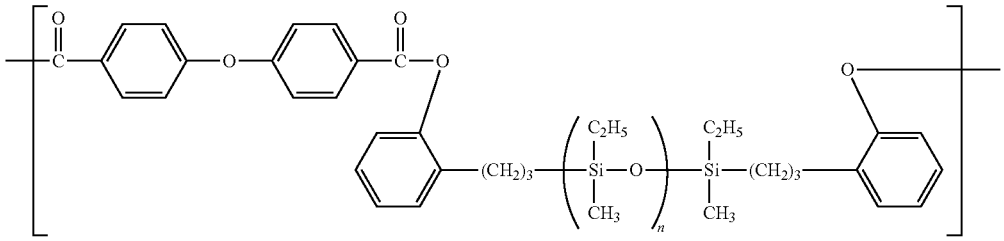

-continued (10-7)

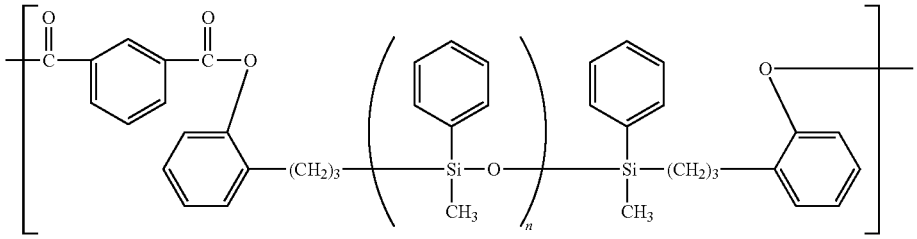

(10-8)

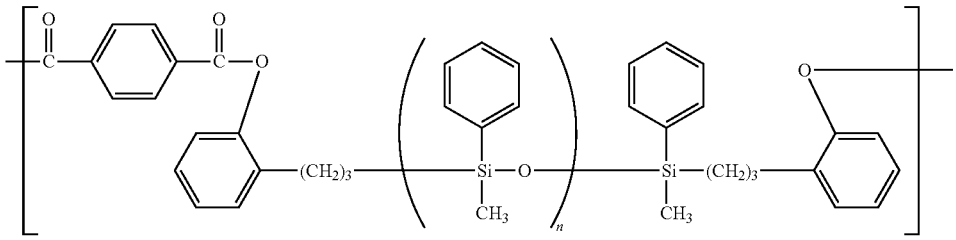

(10-9)

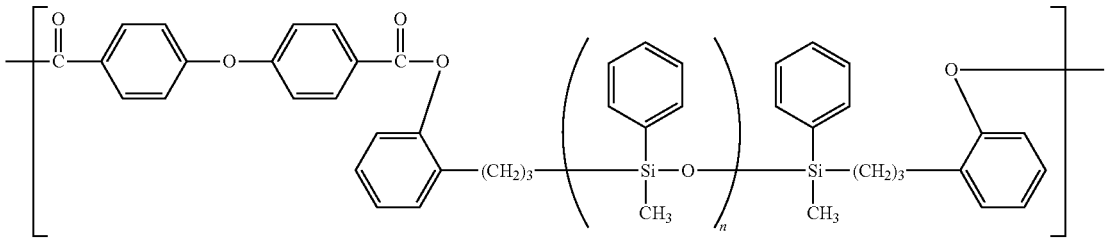

(iii-2) Polycarbonate Resin

In the present invention, the polycarbonate resin B may further have, as a structural unit constituting its main chain, a structural unit represented by the formula (11) or (12). Only one kind of the structural units may be used, or two or more kinds thereof may be used in combination.

(11)

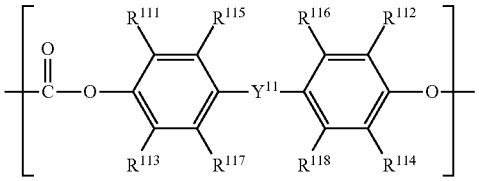

In the formula (11), $R^{111}$ to $R^{118}$ each independently represent a hydrogen atom, a substituted or unsubstituted alkyl group, or a substituted or unsubstituted aryl group. Of those, a hydrogen atom or a methyl group is preferred. $Y^{11}$ represents a single bond, an oxygen atom, a sulfur atom, or a divalent organic group. Of those, a single bond, a divalent organic group having 1 to 3 carbon atoms, a phenylethylidene group, a cyclohexylidene group, or an oxygen atom is preferred.

(12)

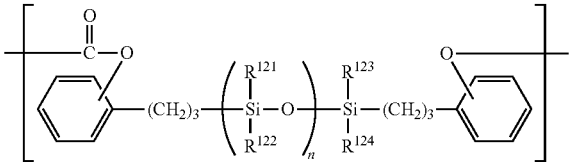

In the formula (12), $R^{121}$ to $R^{124}$ each independently represent a methyl group, an ethyl group, or a phenyl group, and n represents the number of repetitions of a structure in parentheses, and preferably represents 10 or more and 150 or less.

Specific examples of the structural units represented by the formula (11) and the formula (12) are shown below, but the structural units are not limited thereto.

(11-1)

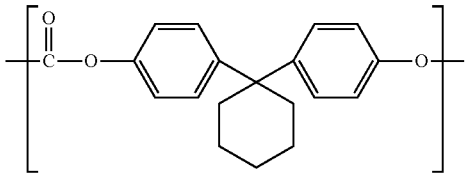

(11-2)

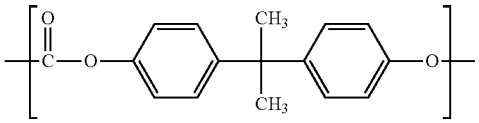

-continued
(11-3)
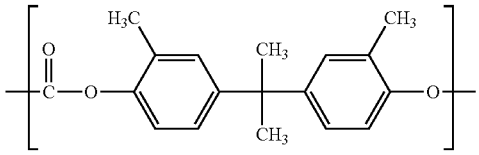
(11-4)
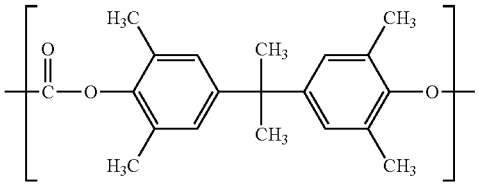
(11-5)
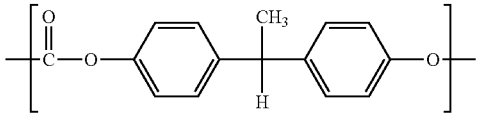
(11-6)
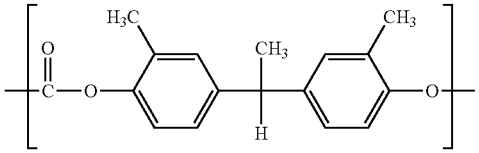
(11-7)
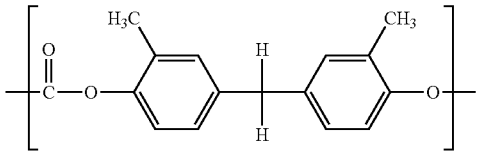
(11-8)
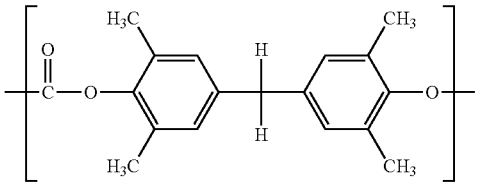
(11-9)
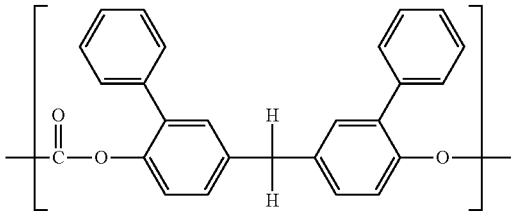
(11-10)
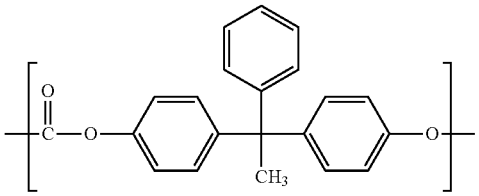
(11-11)
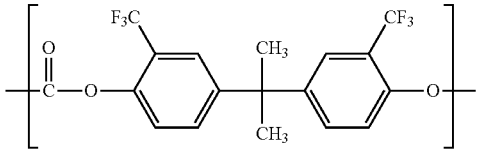
(11-12)
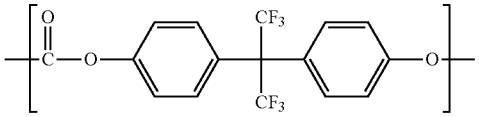
(11-13)
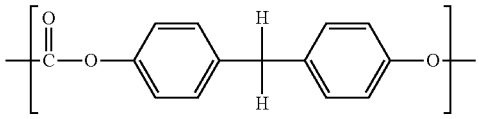
(11-14)
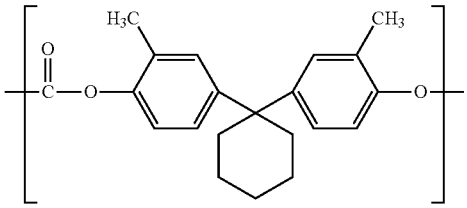
(11-15)
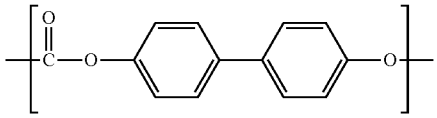
(11-16)
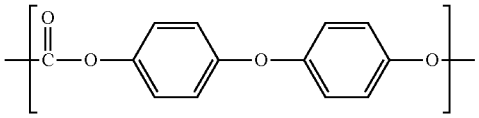
(11-17)
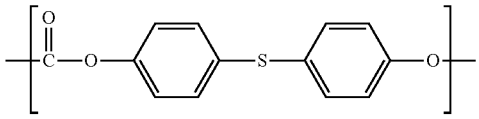
(11-18)
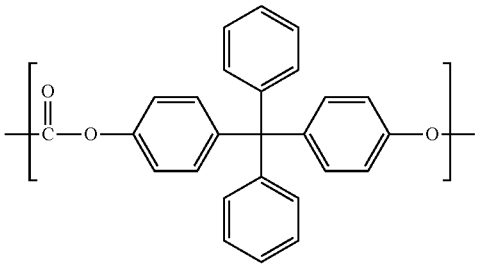

-continued (12-1)

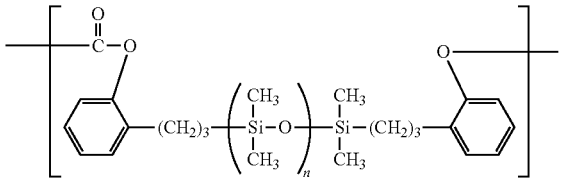

(12-2)

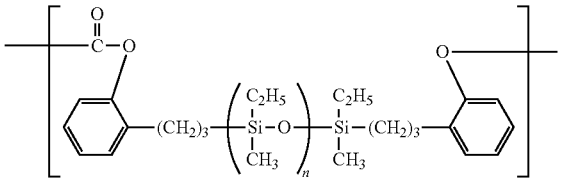

(12-3)

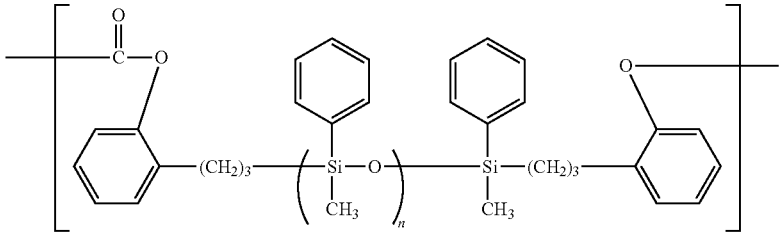

(12-4)

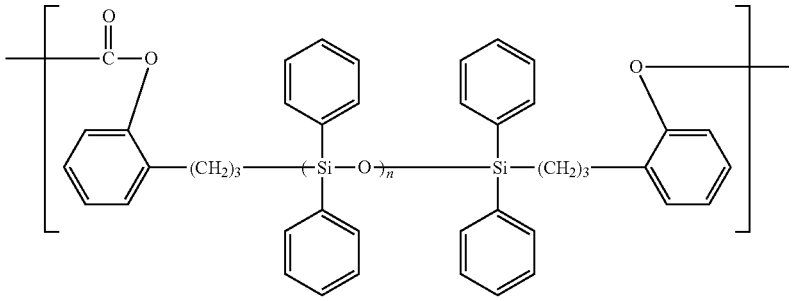

(12-5)

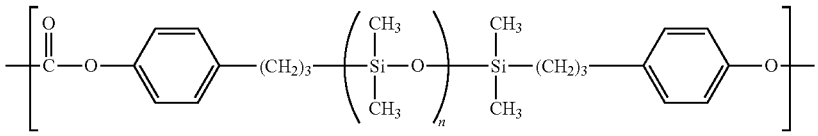

(12-6)

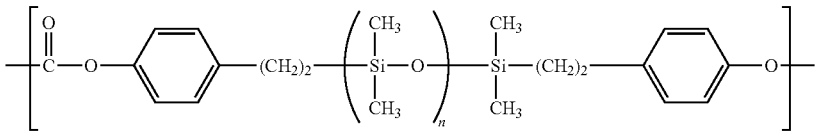

The ratio of the polysiloxane structure represented by the formula (1) to the polyarylate resin and the polycarbonate resin is preferably 0.5 mass % or more and 50 mass % or less from the viewpoints of the effects of the present invention. That is, the content of the structure represented by the formula (1) in the polyarylate resin A is preferably 0.5 mass % or more and 50 mass % or less with respect to the content of the entirety of the polyarylate resin A. In addition, the content of the structure represented by the formula (1) in the polycarbonate resin B is preferably 0.5 mass % or more and 50 mass % or less with respect to the content of the entirety of the polycarbonate resin B. A ratio of 0.5 mass % or more is preferred because an additionally satisfactory cleaning property can be obtained, and a ratio of 50 mass % or less is preferred because a satisfactory electrical characteristic of the photosensitive member can be obtained.

The ratio of the polysiloxane structure represented by the formula (1) can be confirmed by, for example, a conversion method based on the peak area ratio of a hydrogen atom obtained by the $^{1}$H-NMR measurement of a resin as a general approach.

In addition, in the present invention, the viscosity-average molecular weight (Mv) of each of the polyarylate resin A and the polycarbonate resin B is preferably 1,000 or more and 200,000 or less. The viscosity-average molecular weight is more preferably 5,000 or more and 100,000 or less from the viewpoints of synthesis and film formability.

In the present invention, the charge transporting layer serving as the surface layer (outermost surface layer) of the electrophotographic photosensitive member, which contains at least one kind of resin selected from the group consisting of the polyarylate resin A and the polycarbonate resin B, may use any other resin in combination therewith to the extent that the effects of the present invention are not impaired. In that case, the total content of the polyarylate resin A and the polycarbonate resin B in the charge transporting layer is preferably 0.1 mass % or more and 50 mass % or less with respect to the total mass of all solid matters in the charge transporting layer. In addition, when the polyarylate resin A and the polycarbonate resin B each have the polysiloxane structure represented by the formula (2) in at least part of a terminal thereof, the total content preferably falls within the following range because a satisfactory electrical characteristic of the photosensitive member is obtained. That is, the total content of the polyarylate resin A and the polycarbonate resin B in the charge transporting layer is more preferably 0.1 mass % or more and 20 mass % or less with respect to the total mass of all solid matters in the charge transporting layer.

Examples of the resin that can be used in combination with the at least one kind of resin include an acrylic resin, an acrylonitrile resin, an allyl resin, an alkyd resin, an epoxy resin, a silicone resin, a phenol resin, a phenoxy resin, a butyral resin, a polyacrylamide resin, a polyacetal resin, a polyamide imide resin, a polyamide resin, a polyallyl ether resin, a polyarylate resin, a polyimide resin, a polyurethane resin, a polyester resin, a polyethylene resin, a polycarbonate resin, a polystyrene resin, a polysulfone resin, a polyvinyl butyral resin, a polyphenylene oxide resin, a polybutadiene resin, a polypropylene resin, a methacrylic resin, a urea resin, a vinyl chloride resin, and a vinyl acetate resin. In particular, a polyester resin, a polyarylate resin, or a polycarbonate resin is preferred. Further, a polyarylate resin having the structural unit represented by the formula (9) or a polycarbonate resin having the structural unit represented by the formula (11) is more preferred. Specific examples of the structural unit represented by the formula (9) and the structural unit represented by the formula (11) are as described in the foregoing. One kind of the resins that can be used in combination with the polyarylate resin A or the polycarbonate resin B can be used alone, or two or more kinds thereof can be used as a mixture or a copolymer.

The charge transporting layer contains a charge transporting substance. Examples of the charge transporting substance include a triarylamine compound, a hydrazone compound, a styryl compound, a pyrazoline compound, an oxazole compound, a thiazole compound, a stilbene compound, a butadiene compound, and an enamine compound. Only one kind or two or more kinds of those charge transporting substances may be used.

Specific examples of the charge transporting substance are shown below, but the charge transporting substance is not limited thereto.

(13-1)

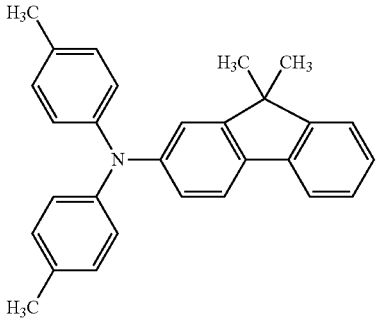

(13-2)

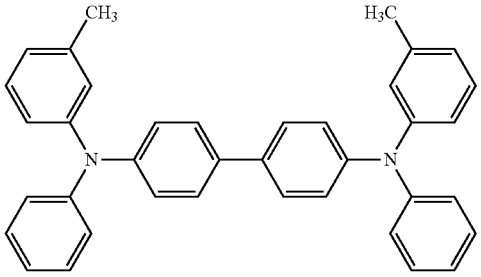

(13-3)

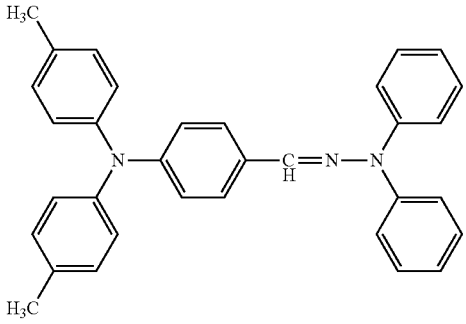

(13-4)

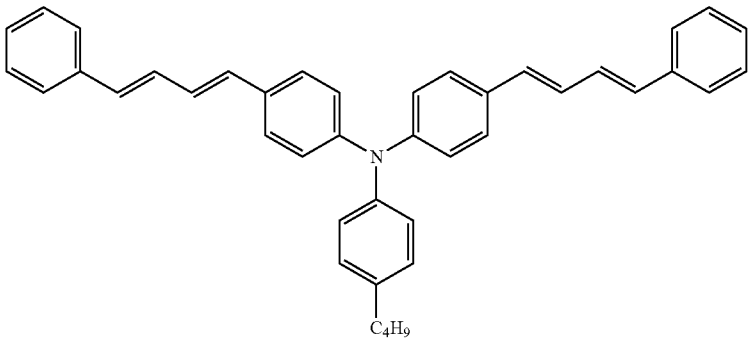

-continued (13-5)

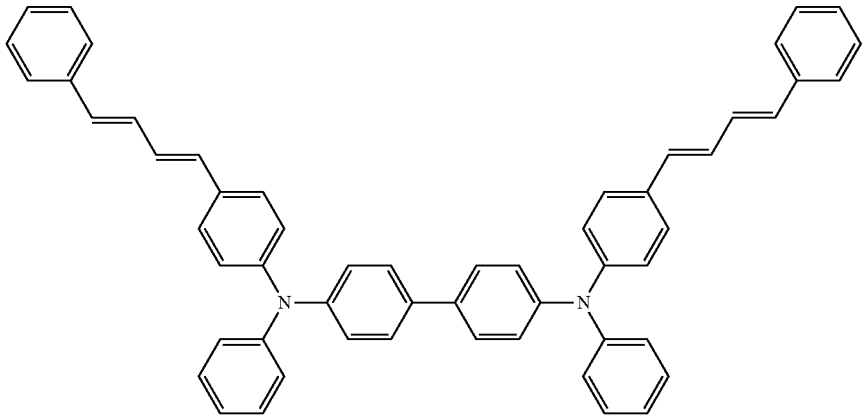

(13-6)

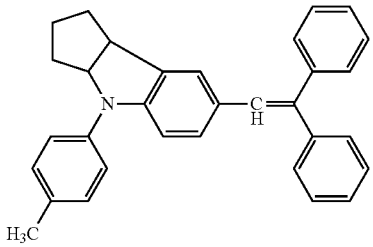

(13-7)

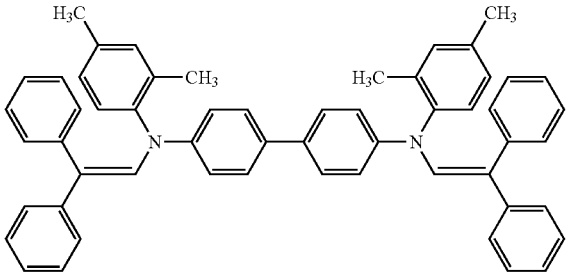

(13-8)

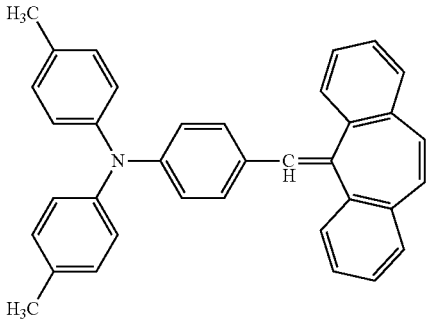

(13-9)

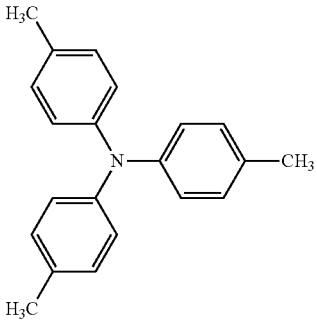

(13-10)

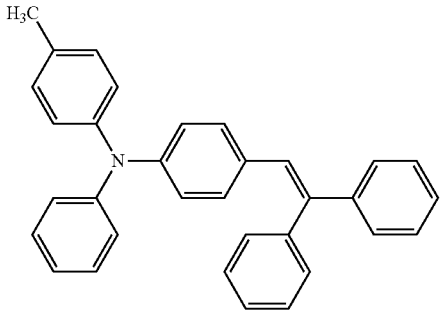

(13-11)

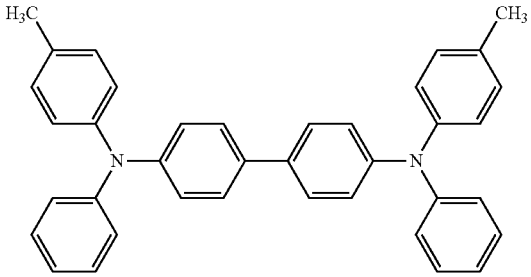

The charge transporting layer can be formed of an applied film of a charge transporting layer coating liquid obtained by dissolving at least one kind of resin selected from the group consisting of the polyarylate resin A and the polycarbonate resin B, and the charge transporting substance in a solvent. In addition, as described in the foregoing, a resin except the polyarylate resin A and the polycarbonate resin B may be used in combination therewith.

In addition, the charge transporting layer may be of a laminated structure. In that case, at least one kind of resin selected from the group consisting of the polyarylate resin A and the polycarbonate resin B is incorporated into at least the charge transporting layer on the side closest to the surface of the photosensitive member.

A ratio between the charge transporting substance and all resins in the charge transporting layer preferably falls within the range of from 3:10 to 20:10 (mass ratio), and more preferably falls within the range of from 5:10 to 12:10 (mass ratio).

Examples of the solvent to be used in the charge transporting layer coating liquid include a ketone-based solvent, an ester-based solvent, an ether-based solvent, and an aromatic hydrocarbon-based solvent. One kind of those solvents may be used alone, or two or more kinds thereof may be used as a mixture. Of those solvents, an ether-based solvent or an aromatic hydrocarbon-based solvent is preferably used from the viewpoint of the solubility of each resin.

The thickness of the charge transporting layer is preferably 5 μm or more and 50 μm or less, more preferably 10 μm or more and 35 μm or less.

Various additives can be added to the respective layers of the electrophotographic photosensitive member. Examples of the additives include: antidegradants, such as an antioxidant, a UV absorber, and a light stabilizer; and particles such as organic particles and inorganic particles. Examples of the antidegradants include a hindered phenol-based antioxidant, a hindered amine-based light stabilizer, a sulfur atom-containing antioxidant, and a phosphorus atom-containing antioxidant. Examples of the organic particles include polymeric resin particles, such as fluorine atom-containing resin particles, polystyrene resin particles, and polyethylene resin particles. Examples of the inorganic particles include metal oxide particles of silica, alumina, or the like.

The following application method may be used when the coating liquid for each of the layers is applied: an immersion application method (immersion coating method), a spray coating method, a spinner coating method, a roller coating method, a Mayer bar coating method, a blade coating method, or the like.

The extent to which a silicon-containing compound is present in the outermost surface of the surface layer can be known by measuring the abundance ratio of a silicon atom to all atoms except a hydrogen atom in the outermost surface of the electrophotographic photosensitive member. In the present invention, when the polyarylate resin A has the structural unit represented by the formula (5) or when the polycarbonate resin B has the structural unit represented by the formula (8), the abundance ratio of the silicon atom is preferably as described below. That is, the abundance ratio of the silicon atom to all atoms except the hydrogen atom in the outermost surface of the surface layer (charge transporting layer) of the electrophotographic photosensitive member measured by Electron spectroscopy for chemical analysis (ESCA) (X-ray photoelectron spectroscopy (XPS)) is preferably 0.6 atoms % or more. When the abundance ratio is 0.6 atoms % or more, an additionally satisfactory cleaning property is obtained. Further, an abundance ratio of 20 atoms % or less is preferred because a satisfactory cleaning property is obtained in an additionally stable manner. It should be noted that ESCA has no measurement sensitivity to a hydrogen atom.

In the present invention, the measurement of the abundance ratio of the silicon atom to all atoms except the hydrogen atom in the outermost surface of the surface layer of the electrophotographic photosensitive member by Electron spectroscopy for chemical analysis (ESCA) was performed as described below.

Apparatus used:

Quantum 2000 Scanning ESCA Microprobe manufactured by Physical Electronics Industries, Inc. (PHI)

Measurement conditions:

X-ray source: Al Ka 1,486.6 eV (25 W 15 kV)

Measurement area: ϕ100 μm

Spectral region: 1,500 μm×300 μm, angle: 45°

Pass energy: 117.40 eV

The surface atomic concentration (atoms %) of each element is calculated from its peak intensity measured under the above-mentioned conditions by using a relative sensitivity factor provided by PHI. The peak top region of the measurement of each element constituting the surface layer is as follows.

C1s: 278 eV to 298 eV

F1s: 680 eV to 700 eV

Si2p: 90 eV to 110 eV

O1s: 525 eV to 545 eV

N1s: 390 eV to 410 eV

<Toner>

Next, the toner to be used in the present invention is described.

The toner contains the toner particle and the organic-inorganic composite fine particle present on the surface of the toner particle. Further, the organic-inorganic composite fine particle contains the inorganic fine particle and the resin particle, and the inorganic fine particle is present so that the protrusion derived from the particle shape of the inorganic fine particle is formed on the surface of the resin particle. That is, the inorganic fine particle is exposed to the surface of the resin particle so that the protrusion derived from the particle shape of the inorganic fine particle is formed on the surface.

In order to improve the cleaning property, it is important that a material to be added to the surface of the toner particle be the organic-inorganic composite fine particle having the protrusion. The organic-inorganic composite fine particle has a structure in which the inorganic fine particle is exposed to the surface of the resin particle, e.g., a structure in which the inorganic fine particle is embedded in the surface of the resin particle, and the protrusion derived from the inorganic fine particle is present on the surface of the organic-inorganic composite fine particle. It is assumed that the protrusion serves as an anchor on the surface of the toner particle, and hence the organic-inorganic composite fine particle hardly migrates from the toner particle to the photosensitive member.

Further, when the surface layer of the photosensitive member contains at least one kind of resin selected from the group consisting of the polyarylate resin A and the polycarbonate resin B, the phenomenon in which the organic-inorganic composite fine particle migrates from the toner particle to the photosensitive member is additionally suppressed. Details about a mechanism for the foregoing are unclear, but it is probably because the protrusion derived from the inorganic fine particle formed on the surface of the organic-inorganic composite fine particle, and the polyarylate resin A and the polycarbonate resin B show a small adhesive force upon contact therebetween that the phenomenon is additionally suppressed. Thus, in the present invention, the occurrence of the organic-inorganic composite fine particle serving as an external additive migrating to the surface of the photosensitive member, the fine particle being responsible for the occurrence of a cleaning failure, is suppressed. As a result, the toner has a satisfactory cleaning property even at the initial stage of the use of a brand-new process cartridge or electrophotographic apparatus, and hence can suppress a reduction in image quality due to the contamination of a charging member.

The surface abundance ratio of the inorganic fine particles constituting the organic-inorganic composite fine particle is more preferably 20% or more and 70% or less from the viewpoint that the effects of the present invention are obtained with additional sufficiency.

The number-average particle diameter of the organic-inorganic composite fine particles is preferably 70 nm or more and 500 nm or less. When the number-average particle diameter is 70 nm or more and 500 nm or less, the organic-inorganic composite fine particle is stably present on the surface of the toner particle with ease. Further, the number-average particle diameter is more preferably 70 nm or more and 200 nm or less.

The number-average particle diameter of the organic-inorganic composite fine particles can be adjusted by changing the particle diameter of the inorganic fine particle to be used in the organic-inorganic composite fine particle, or an amount ratio between the inorganic fine particle and the resin.

The inorganic fine particle of the organic-inorganic composite fine particle is preferably silica or a metal oxide fine particle. When the inorganic fine particle of the organic-inorganic composite fine particle is silica or the metal oxide fine particle, satisfactory developability is obtained because the inorganic fine particle is excellent in chargeability.

The organic-inorganic composite fine particle can be produced in accordance with, for example, the description of Examples of International Publication WO2013/063291.

The content of the organic-inorganic composite fine particle is preferably 0.5 mass % or more and 5.0 mass % or less with respect to a content of the toner particle.

A binder resin in the toner particle in the present invention is described.

Examples of the binder resin include a polyester resin, a vinyl-based resin, an epoxy resin, and a polyurethane resin. In particular, from the viewpoint that a charge control agent having polarity is uniformly dispersed, the toner particle preferably contains a polyester resin that generally has high polarity in terms of developability.

The polyester resin is obtained by, for example, causing a dihydric alcohol component and a divalent acid component to react with each other.

Examples of the dihydric alcohol component include chain aliphatic diols, such as ethylene glycol, diethylene glycol, triethylene glycol, 1,2-propylene glycol, 1,3-propylene glycol, dipropylene glycol, 1,4-butanediol, 1,4-butadiene glycol, trimethylene glycol, tetramethylene glycol, pentamethylene glycol, hexamethylene glycol, octamethylene glycol, nanomethylene glycol, decamethylene glycol, and neopentyl glycol.

Examples of the dihydric alcohol component also include aromatic diols, such as a bisphenol represented by the following formula (e-1) and a derivative thereof, and a diol represented by the following formula (e-2).

(e-1)

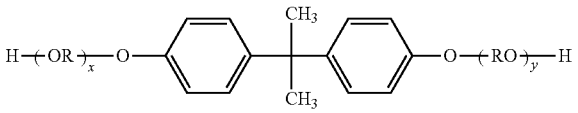

(In the formula (e-1), R represents an ethylene group or a propylene group, x and y each represent an integer of 1 or more, and the average value of x+y is 2 or more and 10 or less.)

(e-2)

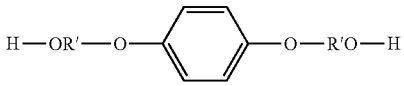

(In the formula (e-2), R' represents —$CH_2CH_2$—, —$CH_2CH(CH_3)$—, or —$CH_2C(CH_3)_2$—.)

Examples of the divalent acid component include dicarboxylic acids and derivatives thereof, such as: benzene dicarboxylic acids or anhydrides thereof, such as phthalic acid, terephthalic acid, isophthalic acid, and phthalic anhydride, or lower alkyl esters thereof; alkyldicarboxylic acids or anhydrides thereof, such as succinic acid, adipic acid, sebacic acid, and azelaic acid, or lower alkyl esters thereof; alkenylsuccinic acids or alkylsuccinic acids or anhydrides thereof, such as n-dodecenylsuccinic acid and n-dodecylsuccinic acid, or lower alkyl esters thereof; and unsaturated dicarboxylic acids or anhydrides thereof, such as fumaric acid, maleic acid, citraconic acid, and itaconic acid, or lower alkyl esters thereof.

In the present invention, the polyester resin is a polyester obtained by subjecting a carboxylic acid component containing 90 mol % or more of an aromatic carboxylic acid compound and an alcohol component to condensation polymerization, and 80 mol % or more of the aromatic carboxylic acid compound is preferably terephthalic acid and/or isophthalic acid.

In addition, it is preferred that one kind of an alcohol component that is trihydric or more and an acid component that is trivalent or more, the components serving as cross-linking components, be used alone, or two or more kinds thereof be used in combination for achieving additionally uniform dispersibility of an internal additive, such as magnetic iron oxide or a wax.

Examples of the polyhydric alcohol component that is trihydric or more include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methyl propanetriol, 2-methyl-1,2,4-butanetriol, trimethylolethane, trimethylolpropane, and 1,3,5-trihydroxybenzene.

Examples of the polyvalent carboxylic acid component that is trivalent or more include trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl)methane, 1,2,7,8-octanetetracarboxylic acid, and an enpol trimer acid, and anhydrides thereof.

It is preferred that the content of the alcohol component be 40 mol % or more and 60 mol % or less, preferably 45 mol % or more and 55 mol % or less, and the content of the acid component be 40 mol % or more and 60 mol % or less, preferably 45 mol % or more and 55 mol % or less.

The polyester resin is typically obtained by generally known condensation polymerization.

Meanwhile, the following monomers are given as vinyl-based monomers for producing the vinyl-based resin.

For example, there are given acrylic acid or methacrylic acid derivatives such as: styrene; derivatives of styrene, such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; unsaturated monoolefins, such as ethylene, propylene, butylene, and isobutylene; unsaturated polyenes, such as butadiene and isoprene; vinyl halides, such as vinyl chloride, vinylidene chloride, vinyl bromide, and vinyl fluoride; vinyl esters, such as vinyl acetate, vinyl propionate, and vinyl benzoate; α-methylene aliphatic monocarboxylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinylpyrrolidone; vinylnaphthalenes; acrylonitrile, methacrylonitrile, and acrylamide.

Further, there are given monomers each having a carboxyl group such as: unsaturated dibasic acids, such as maleic acid, citraconic acid, itaconic acid, an alkenylsuccinic acid, fumaric acid, and mesaconic acid; unsaturated dibasic acid anhydrides, such as maleic anhydride, citraconic anhydride, itaconic anhydride, and an alkenylsuccinic anhydride; unsaturated dibasic acid half esters, such as a methyl maleate half ester, an ethyl maleate half ester, a butyl maleate half ester, a methyl citraconate half ester, an ethyl citraconate half ester, a butyl citraconate half ester, a methyl itaconate half ester, a methyl alkenylsuccinate half ester, a methyl fumarate half ester, and a methyl mesaconate half ester; unsaturated dibasic acid esters, such as dimethyl maleate and dimethyl fumarate; α,β-unsaturated acids, such as acrylic acid, methacrylic acid, crotonic acid, and cinnamic acid; α,β-unsaturated acid anhydrides, such as crotonic anhydride and cinnamic anhydride, and anhydrides of the α,β-unsaturated acids and lower fatty acids; an alkenylmalonic acid, an alkenylglutaric acid, and an alkenyladipic acid, and acid anhydrides thereof and monoesters thereof.

Further, there are given monomers each having a hydroxy group such as: acrylic acid esters and mathacrylic acid esters, such as 2-hydroxyethyl acrylate, 2-hydroxyethyl methacrylate, and 2-hydroxypropyl methacrylate; 4-(1-hydroxy-1-methylbutyl)styrene and 4-(1-hydroxy-1-methylhexyl)styrene.

In the toner to be used in the present invention, the vinyl-based resin serving as the binder resin may have a crosslinked structure crosslinked with a crosslinking agent having two or more vinyl groups.

The following crosslinking agents are used in this case. As aromatic divinyl compounds, there are given, for example, divinylbenzene and divinylnaphthalene. As diacrylate compounds bonded by alkyl chains, there are given, for example, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and those obtained by changing the acrylates of the above-mentioned compounds to methacrylates. As diacrylate compounds bonded by alkyl chains each containing an ether bond, there are given, for example, diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and those obtained by changing the acrylates of the above-mentioned compounds to methacrylates. As diacrylate compounds bonded by chains each containing an aromatic group and an ether bond, there are given, for example, polyoxyethylene (2)-2,2-bis(4-hydroxyphenyl)propane diacrylate, polyoxyethylene(4)-2,2-bis(4-hydroxyphenyl)propane diacrylate, and those obtained by changing the acrylates of the above-mentioned compounds to methacrylates. As a polyester-type diacrylate compound, there is given, for example, a product available under the trade name MANDA (Nippon Kayaku Co., Ltd.). In addition, as polyfunctional crosslinking agents, there are given: pentaerythritol triacrylate, trimethylolethane triacrylate, trimethylolpropane triacrylate, tetramethylolmethane tetraacrylate, oligoester acrylate, and those obtained by changing the acrylates of the above-mentioned compounds to methacrylates; triallyl cyanurate; and triallyl trimellitate.

Each of those crosslinking agents may be used in an amount of preferably 0.01 part by mass or more and 10 parts by mass or less, more preferably 0.03 part by mass or more and 5 parts by mass or less with respect to 100 parts by mass of the other monomer components.

Of those crosslinking agents, aromatic divinyl compounds (in particular, divinylbenzene) and diacrylate compounds bonded by chains each containing an aromatic group and an ether bond are given as ones to be suitably used.

In addition, as a polymerization initiator to be used in the production of a vinyl-based copolymer, there are given, for example, 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutyrate, 1,1'-azobis(1-cyclohexanecarbonitrile), 2-(carbamoylazo)-isobutyronitrile, 2,2'-azobis(2,4,4-trimethylpentane), 2-phenylazo-2,4-dimethyl-4-methoxyvaleronitrile, 2,2-azobis(2-methylpropane), ketone peroxides, such as methyl ethyl ketone peroxide, acetylacetone peroxide, and cyclohexanone peroxide, 2,2-bis(t-butylperoxy)butane, t-butyl hydroperoxide, cumene hydroperoxide, 1,1,3,3-tetramethylbutyl hydroperoxide, di-t-butyl peroxide, t-butyl cumyl peroxide, dicumyl peroxide, α,α'-bis(t-butylperoxyisopropyl) benzene, isobutyl peroxide, octanoyl peroxide, decanoyl peroxide, lauroyl peroxide, 3,5,5-trimethylhexanoyl peroxide, benzoyl peroxide, m-toluoyl peroxide, di-isopropyl peroxydicarbonate, di-2-ethylhexyl peroxydicarbonate, di-n-propyl peroxydicarbonate, di-2-ethoxyethyl peroxycarbonate, dimethoxyisopropyl peroxydicarbonate, di(3-methyl-3-methoxybutyl) peroxycarbonate, acetyl cyclohexylsulfonyl peroxide, t-butyl peroxyacetate, t-butyl peroxyisobutyrate, t-butyl peroxyneodecanoate, t-butyl peroxy-2-ethylhexanoate, t-butyl peroxylaurate, t-butyl peroxybenzoate, t-butyl peroxyisopropylcarbonate, di-t-butyl peroxyisophthalate, t-butyl peroxyallylcarbonate, t-amyl peroxy-2-ethylhexanoate, di-t-butyl peroxyhexahydroterephthalate, and di-t-butyl peroxyazelate.

The binder resin has a glass transition point (Tg) of preferably 45° C. or more and 70° C. or less, more preferably 50° C. or more and 70° C. or less from the viewpoints of the storage stability and low-temperature fixability of the toner. The softening point Tm of the resin is preferably 90° C. or more and 130° C. or less from the viewpoint of suppressing an end-portion hot offset while maintaining the low-temperature fixability of the toner.

In the present invention, the weight-average particle diameter of the toner is preferably 2.5 μm or more and 10.0 μm or less, more preferably 5.0 μm or more and 9.0 μm or less, particularly preferably 6.0 μm or more and 8.0 μm or less.

The toner to be used in the present invention may be used as a magnetic toner by further incorporating magnetic iron oxide particles. In this case, the magnetic iron oxide particles can each also serve as a colorant.

Examples of the magnetic iron oxide particles to be incorporated into the magnetic toner include: iron oxides, such as magnetite, hematite, and ferrite; and metals such as iron, cobalt, and nickel, and alloys and mixtures of these metals with metals such as aluminum, cobalt, copper, lead, magnesium, tin, zinc, antimony, bismuth, calcium, manganese, titanium, tungsten, and vanadium.

The average particle diameter of those magnetic iron oxide particles is preferably 2 μm or less, more preferably 0.05 μm or more and 0.5 μm or less. The amount of the particles to be incorporated into the toner is preferably 20 parts by mass or more and 200 parts by mass or less with respect to 100 parts by mass of the binder resin, and is particularly preferably 40 parts by mass or more and 150 parts by mass or less with respect to 100 parts by mass of the binder resin.

The following colorant may be utilized as the colorant to be used in the present invention: a black colorant, such as carbon black, grafted carbon, and a colorant toned to black with the following yellow/magenta/cyan colorants.

Examples of the yellow colorant include compounds typified by a condensed azo compound, an isoindolinone compound, an anthraquinone compound, an azo metal complex, a methine compound, and an allylamide compound.

Examples of the magenta colorant include a condensed azo compound, a diketopyrrolopyrrole compound, anthraquinone, a quinacridone compound, a base dye lake compound, a naphthol compound, a benzimidazolone compound, a thioindigo compound, and a perylene compound.

Examples of the cyan colorant include a copper phthalocyanine compound and a derivative thereof, an anthraquinone compound, and a base dye lake compound. One kind of those colorants may be used alone, or two or more kinds thereof may be used as a mixture. In addition, those colorants may be used in a state of a solid solution.

The colorant is selected in terms of a hue angle, chroma, lightness, weatherability, OHP transparency, and dispersibility in the toner. The addition amount of the colorant is 1 part by mass or more and 20 parts by mass or less with respect to 100 parts by mass of the binder resin.

The toner to be used in the present invention may also contain a wax.

Examples of the wax include the following: aliphatic hydrocarbon-based waxes, such as low-molecular-weight polyethylene, low-molecular-weight polypropylene, a polyolefin copolymer, a polyolefin wax, a microcrystalline wax, a paraffin wax, and a Fischer-Tropsch wax; oxides of aliphatic hydrocarbon-based waxes, such as a polyethylene oxide wax; or block copolymers thereof; plant-based waxes, such as a candelila wax, a carnauba wax, a haze wax, and a jojoba wax; animal-based waxes, such as a beeswax, lanolin, and a spermaceti wax; mineral-based waxes, such as ozokerite, ceresin, and petrolatum; waxes containing aliphatic esters as main components, such as a montanic acid ester wax and a castor wax; and partially or wholly deacidified aliphatic esters, such as a deacidified carnauba wax. The examples further include: saturated linear fatty acids, such as palmitic acid, stearic acid, montanic acid, and a long-chain alkylcarboxylic acid having an additionally long alkyl group; unsaturated fatty acids, such as brassidic acid, eleostearic acid, and parinaric acid; saturated alcohols, such as stearyl alcohol, eicosyl alcohol, behenyl alcohol, carnaubyl alcohol, ceryl alcohol, melissyl alcohol, and an alkyl alcohol having an additionally long alkyl group; polyhydric alcohols, such as sorbitol; aliphatic amides, such as linoleic amide, oleic amide, and lauric amide; saturated aliphatic bis amides, such as methylene bis stearamide, ethylene bis capramide, ethylene bis lauramide, and hexamethylene bis stearamide; unsaturated fatty acid amides, such as ethylene bis oleamide, hexamethylene bis oleamide, N,N'-dioleyl adipamide, and N,N'-dioleyl sebacamide; aromatic bis amides, such as m-xylene bis stearamide and N,N'-distearyl isophthalamide; aliphatic metal salts (which are generally referred to as metallic soaps), such as calcium stearate, calcium laurate, zinc stearate, and magnesium stearate; waxes obtained by grafting aliphatic hydrocarbon-based waxes with vinyl-based monomers, such as styrene and acrylic acid; partially esterified products of fatty acids and polyhydric alcohols, such as behenic monoglyceride; and methyl ester compounds each having a hydroxyl group obtained by the hydrogenation of vegetable oils and fats.

In addition, the waxes whose molecular weight distribution is sharpened by a press sweating method, a solvent method, a recrystallization method, a vacuum distillation method, a supercritical gas extraction method, or a melt crystallization method are preferably used. In addition, waxes from which a low-molecular-weight solid fatty acid, a low-molecular-weight solid alcohol, a low-molecular-weight solid compound, or other impurities are removed are also preferably used.

Specific examples of the waxes that may be used as release agents include: Biscol (trademark) 330-P, 550-P, 660-P, and TS-200 (Sanyo Chemical Industries, Ltd.); Hiwax 400P, 200P, 100P, 410P, 420P, 320P, 220P, 210P, and 110P (Mitsui Chemicals, Inc.); Sasol H1, H2, C80, C105, and C77 (Schumann Sasol); HNP-1, HNP-3, HNP-9, HNP-10, HNP-11, and HNP-12 (Nippon Seiro Co., Ltd.); Unilin (trademark) 350, 425, 550, and 700 and Unisid (trademark) 350, 425, 550, and 700 (Toyo-Petrolite); and a haze wax, a beeswax, a rice wax, a candelilla wax, and a carnauba wax (available from Cerarica Noda Co., Ltd.).

In the toner to be used in the present invention, a charge control agent is preferably used in order to stabilize its chargeability. An organometallic complex or a chelate compound, whose central metal can easily interact with an acid group or a hydroxyl group present in a terminal of the binder resin, is effective as the charge control agent. Examples thereof include: a monoazo metal complex; an acetylacetone metal complex; and a metal complex or metal salt of an aromatic hydroxycarboxylic acid or an aromatic dicarboxylic acid.

Specific examples of the charge control agent that may be used include Spilon Black TRH, T-77, T-95 (Hodogaya Chemical Co., Ltd.), and BONTRON (trademark) S-34, S-44, S-54, E-84, E-88, E-89 (Orient Chemical Industries Co., Ltd.). In addition, a charge control resin can also be used together with the above-mentioned charge control agents.

A flowability improver is preferably added to the toner to be used in the present invention for improving the flowability and chargeability of the toner.

Examples of the flowability improver include: fluorine-based resin powder, such as vinylidene fluoride fine powder or polytetrafluoroethylene fine powder; fine powder silica, such as wet process silica or dry process silica, fine powder titanium oxide, fine powder alumina, or treated silica obtained by subjecting them to a surface treatment with a silane compound, a titanium coupling agent, or silicone oil; oxides, such as zinc oxide or tin oxide; complex oxides, such as strontium titanate, barium titanate, calcium titanate, strontium zirconate, and calcium zirconate; and carbonate compounds, such as calcium carbonate and magnesium carbonate.

A preferred flowability improver is fine powder produced by the vapor phase oxidation of a silicon halide, i.e., the so-called dry silica or fumed silica. The production utilizes, for example, the pyrolysis oxidation reaction of a silicon tetrachloride gas in an oxyhydrogen flame, and a reaction formula that forms a basis for the reaction is as described below.

$$SiCl_4+2H_2+O_2 \rightarrow SiO_2+4HCl$$

In the production process, composite fine powder of silica and any other metal oxide can be obtained by using any other metal halide, such as aluminum chloride or titanium chloride, together with the silicon halide, and such fine powder is also included as silica.

The average primary particle diameter of the flowability improver in a particle size distribution on a number basis is preferably 5 nm or more and 30 nm or less because high chargeability and high flowability can be imparted to the toner.

Further, the flowability improver to be used in the present invention is more preferably treated silica fine powder obtained by subjecting the silica fine powder produced by the gas phase oxidation of the silicon halide to a hydrophobic treatment.

The flowability improver preferably has a specific surface area based on nitrogen adsorption measured by a BET method of 30 $m^2/g$ or more and 300 $m^2/g$ or less.

The flowability improver is desirably used in a total amount of 0.01 part by mass or more and 3 parts by mass or less with respect to 100 parts by mass of the toner.

The toner to be used in the present invention can be used as a one-component developer by being mixed with the flowability improver and by being further mixed with any other external additive (such as a charge control agent) as required. In addition, the toner can be used as a two-component developer by being used in combination with a carrier. All conventionally known carriers can each be used as the carrier to be used in a two-component developing method. Specifically, metals, such as surface-oxidized or -unoxidized iron, nickel, cobalt, manganese, chromium, and rare earths, and alloys or oxides thereof are each preferably used.

In addition, a substance such as a styrene-based resin, an acrylic resin, a silicone-based resin, a fluorine-based resin, or a polyester resin is preferably adhered to, or caused to coat, the surface of such carrier particle before use.

A method of producing the toner to be used in the present invention, which is not particularly limited, is preferably a pulverization method. In order to produce the toner by the pulverization method, the binder resin, the colorant, the wax, the charge control agent, and the like constituting the toner particle are sufficiently mixed by using a mixer, such as a Henschel mixer or a ball mill. Then, the mixture is melted and kneaded with a heat kneader, such as a biaxial kneading extruder, a heating roll, a kneader, or an extruder, so that the resins are made compatible with each other. The wax, the magnetic iron oxide particles, and a metal-containing compound are dispersed or dissolved in the kneaded product, and the resultant is cooled to be solidified. After that, the solidified product is pulverized and classified, whereby the toner particle according to the present invention can be obtained.

Then, the toner particle is sufficiently mixed with the organic-inorganic composite fine particle, and as required, a desired external additive except the organic-inorganic composite fine particle by using a mixer, such as a Henschel mixer, whereby the toner according to the present invention can be obtained.

Examples of the mixer include: Henschel mixer (manufactured by Nippon Coke & Engineering Co., Ltd.); Super Mixer (manufactured by Kawata Mfg Co., Ltd.); Ribocone (manufactured by Okawara Corporation); Nauta Mixer, Turburizer, and Cyclomix (manufactured by Hosokawa Micron); Spiral Pin Mixer (manufactured by Pacific Machinery & Engineering Co., Ltd.); and Loedige Mixer (manufactured by Matsubo Corporation).

Examples of the kneader include: KRC kneader (manufactured by Kurimoto Ironworks Co., Ltd.); Buss Co-kneader (manufactured by Buss Co., Ltd.), TEM-type extruder (manufactured by Toshiba Machine Co., Ltd.); TEX Biaxial Kneader (manufactured by The Japan Steel Works, Ltd.); PCM Kneader (manufactured by Ikegai machinery Co.); Three-Roll Mill, Mixing Roll Mill, and Kneader (manufactured by Inoue Manufacturing Co., Ltd.); Kneadex (manufactured by Mitsui Mining Co., Ltd.); MS-type Pressure Kneader, and Kneader-Ruder (manufactured by Moriyama Manufacturing Co., Ltd.); and Banbury Mixer (manufactured by Kobe Steel, Ltd.).

Examples of the pulverizer include: Counter Jet Mill, Micron Jet, and Inomizer (manufactured by Hosokawa Micron); IDS-type Mill and PJM Jet Mill (manufactured by Nippon Pneumatic MFG Co., Ltd.); Cross Jet Mill (manufactured by Kurimoto Tekkosho KK); Ulmax (manufactured by Nisso Engineering Co., Ltd.); SK Jet O-Mill (manufactured by Seishin Enterprise Co., Ltd.); Criptron (manufactured by Kawasaki Heavy Industries, Ltd.); Turbo Mill (manufactured by Turbo Kogyo Co., Ltd.); and Super Rotor (manufactured by Nisshin Engineering Inc.).

Examples of the classifier include: Classiel, Micron Classifier, and Spedic Classifier (manufactured by Seishin Enterprise Co., Ltd.); Turbo Classifier (manufactured by Nisshin Engineering Inc.); Micron Separator, Turboprex (ATP), and TSP Separator (manufactured by Hosokawa Micron); Elbow Jet (manufactured by Nittetsu Mining Co., Ltd.); Dispersion Separator (manufactured by Nippon Pneumatic MFG Co., Ltd.); and YM Microcut (manufactured by Yasukawa Shoji K.K.).

As a sifter for sieving coarse particles, there are given: Ultra Sonic (manufactured by Koei Sangyo Co., Ltd.); Rezona Sieve and Gyro Sifter (manufactured by Tokuju Corporation); Vibrasonic System (manufactured by Dalton Co., Ltd.); Sonicreen (manufactured by Shinto Kogyo K.K.); Turbo Screener (manufactured by Turbo Kogyo Co., Ltd.); Microsifter (manufactured by Makino Mfg. Co., Ltd.); and circular vibrating sieves.

In addition, the toner can be produced by the so-called polymerization method, such as an emulsion polymerization method, a suspension polymerization method, or a dissolution suspension method, as any other approach.

Methods of measuring physical properties according to the toner to be used in the present invention are as described below. Production Examples and Examples to be described later are also based on the methods.

<Method of Measuring Number-Average Particle Diameter of Organic-Inorganic Composite Fine Particles>

The measurement of the number-average particle diameter of the organic-inorganic composite fine particles is performed with a scanning electron microscope "S-4800" (trade name; manufactured by Hitachi, Ltd.). The toner to which the organic-inorganic composite fine particles have been externally added is observed, and the long diameters (lengths of the longest portions) of 100 randomly selected primary particles of the organic-inorganic composite fine particles are measured in a field of view magnified by a factor of up to 200,000, followed by the determination of their number-average particle diameter. The observation magnification is appropriately adjusted.

<Method of Measuring Surface Abundance Ratio of Inorganic Fine Particles Constituting Organic-Inorganic Composite Fine Particle>

The surface abundance ratio of the inorganic fine particles constituting the organic-inorganic composite fine particle is calculated from the amount of atoms derived from the inorganic fine particles present in the surface of the organic-inorganic composite fine particle measured by Electron spectroscopy for chemical analysis (ESCA). ESCA is an analysis method involving detecting an atom in a region as far as several nanometers or less from the surface of a sample in its depth direction. Accordingly, an atom in the surface of the organic-inorganic composite fine particle can be detected.

When the surface abundance ratio of the inorganic fine particles constituting the organic-inorganic composite fine particle externally added to the toner is measured, the organic-inorganic composite fine particle is isolated from the toner, for example, as described below. First, the toner is dispersed in ion-exchanged water having added thereto several drops of "Contaminon N" (10 mass % aqueous solution of a neutral detergent for washing a precision measuring device, the neutral detergent being formed of a nonionic surfactant, an anionic surfactant, and an organic builder, and having a pH of 7, manufactured by Wako Pure Chemical Industries, Ltd.) with an ultrasonic wave, and the resultant is left at rest for 24 hours. A supernatant is collected and dried, whereby the organic-inorganic composite fine particle can be isolated. When a plurality of external additives are externally added to the toner, the organic-inorganic composite fine particle can be isolated through the separation of the supernatant by a centrifugal separation method.

An apparatus for ESCA and measurement conditions thereof are as follows.

Apparatus used: Quantum 2000 manufactured by ULVAC-PHI, Inc.
Analysis method: narrow analysis
Measurement conditions: X-ray source: Al-Kα
X-ray conditions: 100 μm, 25 W, 15 kV
Photoelectron acceptance angle: 45°
Pass energy: 58.70 eV
Measurement range: ϕ100 μm The measurement is performed under the foregoing conditions. Here, an example in which silica particles are used as the inorganic fine particles of the organic-inorganic composite fine particle is described.

First, the amount of Si atoms derived from silica with respect to the amount of all atoms except hydrogen atoms of the organic-inorganic composite fine particle is determined by subjecting the organic-inorganic composite fine particle to measurement. Next, the amount of Si atoms derived from silica with respect to the amount of all atoms except hydrogen atoms of the inorganic fine particles (silica particles) constituting the organic-inorganic composite fine particle is determined by subjecting the inorganic fine particles (silica particles) to measurement. The ratio of the amount of the Si atoms in the measurement of the organic-inorganic composite fine particle to the amount of the Si atoms in the measurement of the silica particles is defined as the surface abundance ratio (%) of the inorganic fine particles constituting the organic-inorganic composite fine particle. The ratio is calculated by using, for example, colloidal silica particles (number-average particle diameter: 101 nm) described in Production Examples as the silica particles. It should be noted that when particles except silica are used as the inorganic fine particles, the abundance ratio can be similarly calculated by the above-mentioned method through the measurement of the amount of the atoms of an inorganic element in the inorganic fine particles instead of the amount of the Si atoms.

<Method of Determining Organic-Inorganic Composite Fine Particle in Toner>

When the content of the organic-inorganic composite fine particle is measured in a toner obtained by externally adding a plurality of external additives to the toner particle, the external additives need to be removed from the toner, and the plurality of kinds of external additives need to be isolated and recovered.

A specific method is, for example, the following method.

(1) 5 Grams of the toner is loaded into a sample bottle and 200 ml of methanol is loaded into the bottle.

(2) The external additives are separated by dispersing the sample with an ultrasonic washing machine for 5 minutes.

(3) The toner particle and the external additives are separated from each other by suction filtration (10-μm membrane filter). Alternatively, only the supernatant may be separated by bringing a neodymium magnet into contact with the bottom of the sample bottle to fix the toner particle.

(4) The operations (2) and (3) are performed a total of three times.

The externally added external additives are isolated from the toner by the foregoing operations. The organic-inorganic composite fine particle and the other external additives are separated and recovered by subjecting the recovered aqueous solution to a centrifuge. It should be noted that when only the organic-inorganic composite fine particle is used as the external additive, the operation with the centrifuge does not need to be performed. Next, the solvent is removed, the remainder is sufficiently dried with a vacuum dryer, and the weight of the dried product is measured. Thus, the content of the organic-inorganic composite fine particle can be obtained.

<Image-Forming Method>

An image-forming method of the present invention is an image-forming method including: a charging step of charging an electrophotographic photosensitive member; an electrostatic latent image-forming step of forming an electrostatic latent image on the surface of the charged electrophotographic photosensitive member; a developing step of developing the electrostatic latent image with a toner to form a toner image on the surface of the electrophotographic photosensitive member; a transferring step of transferring the toner image on the surface of the electrophotographic photosensitive member onto a transfer material through or without through an intermediate transfer member; and a cleaning step of removing a transfer residual toner from the surface of the electrophotographic photosensitive member, in which <Electrophotographic Photosensitive Member> described above is used as the electrophotographic photosensitive member and <Toner> described above is used as the toner. The image-forming method of the present invention is further described by using an electrophotographic apparatus serving as an example of an image-forming apparatus to which the image-forming method of the present invention can be applied.

An example of the schematic construction of an electrophotographic apparatus including a process cartridge having an electrophotographic photosensitive member and a toner is illustrated in FIGURE.

In FIGURE, a cylindrical electrophotographic photosensitive member 1 is rotationally driven about an axis 2 in a direction indicated by an arrow at a predetermined peripheral speed. The surface of the electrophotographic photosensitive member 1 to be rotationally driven is uniformly charged to a predetermined positive or negative potential by a charging device (primary charging device: a charging roller or the like) 3 in its rotation process (charging step). Next, the surface receives exposure light (image exposure light) 4 output from an exposing device (not shown), such as slit exposure or laser beam scanning exposure. Thus, electrostatic latent images corresponding to a target image are sequentially formed on the surface of the electrophotographic photosensitive member 1 (electrostatic latent image-forming step).

The electrostatic latent images formed on the surface of the electrophotographic photosensitive member 1 are developed with a toner T in a developing device 5 by reversal development to turn into toner images (developing step). Next, the toner images formed on and carried by the surface of the electrophotographic photosensitive member 1 are sequentially transferred onto a transfer material (such as paper) P by a transfer bias from a transferring device (such as a transfer roller) 6 (transferring step). In the transferring step, the transfer of the toner images on the surface of the electrophotographic photosensitive member may be performed through an intermediate transfer member, or may be performed without through any intermediate transfer member. It should be noted that the transfer material P is taken out of a transfer material-supplying device (not shown), and fed to a gap between the electrophotographic photosensitive member 1 and the transferring device 6 (contacting portion) in synchronization with the rotation of the electrophotographic photosensitive member 1.

The transfer material P onto which the toner images have been transferred is separated from the surface of the electrophotographic photosensitive member 1 and introduced into a fixing device 8 to be subjected to image fixation. Thus, the transfer material is printed out as an image-formed product (a print or a copy) to the outside of the apparatus.

The surface of the electrophotographic photosensitive member 1 after the transfer of the toner images is subjected to the removal of a transfer residual developer (toner) by a cleaning device (such as a cleaning blade) 7 to be cleaned (cleaning step). In the present invention, the specific electrophotographic photosensitive member and the specific toner are used. Accordingly, the occurrence of an inconvenience in which an external additive that has migrated to the surface of the electrophotographic photosensitive member is not sufficiently cleaned out in the cleaning step is suppressed, and satisfactory image quality can be obtained. Next, the surface is subjected to an antistatic treatment by pre-exposure light (not shown) from a pre-exposing device (not shown), and is then repeatedly used in image formation. It should be noted that pre-exposure is not necessarily needed when the charging device 3 is a contact charging device using a charging roller or the like as illustrated in FIGURE.

As described above, a product obtained by storing components, such as the electrophotographic photosensitive member 1, the charging device 3, the developing device 5, and the transferring device 6, and as required, the cleaning device 7, in, for example, a container and integrally bonding the components is a process cartridge of the present invention. The process cartridge is configured to be detachably mountable to the main body of an electrophotographic apparatus, such as a copying machine or a laser beam printer. In FIGURE, the electrophotographic photosensitive member 1, the charging device 3, the developing device 5, and the cleaning device 7 are integrally supported to be turned into a cartridge, and the cartridge is arranged as a process cartridge 9 detachably mountable to the main body of the electrophotographic apparatus by using a guiding device 10 of the main body of the electrophotographic apparatus, such as a rail.

EXAMPLES

The present invention is hereinafter more specifically described by way of specific Examples. However, the present invention is not limited thereto.

[Synthesis of Resin]

The polyarylate resin A and the polycarbonate resin B to be used in the present invention can each be synthesized by a method appropriately selected from known methods, such as an ester exchange method, an interfacial polymerization method, and a direct polymerization method. Synthesis examples of the polyarylate resin A and the polycarbonate resin B are described below.

Synthesis Example A1

An acid halide solution was prepared by dissolving 3.3 g of isophthalic chloride and 3.3 g of terephthalic chloride in dichloromethane. In addition, separately from the acid halide solution, 4.2 g of a siloxane derivative represented by the following formula (a-1), 6.8 g of a diol represented by the following formula (a-2), and 3.6 g of a diol represented by the following formula (a-3) were dissolved in a 10% aqueous solution of sodium hydroxide. Further, tributylbenzylammonium chloride was added as a polymerization catalyst to the resultant solution, and the mixture was stirred to prepare a diol compound solution.

Next, polymerization was initiated by adding the acid halide solution to the diol compound solution while stirring the solution. A polymerization reaction was performed for 3 hours while a reaction temperature was kept at 25° C. or less and the mixture was stirred. After that, the polymerization reaction was terminated by adding acetic acid, and the resultant was repeatedly washed with water until an aqueous phase became neutral. Subsequently, the liquid phase was dropped in methanol, and a precipitate was filtered out and dried. Thus, a white polymer (resin A1) was obtained.

The viscosity-average molecular weight of the resultant resin A1 was 21,000. The viscosity-average molecular weight was calculated as described below. 0.5 Gram of the sample was dissolved in 100 ml of dichloromethane, and the specific viscosity of the solution at 25° C. was measured with an Ubbelohde-type viscometer. A limiting viscosity was determined from the specific viscosity, and the viscosity-average molecular weight was calculated by setting the K and a of the Mark-Houwink viscosity equation to $1.23\times 10^{-4}$ and 0.83, respectively.

In addition, the content of a portion corresponding to the structure represented by the formula (1) in the resin A1 was analyzed by the above-mentioned approach. As a result, the content was 20 mass %.

(a-1)

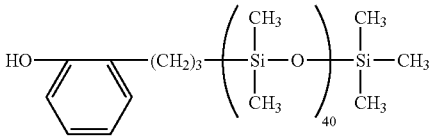

(a-2)

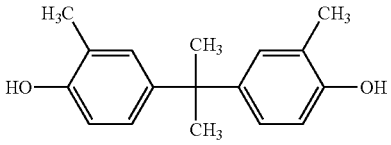

(a-3)

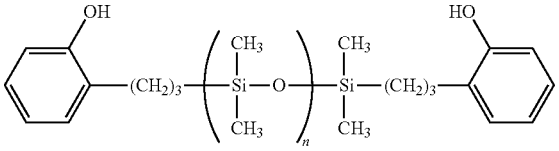

Synthesis Examples A2 to A8

Resins A2 to A8 were synthesized by using the synthesis method described in Synthesis Example A1 and by using raw materials in accordance with structures shown in Table 1. The viscosity-average molecular weights of the resins A2 to A8 were each controlled by adjusting a time period from the initiation of polymerization to the completion of the polymerization.

The constructions and viscosity-average molecular weights of the resins A1 to A8 are shown in Table 1.

TABLE 1

| | Formula (2) | Content of formula (1) | Formula (9) | Formula (10) | n of formula (10) | Viscosity-average molecular weight |
|---|---|---|---|---|---|---|
| Resin A1 | (2-1) | 20% | (9-1)/(9-2) = 5/5 | (10-1)/(10-2) = 5/5 | 20 | 21,000 |
| Resin A2 | (2-2) | 20% | (9-1)/(9-2) = 5/5 | (10-1)/(10-2) = 5/5 | 40 | 20,000 |
| Resin A3 | (2-1) | 10% | (9-1)/(9-2) = 5/5 | (10-1)/(10-2) = 5/5 | 80 | 25,000 |
| Resin A4 | (2-1) | 30% | (9-1)/(9-2) = 5/5 | — | — | 18,000 |
| Resin A5 | (2-4) | 20% | (9-3) | (10-3) | 40 | 45,000 |
| Resin A6 | (2-5) | 20% | (9-4)/(9-5) = 5/5 | (10-1)/(10-2) = 5/5 | 40 | 30,000 |
| Resin A7 | (2-7) | 20% | (9-1)/(9-2) = 5/5 | (10-1)/(10-2) = 5/5 | 40 | 25,000 |
| Resin A8 | (2-13) | 50% | (9-7)/(9-8) = 5/5 | (10-1)/(10-2) = 5/5 | 40 | 27,000 |

The column "Formula (2)" in Table 1 represents the structure represented by the formula (2). The column "Content of formula (1)" in Table 1 means the content (mass %) of the structure represented by the formula (1) in a resin. The column "Formula (9)" in Table 1 represents the structural unit represented by the formula (9). When the structural units each represented by the formula (9) are used as a mixture, the column represents the kinds of, and a mixing ratio (on a mass basis) between, the structural units. The column "Formula (10)" in Table 1 represents the structural unit represented by the formula (10). When the structural units each represented by the formula (10) are used as a mixture, the column represents the kinds of, and a mixing ratio (on a mass basis) between, the structural units. The column "n of formula (10)" in Table 1 means the number n of repetitions of the structure in the parentheses in the structural unit represented by the formula (10).

Synthesis Example B1

12.0 Grams of a diol represented by the following formula (b-1) was dissolved in a 10% aqueous solution of sodium hydroxide. Dichloromethane was added to the solution and the mixture was stirred. While the temperature of the resultant solution was kept at 10° C. or more and 15° C. or less, 15 g of phosgene was blown into the solution over 1 hour. When about 70% of phosgene was blown into the solution, 4.2 g of the siloxane derivative represented by the formula (a-1) and 4.0 g of the diol represented by the formula (a-3) were added to the solution. After the completion of the introduction of phosgene, the reaction liquid was vigorously stirred to be emulsified and triethylamine was added thereto, followed by stirring for 1 hour. After that, a dichloromethane phase was neutralized with phosphoric acid, and the neutralized product was repeatedly washed with water until its pH became about 7. Subsequently, the liquid phase was dropped in isopropanol, and a precipitate was filtered out and dried. Thus, a white polymer (resin B1) was obtained.

The viscosity-average molecular weight of the resultant resin B1 was 18,000. In addition, the content of a portion corresponding to the structure represented by the formula (1) in the resin B1 was 10 mass %.

(b-1)

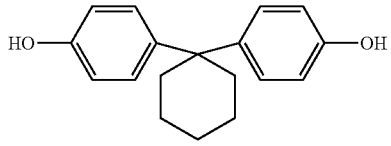

Synthesis Examples B2 to B9

Resins B2 to B9 were synthesized by using the synthesis method described in Synthesis Example B1 and by using raw materials in accordance with structures shown in Table 2. The viscosity-average molecular weights of the resins B2 to B9 were each controlled by adjusting a time period from the initiation of polymerization to the completion of the polymerization.

The constructions and viscosity-average molecular weights of the resins B1 to B9 are shown in Table 2.

TABLE 2

| | Formula (2) | Content of formula (1) | Formula (11) | Formula (12) | n of formula (12) | Viscosity-average molecular weight |
|---|---|---|---|---|---|---|
| Resin B1 | (2-1) | 10% | (11-1) | (12-1) | 20 | 18,000 |
| Resin B2 | (2-2) | 20% | (11-1) | (12-1) | 40 | 20,000 |

TABLE 2-continued

| | Formula (2) | Content of formula (1) | Formula (11) | Formula (12) | n of formula (12) | Viscosity-average molecular weight |
|---|---|---|---|---|---|---|
| Resin B3 | (2-2) | 10% | (11-1)/(11-15) = 8/2 | (12-1) | 40 | 30,000 |
| Resin B4 | (2-1) | 20% | (11-1) | (12-4) | 20 | 25,000 |
| Resin B5 | (2-1) | 45% | (11-1) | — | — | 15,000 |
| Resin B6 | (2-4) | 10% | (11-1) | (12-1) | 40 | 30,000 |
| Resin B7 | (2-5) | 30% | (11-1) | (12-1) | 80 | 21,000 |
| Resin B8 | (2-7) | 10% | (11-1) | (12-1) | 40 | 21,000 |
| Resin B9 | (2-13) | 20% | (11-1) | (12-3) | 60 | 20,000 |

The column "Formula (2)" in Table 2 represents the structure represented by the formula (2). The column "Content of formula (1)" in Table 2 means the content (mass %) of the structure represented by the formula (1) in a resin. The column "Formula (11)" in Table 2 represents the structural unit represented by the formula (11). When the structural units each represented by the formula (11) are used as a mixture, the column represents the kinds of, and a mixing ratio (on a mass basis) between, the structural units. The column "Formula (12)" in Table 2 represents the structural unit represented by the formula (12). The column "n of formula (12)" in Table 2 means the number n of repetitions of the structure in the parentheses in the structural unit represented by the formula (12).

Synthesis Example A9

A resin A9 having a structure shown in Table 3 was synthesized by using a siloxane derivative represented by the following formula (a-4) and the diol represented by the formula (a-2) in accordance with the method of Synthesis Example A1. The viscosity-average molecular weight of the resultant resin A9 was 22,000. In addition, the content of a portion corresponding to the structure represented by the formula (1) in the resin A9 was 20 mass %.

(a-4)

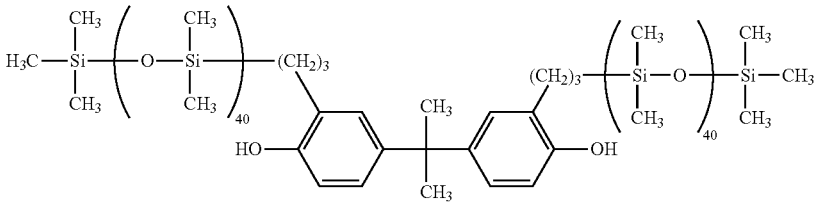

The siloxane derivative represented by the formula (a-4) is a compound that can be obtained by, for example, a hydrosilylation reaction between a bisphenol having a carbon-carbon double bond in a side chain thereof and a polysiloxane of a one-terminal Si—H structure.

Synthesis Examples A10 to A14

Resins A10 to A14 were synthesized by using the synthesis method described in Synthesis Example A1 and by using raw materials in accordance with structures shown in Table 3. The viscosity-average molecular weights of the resins A10 to A14 were each controlled by adjusting a time period from the initiation of polymerization to the completion of the polymerization.

The constructions and viscosity-average molecular weights of the resins A9 to A14 are shown in Table 3.

TABLE 3

| | Formula (3) | Formula (3-A) | Content of formula (1) | Formula (9) | Formula (10) | n of formula (10) | Viscosity-average molecular weight |
|---|---|---|---|---|---|---|---|
| Resin A9 | (3-1)/(3-2) = 5/5 | (3-A-1) | 20% | (9-1)/(9-2) = 5/5 | — | — | 22,000 |
| Resin A10 | (3-1)/(3-2) = 5/5 | (3-A-5) | 10% | (9-1)/(9-2) = 5/5 | — | — | 16,000 |
| Resin A11 | (3-3) | (3-A-1) | 40% | (9-3) | — | — | 25,000 |
| Resin A12 | (3-4)/(3-5) = 5/5 | (3-A-1) | 20% | (9-4)/(9-5) = 5/5 | — | — | 40,000 |
| Resin A13 | (3-11) | (3-A-7) | 5% | (9-3) | — | — | 21,000 |

TABLE 3-continued

| | Formula (3) | Formula (3-A) | Content of formula (1) | Formula (9) | Formula (10) | n of formula (10) | Viscosity-average molecular weight |
|---|---|---|---|---|---|---|---|
| Resin A14 | (3-1)/(3-2) = 5/5 | (3-A-1) | 20% | (9-1)/(9-2) = 5/5 | (10-1)/(10-2) = 5/5 | 40 | 18,000 |

The column "Formula (3)" in Table 3 represents the structural unit represented by the formula (3). When the structural units each represented by the formula (3) are used as a mixture, the column represents the kinds of, and a mixing ratio (on a mass basis) between, the structural units. The column "Formula (3-A)" in Table 3 represents the group represented by the formula (3-A). The column "Content of formula (1)" in Table 3 means the content (mass %) of the structure represented by the formula (1) in a resin. The column "Formula (9)" in Table 3 represents the structural unit represented by the formula (9). When the structural units each represented by the formula (9) are used as a mixture, the column represents the kinds of, and a mixing ratio (on a mass basis) between, the structural units. The column "Formula (10)" in Table 3 represents the structural unit represented by the formula (10). When the structural units each represented by the formula (10) are used as a mixture, the column represents the kinds of, and a mixing ratio (on a mass basis) between, the structural units. The column "n of formula (10)" in Table 3 means the number n of repetitions of the structure in the parentheses in the structural unit represented by the formula (10).

Synthesis Example B10

A resin B10 having a structure shown in Table 4 was synthesized by using the siloxane derivative represented by the formula (a-4) and the diol represented by the formula (b-1) in accordance with the method of Synthesis Example B1. The viscosity-average molecular weight of the resultant resin B10 was 19,000. In addition, the content of a portion corresponding to the structure represented by the formula (1) in the resin B10 was 20 mass %.

Synthesis Examples B11 to B16

Resins B11 to B16 were synthesized by using the synthesis method described in Synthesis Example B1 and by using raw materials in accordance with structures shown in Table 4. The viscosity-average molecular weights of the resins B11 to B16 were each controlled by adjusting a time period from the initiation of polymerization to the completion of the polymerization.

The constructions and viscosity-average molecular weights of the resins B10 to B16 are shown in Table 4.

TABLE 4

| | Formula (6) | Formula (6-A) | Content of formula (1) | Formula (11) | Formula (12) | n of formula (12) | Viscosity-average molecular weight |
|---|---|---|---|---|---|---|---|
| Resin B10 | (6-1) | (3-A-1) | 20% | (11-1) | — | — | 19,000 |
| Resin B11 | (6-3) | (3-A-1) | 2% | (11-3) | — | — | 23,000 |
| Resin B12 | (6-5) | (3-A-1) | 40% | (11-1) | — | — | 18,000 |
| Resin B13 | (6-8) | (3-A-7) | 15% | (11-1) | — | — | 30,000 |
| Resin B14 | (6-1) | (3-A-5) | 50% | (11-3)/(11-16) = 5/5 | — | — | 20,000 |
| Resin B15 | (6-1) | (3-A-1) | 20% | (11-1)/(11-15) = 8/2 | — | — | 30,000 |
| Resin B16 | (6-1) | (3-A-1) | 20% | (11-1) | (12-1) | 40 | 21,000 |

The column "Formula (6)" in Table 4 represents the structural unit represented by the formula (6). The column "Formula (6-A)" in Table 4 represents the group represented by the formula (6-A). The column "Content of formula (1)" in Table 4 means the content (mass %) of the structure represented by the formula (1) in a resin. The column "Formula (11)" in Table 4 represents the structural unit represented by the formula (11). When the structural units each represented by the formula (11) are used as a mixture, the column represents the kinds of, and a mixing ratio (on a mass basis) between, the structural units. The column "Formula (12)" in Table 4 represents the structural unit represented by the formula (12). The column "n of formula (12)" in Table 4 means the number n of repetitions of the structure in the parentheses in the structural unit represented by the formula (12).

Synthesis Example A15

A resin A15 having a structure shown in Table 5 was synthesized by using a siloxane derivative represented by the following formula (a-5) and the diol represented by the formula (a-2) in accordance with the method of Synthesis Example A1. The viscosity-average molecular weight of the resultant resin A15 was 23,000. In addition, the content of a portion corresponding to the structure represented by the formula (1) in the resin A15 was 20 mass %.

(a-5)

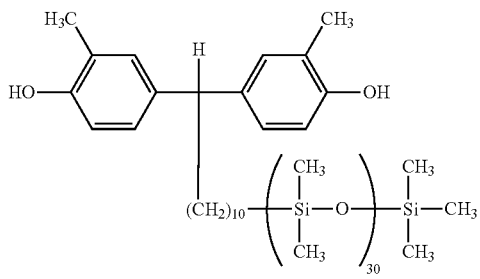

The siloxane derivative represented by the formula (a-5) is a compound that can be obtained by, for example, a hydrosilylation reaction between a bisphenol having a carbon-carbon double bond in a substituent of its central skeleton and a polysiloxane of a one-terminal Si—H structure.

Synthesis Examples A16 to A21

Resins A16 to A21 were synthesized by using the synthesis method described in Synthesis Example A1 and by using raw materials in accordance with structures shown in Tables 5 and 6. The viscosity-average molecular weights of the resins A16 to A21 were each controlled by adjusting a time period from the initiation of polymerization to the completion of the polymerization.

The constructions and viscosity-average molecular weights of the resins A15 to A21 are shown in Tables 5 and 6.

the formula (4-B). The column "Content of formula (1)" in each of Tables 5 and 6 means the content (mass %) of the structure represented by the formula (1) in a resin. The column "Formula (9)" in each of Tables 5 and 6 represents the structural unit represented by the formula (9). When the structural units each represented by the formula (9) are used as a mixture, the column represents the kinds of, and a mixing ratio (on a mass basis) between, the structural units. The column "Formula (10)" in Table 5 represents the structural unit represented by the formula (10). When the structural units each represented by the formula (10) are used as a mixture, the column represents the kinds of, and a mixing ratio (on a mass basis) between, the structural units. The column "n of formula (10)" in Table 5 means the number n of repetitions of the structure in the parentheses in the structural unit represented by the formula (10).

Synthesis Example B17

A resin B17 having a structure shown in Table 7 was synthesized by using the siloxane derivative represented by the formula (a-5) and the diol represented by the formula (b-1) in accordance with the method of Synthesis Example B1. The viscosity-average molecular weight of the resultant resin B17 was 18,000. In addition, the content of a portion corresponding to the structure represented by the formula (1) in the resin B17 was 20 mass %.

Synthesis Examples B18 to B22

Resins B18 to B22 were synthesized by using the synthesis method described in Synthesis Example B1 and by

TABLE 5

| | | Formula (4-A) | | | | | Content of | | | n of | Viscosity-average |
|---|---|---|---|---|---|---|---|---|---|---|---|
| | Formula (4) | $R^{411}$, $R^{412}$ | $R^{413}$, $R^{414}$ | Z | m | n | formula (1) | Formula (9) | Formula (10) | formula (10) | molecular weight |
| Resin A15 | (4-1)/ (4-2) = 5/5 | Methyl group | Methyl group | Methyl group | 10 | 30 | 20% | (9-1)/ (9-2) = 5/5 | — | — | 23,000 |
| Resin A16 | (4-3) | Methyl group | Methyl group | t-Butyl group | 10 | 30 | 10% | (9-3) | — | — | 20,000 |
| Resin A17 | (4-1)/ (4-2) = 5/5 | Methyl group | Methyl group | Methyl group | 3 | 30 | 40% | (9-1)/ (9-2) = 5/5 | — | — | 18,000 |
| Resin A18 | (4-4)/ (4-5) = 5/5 | Methyl group | Methyl group | Methyl group | 10 | 30 | 20% | (9-4)/ (9-5) = 5/5 | — | — | 23,000 |
| Resin A19 | (4-1)/ (4-2) = 5/5 | Methyl group | Methyl group | Methyl group | 10 | 80 | 5% | (9-1)/ (9-2) = 5/5 | — | — | 46,000 |
| Resin A20 | (4-1)/ (4-2) = 5/5 | Methyl group | Methyl group | Methyl group | 10 | 30 | 20% | (9-1)/ (9-2) = 5/5 | (10-1)/ (10-2) = 5/5 | 40 | 20,000 |

TABLE 6

| | | Formula (4-B) | | | | | | | |
|---|---|---|---|---|---|---|---|---|---|
| | Formula (4) | $R^{421}$ to $R^{428}$ | $Z^1$, $Z^2$ | m | $n^1$ | $n^2$ | Content of formula (1) | Formula (9) | Viscosity-average molecular weight |
| Resin A21 | (4-1)/ (4-2) = 5/5 | Methyl group | Methyl group | 10 | 15 | 15 | 20% | (9-1)/ (9-2) = 5/5 | 32,000 |

The column "Formula (4)" in each of Tables 5 and 6 represents the structural unit represented by the formula (4). When the structural units each represented by the formula (4) are used as a mixture, the column represents the kinds of, and a mixing ratio (on a mass basis) between, the structural units. The column "Formula (4-A)" in Table 5 represents the group represented by the formula (4-A). The column "Formula (4-B)" in Table 6 represents the group represented by using raw materials in accordance with structures shown in Tables 7 and 8. The viscosity-average molecular weights of the resins B18 to B22 were each controlled by adjusting a time period from the initiation of polymerization to the completion of the polymerization.

The constructions and viscosity-average molecular weights of the resins B17 to B22 are shown in Tables 7 and 8.

TABLE 7

| | Formula (7) | Formula (7-A) $R^{711}$, $R^{712}$ | $R^{713}$, $R^{714}$ | Z | m | n | Content of formula (1) | Formula (11) | Formula (12) | n of formula (12) | Viscosity-average molecular weight |
|---|---|---|---|---|---|---|---|---|---|---|---|
| Resin B17 | (7-1) | Methyl group | Methyl group | Methyl group | 10 | 30 | 20% | (11-1) | — | — | 18,000 |
| Resin B18 | (7-1) | Methyl group | Methyl group | t-Butyl group | 10 | 30 | 45% | (11-1) | — | — | 15,000 |
| Resin B19 | (7-2) | Methyl group | Methyl group | Methyl group | 10 | 30 | 1% | (11-3)/(11-16) = 5/5 | — | — | 22,000 |
| Resin B20 | (7-1) | Methyl group | Methyl group | Methyl group | 10 | 30 | 20% | (11-1) | (12-1) | 40 | 27,000 |
| Resin B21 | (7-1) | Methyl group | Methyl group | Methyl group | 10 | 30 | 20% | (11-1)/(11-15) = 8/2 | — | — | 31,000 |

TABLE 8

| | Formula (7) | Formula (7-B) $R^{721}$ to $R^{728}$ | $Z^1$, $Z^2$ | m | $n^1$ | $n^2$ | Content of formula (1) | Formula (11) | Viscosity-average molecular weight |
|---|---|---|---|---|---|---|---|---|---|
| Resin B22 | (7-1) | Methyl group | Methyl group | 10 | 15 | 15 | 20% | (11-1) | 20,000 |

The column "Formula (7)" in each of Tables 7 and 8 represents the structural unit represented by the formula (7). The column "Formula (7-A)" in Table 7 represents the group represented by the formula (7-A). The column "Formula (7-B)" in Table 8 represents the group represented by the formula (7-B). The column "Content of formula (1)" in each of Tables 7 and 8 means the content (mass %) of the structure represented by the formula (1) in a resin. The column "Formula (11)" in each of Tables 7 and 8 represents the structural unit represented by the formula (11). When the structural units each represented by the formula (11) are used as a mixture, the column represents the kinds of, and a mixing ratio (on a mass basis) between, the structural units. The column "Formula (12)" in Table 7 represents the structural unit represented by the formula (12). The column "n of formula (12)" in Table 7 means the number n of repetitions of the structure in the parentheses in the structural unit represented by the formula (12).

Synthesis Example A22

A resin A22 having a structure shown in Table 9 was synthesized by using a siloxane derivative represented by the following formula (a-6) and the diol represented by the formula (a-2) in accordance with the method of Synthesis Example A1. The viscosity-average molecular weight of the resultant resin A22 was 40,000. In addition, the content of a portion corresponding to the structure represented by the formula (1) in the resin A22 was 20 mass %.

(a-6)

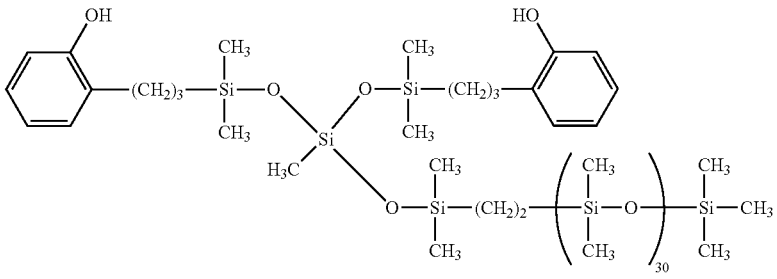

Synthesis Examples A23 to A26

Resins A23 to A26 were synthesized by using the synthesis method described in Synthesis Example A1 and by using raw materials in accordance with structures shown in Table 9. The viscosity-average molecular weights of the resins A23 to A26 were each controlled by adjusting a time period from the initiation of polymerization to the completion of the polymerization.

The constructions and viscosity-average molecular weights of the resins A22 to A26 are shown in Table 9.

TABLE 9

| | Formula (5) | Formula (5-A) $R^{511}$ to $R^{520}$ | Formula (5-A) Z | Formula (5-A) n | Formula (5-A) k | Formula (5-A) l | Content of formula (1) | Formula (9) | Formula (10) | n of formula (10) | Viscosity-average molecular weight |
|---|---|---|---|---|---|---|---|---|---|---|---|
| Resin A22 | (5-1)/(5-2) = 5/5 | Methyl group | Methyl group | 30 | 1 | 1 | 20% | (9-1)/(9-2) = 5/5 | — | — | 40,000 |
| Resin A23 | (5-3) | Methyl group | Methyl group | 30 | 1 | 1 | 0.5% | (9-3) | — | — | 45,000 |
| Resin A24 | (5-1)/(5-2) = 5/5 | Methyl group | Methyl group | 150 | 1 | 1 | 10% | (9-4)/(9-5) = 5/5 | — | — | 48,000 |
| Resin A25 | (5-3) | Methyl group | t-Butyl group | 30 | 1 | 1 | 1% | (9-9) | — | — | 32,000 |
| Resin A26 | (5-1)/(5-2) = 5/5 | Methyl group | Methyl group | 30 | 1 | 1 | 5% | (9-1)/(9-2) = 5/5 | (10-1)/(10-2) = 5/5 | 40 | 23,000 |

The column "Formula (5)" in Table 9 represents the structural unit represented by the formula (5). When the structural units each represented by the formula (5) are used as a mixture, the column represents the kinds of, and a mixing ratio (on a mass basis) between, the structural units. The column "Formula (5-A)" in Table 9 represents the group represented by the formula (5-A). The column "Content of formula (1)" in Table 9 means the content (mass %) of the structure represented by the formula (1) in a resin. The column "Formula (9)" in Table 9 represents the structural unit represented by the formula (9). When the structural units each represented by the formula (9) are used as a mixture, the column represents the kinds of, and a mixing ratio (on a mass basis) between, the structural units. The column "Formula (10)" in Table 9 represents the structural unit represented by the formula (10). When the structural units each represented by the formula (10) are used as a mixture, the column represents the kinds of, and a mixing ratio (on a mass basis) between, the structural units. The column "n of formula (10)" in Table 9 means the number n of repetitions of the structure in the parentheses in the structural unit represented by the formula (10).

Synthesis Example A27

A resin A27 having a structure shown in Table 10 was synthesized by using the siloxane derivative represented by the formula (a-1), a siloxane derivative represented by the formula (a-6), and the diol represented by the formula (a-2) in accordance with the method of Synthesis Example A1. The viscosity-average molecular weight of the resultant resin A27 was 30,000. In addition, the content of the structure represented by the formula (1) in the resin A27 was 10 mass %.

TABLE 10

| | Formula (2) | Formula (5) | Formula (5-A) $R^{511}$ to $R^{520}$ | Formula (5-A) Z | Formula (5-A) n | Formula (5-A) k | Formula (5-A) l | Content of formula (1) | Formula (9) | Viscosity-average molecular weight |
|---|---|---|---|---|---|---|---|---|---|---|
| Resin A27 | (2-1) | (5-1)/(5-2) = 5/5 | Methyl group | Methyl group | 30 | 1 | 1 | 10% | (9-1)/(9-2) = 5/5 | 30,000 |

The column "Formula (2)" in Table 10 represents the structural unit represented by the formula (2). The column "Formula (5)" represents the structural unit represented by the formula (5). When the structural units each represented by the formula (5) are used as a mixture, the column represents the kinds of, and a mixing ratio (on a mass basis) between, the structural units. The column "Formula (5-A)" represents the group represented by the formula (5-A). The column "Content of formula (1)" means the content (mass %) of the structure represented by the formula (1) in a resin. The column "Formula (9)" represents the structural unit represented by the formula (9). When the structural units each represented by the formula (9) are used as a mixture, the column represents the kinds of, and a mixing ratio (on a mass basis) between, the structural units.

Synthesis Example B23

A resin B23 having a structure shown in Table 11 was synthesized by using the siloxane derivative represented by the formula (a-6) and the diol represented by the formula (b-1) in accordance with the method of Synthesis Example B1. The viscosity-average molecular weight of the resultant resin B23 was 31,000. In addition, the content of a portion corresponding to the structure represented by the formula (1) in the resin B23 was 20 mass %.

Synthesis Examples B24 to B31

Resins B24 to B31 were synthesized by using the synthesis method described in Synthesis Example B1 and by using raw materials in accordance with structures shown in Table 11. The viscosity-average molecular weights of the resins B24 to B31 were each controlled by adjusting a time period from the initiation of polymerization to the completion of the polymerization.

The constructions and viscosity-average molecular weights of the resins B23 to B31 are shown in Table 11.

TABLE 11

| | Formula (8) | Formula (8-A) $R^{811}$ to $R^{820}$ | Formula (8-A) Z | Formula (8-A) n | Formula (8-A) k | Formula (8-A) l | Content of formula (1) | Formula (11) | Formula (12) | formula (12) | Viscosity-average molecular weight |
|---|---|---|---|---|---|---|---|---|---|---|---|
| Resin B23 | (8-1) | Methyl group | Methyl group | 30 | 1 | 1 | 20% | (11-1) | — | — | 31,000 |
| Resin B24 | (8-1) | Methyl group | t-Butyl group | 30 | 1 | 1 | 35% | (11-2)/(11-15) = 9/1 | — | — | 45,000 |
| Resin B25 | (8-1) | Methyl group | Methyl group | 30 | 1 | 1 | 10% | (11-1) | (12-1) | 40 | 35,000 |
| Resin B26 | (8-1) | Methyl group | t-Butyl group | 75 | 1 | 1 | 15% | (11-1)/(11-2) = 8/2 | — | — | 32,000 |
| Resin B27 | (8-1) | Methyl group | Methyl group | 30 | 1 | 1 | 0.5% | (11-2)/(11-15) = 9/1 | — | — | 50,000 |
| Resin B28 | (8-1) | Methyl group | Methyl group | 30 | 1 | 1 | 1% | (11-2)/(11-15) = 8/2 | — | — | 45,000 |
| Resin B29 | (8-1) | Methyl group | Methyl group | 30 | 1 | 1 | 1% | (11-1) | — | — | 31,000 |
| Resin B30 | (8-1) | Methyl group | Methyl group | 30 | 1 | 1 | 10% | (11-1)/(11-15) = 8/2 | — | — | 33,000 |
| Resin B31 | (8-1) | Methyl group | Methyl group | 30 | 1 | 1 | 20% | (11-2)/(11-13) = 1/9 | — | — | 32,000 |

The column "Formula (8)" in Table 11 represents the structural unit represented by the formula (8). The column "Formula (8-A)" in Table 11 represents the group represented by the formula (8-A). The column "Content of formula (1)" in Table 11 means the content (mass %) of the structure represented by the formula (1) in a resin. The column "Formula (11)" in Table 11 represents the structural unit represented by the formula (11). When the structural units each represented by the formula (11) are used as a mixture, the column represents the kinds of, and a mixing ratio (on a mass basis) between, the structural units. The column "Formula (12)" in Table 11 represents the structural unit represented by the formula (12). The column "n of formula (12)" in Table 11 means the number n of repetitions of the structure in the parentheses in the structural unit represented by the formula (12).

Synthesis Example B32

A resin B32 having a structure shown in Table 12 was synthesized by using the siloxane derivative represented by the formula (a-1), the siloxane derivative represented by the formula (a-6), and the diol represented by the formula (b-1) in accordance with the method of Synthesis Example B1. The viscosity-average molecular weight of the resultant resin B32 was 25,000. In addition, the content of the structure represented by the formula (1) in the resin B32 was 5 mass %.

TABLE 12

| | Formula (2) | Formula (8) | Formula (8-A) $R^{811}$ to $R^{820}$ | Formula (8-A) Z | Formula (8-A) n | Formula (8-A) k | Formula (8-A) l | Content of Formula (1) | Formula (11) | Viscosity-average molecular weight |
|---|---|---|---|---|---|---|---|---|---|---|
| Resin B32 | (2-1) | (8-1) | Methyl group | Methyl group | 30 | 1 | 1 | 5% | (11-1) | 25,000 |

The column "Formula (2)" in Table 12 represents the structural unit represented by the formula (2). The column "Formula (8)" represents the structural unit represented by the formula (8). The column "Formula (8-A)" represents the group represented by the formula (8-A). The column "Content of formula (1)" means the content (mass %) of the structure represented by the formula (1) in a resin. The column "Formula (11)" represents the structural unit represented by the formula (11).

[Production of Electrophotographic Photosensitive Member]

Production examples of the electrophotographic photosensitive member to be used in the present invention are described below. It should be noted that the term "part(s)" described in each production example of the photosensitive member means "part(s) by mass" unless otherwise stated.

[Production Example of Photosensitive Member 1]

An aluminum cylinder having a diameter of 30 mm and a length of 261 mm was used as a support (conductive support).

Next, 214 parts of titanium oxide ($TiO_2$) particles coated with oxygen-deficient tin oxide ($SnO_2$) serving as metal oxide particles, 132 parts of a phenol resin (monomer/oligomer of a phenol resin) (trade name: PRIOPHEN J-325, manufactured by Dainippon Ink and Chemicals, Inc., resin solid content: 60 mass %) serving as a binding material, and 98 parts of 1-methoxy-2-propanol serving as a solvent were loaded into a sand mill using 450 parts of glass beads each having a diameter of 0.8 mm, and were subjected to a dispersion treatment under the conditions of a number of revolutions of 2,000 rpm, a dispersion treatment time of 4.5 hours, and a preset temperature of cooling water of 18° C. to provide a dispersion liquid. The glass beads were removed from the dispersion liquid with a mesh.

Silicone resin particles (trade name: TOSPEARL 120, manufactured by Momentive Performance Materials Inc., average particle diameter: 2 μm) serving as a surface roughness-imparting material were added to the dispersion liquid after the removal of the glass beads so that the amount of the particles became 10 mass % with respect to the total mass of the metal oxide particles and the binding material in the dispersion liquid. In addition, a silicone oil (trade name: SH28PA, manufactured by Dow Corning Toray Co., Ltd.) serving as a leveling agent was added to the dispersion liquid so that the amount of the oil became 0.01 mass % with respect to the total mass of the metal oxide particles and the binding material in the dispersion liquid, followed by stirring. Thus, a conductive layer coating liquid was prepared.

The conductive layer coating liquid was applied onto the support by immersion, and the resultant applied film was dried and thermally cured for 30 minutes at 150° C. to form a conductive layer having a thickness of 30 μm.

Next, an undercoat layer coating liquid was prepared by dissolving 3 parts of an N-methoxymethylated nylon and 3 parts of a copolymerized nylon in a mixed solvent formed of 65 parts of methanol and 30 parts of n-butanol.

The undercoat layer coating liquid was applied onto the conductive layer by immersion, and was dried for 10 minutes at 100° C. to form an undercoat layer having a thickness of 0.7 μm.

Next, 10 parts of a hydroxygallium phthalocyanine (charge generating substance) of a crystal form having peaks at Bragg angles 2θ±0.2° in CuKα characteristic X-ray diffraction of 7.5°, 9.9°, 16.3°, 18.6°, 25.1°, and 28.3° was prepared. The hydroxygallium phthalocyanine was mixed with 250 parts of cyclohexanone and 5 parts of a polyvinyl butyral resin (trade name: S-LEC BX-1, manufactured by Sekisui Chemical Co., Ltd.), and the materials were dispersed with a sand mill apparatus using glass beads each having a diameter of 1 mm under an atmosphere at 23±3° C. for 1 hour. After the dispersion, a charge generating layer coating liquid was prepared by adding 250 parts of ethyl acetate to the resultant. The charge generating layer coating liquid was applied onto the undercoat layer by immersion, and the resultant applied film was dried for 10 minutes at 100° C. to form a charge generating layer having a thickness of 0.26 μm.

Next, 8 parts of the compound represented by the formula (13-1) and 2 parts of the compound represented by the formula (13-8) serving as charge transporting substances, and 0.7 part of the resin A1 synthesized in Synthesis Example A1 and 9.3 parts of a polyarylate resin (viscosity-average molecular weight: 40,000), which contained the structural unit represented by the formula (9-1) and the structural unit represented by the formula (9-2) at a ratio of 5:5, serving as resins were dissolved in a mixed solvent formed of 40 parts of dimethoxymethane, 60 parts of o-xylene, and 5 parts of methyl benzoate. Thus, a charge transporting layer coating liquid was prepared. The charge transporting layer coating liquid was applied onto the charge generating layer by immersion, and the resultant applied film was dried for 1 hour at 120° C. to form a charge transporting layer having a thickness of 16 μm.

Thus, a photosensitive member 1 in which the charge transporting layer was a surface layer was produced. The constructions of the charge transporting substances and resins to be incorporated into the charge transporting layer are shown in Table 13.

[Production Examples of Photosensitive Members 2 to 83]

Photosensitive members 2 to 83 were produced in the same manner as in the photosensitive member 1 except that in the photosensitive member 1, the charge transporting substances and the resins in the charge transporting layer were changed as shown in Table 13 and Table 14. The constructions of the charge transporting substances and resins to be incorporated into the charge transporting layers of the photosensitive members 2 to 83 are shown in Table 13 and Table 14. In addition, the abundance ratios of silicon atoms to all atoms except hydrogen atoms in the outermost surfaces of the charge transporting layers of the photosensitive members 63 to 83 measured by Electron spectroscopy for chemical analysis are shown in Table 15.

TABLE 13

| | | Resin | | | |
|---|---|---|---|---|---|
| | Charge transporting substance | Resin A or resin B | Other resin | Viscosity-average molecular weight of other resin | Ratio of resin A or resin B |
| Photosensitive member 1 | (13-1)/(13-8) = 8/2 | Resin A1 | (9-1)/(9-2) = 5/5 | 40,000 | 3.5% |
| Photosensitive member 2 | (13-1)/(13-8) = 8/2 | Resin A2 | (9-1)/(9-2) = 5/5 | 40,000 | 2.0% |
| Photosensitive member 3 | (13-5) = 10 | Resin A2 | (9-12) | 35,000 | 1.5% |
| Photosensitive member 4 | (13-1)/(13-8) = 8/2 | Resin A3 | (11-1) | 40,000 | 1.5% |
| Photosensitive member 5 | (13-1)/(13-8) = 8/2 | Resin A4 | (9-1)/(9-2) = 5/5 | 40,000 | 2.5% |
| Photosensitive member 6 | (13-1)/(13-8) = 8/2 | Resin A5 | (9-1)/(9-2) = 5/5 | 40,000 | 1.0% |
| Photosensitive member 7 | (13-1)/(13-8) = 8/2 | Resin A6 | (9-1)/(9-2) = 5/5 | 40,000 | 0.3% |
| Photosensitive member 8 | (13-1)/(13-8) = 8/2 | Resin A7 | (9-1)/(9-2) = 5/5 | 40,000 | 2.5% |
| Photosensitive member 9 | (13-1)/(13-2) = 5/5 | Resin A8 | (9-1)/(9-2) = 5/5 | 40,000 | 1.5% |
| Photosensitive member 10 | (13-1)/(13-8) = 8/2 | Resin B1 | (9-1)/(9-2) = 5/5 | 40,000 | 0.5% |
| Photosensitive member 11 | (13-1)/(13-8) = 8/2 | Resin B2 | (9-1)/(9-2) = 5/5 | 40,000 | 1.0% |
| Photosensitive member 12 | (13-1)/(13-8) = 8/2 | Resin B2 | (11-1) | 40,000 | 1.5% |
| Photosensitive member 13 | (13-1)/(13-2) = 5/5 | Resin B2 | (11-1) | 40,000 | 1.0% |
| Photosensitive member 14 | (13-5) = 10 | Resin B2 | (9-12) | 35,000 | 2.0% |
| Photosensitive member 15 | (13-5) = 10 | Resin B2 | (11-2)/(11-3) = 7/3 | 32,000 | 2.5% |
| Photosensitive member 16 | (13-4) = 10 | Resin B2 | (11-1)/(11-15) = 8/2 | 30,000 | 0.3% |
| Photosensitive member 17 | (13-1)/(13-8) = 8/2 | Resin B3 | (9-1)/(9-2) = 5/5 | 40,000 | 5.0% |
| Photosensitive member 18 | (13-5) = 10 | Resin B3 | (9-12) | 35,000 | 3.0% |
| Photosensitive member 19 | (13-5) = 10 | Resin B3 | (11-1)/(11-15) = 8/2 | 30,000 | 1.0% |
| Photosensitive member 20 | (13-5) = 10 | Resin B3 | (11-2)/(11-3) = 7/3 | 32,000 | 1.5% |
| Photosensitive member 21 | (13-4) = 10 | Resin B3 | (11-1)/(11-15) = 8/2 | 30,000 | 0.5% |
| Photosensitive member 22 | (13-1)/(13-8) = 8/2 | Resin B4 | (9-1)/(9-2) = 5/5 | 40,000 | 3.0% |
| Photosensitive member 23 | (13-1)/(13-8) = 8/2 | Resin B5 | (11-1) | 40,000 | 2.5% |
| Photosensitive member 24 | (13-1)/(13-8) = 8/2 | Resin B6 | (9-1)/(9-2) = 5/5 | 40,000 | 4.0% |

TABLE 13-continued

| | Charge transporting substance | Resin | | | |
|---|---|---|---|---|---|
| | | Resin A or resin B | Other resin | Viscosity-average molecular weight of other resin | Ratio of resin A or resin B |
| Photosensitive member 25 | (13-1)/(13-8) = 8/2 | Resin B7 | (9-1)/(9-2) = 5/5 | 40,000 | 1.0% |
| Photosensitive member 26 | (13-1)/(13-8) = 8/2 | Resin B8 | (11-1) | 40,000 | 2.5% |
| Photosensitive member 27 | (13-1)/(13-8) = 8/2 | Resin B9 | (9-1)/(9-2) = 5/5 | 40,000 | 0.1% |
| Photosensitive member 28 | (13-5) = 10 | Resin A9 | (9-12) | 35,000 | 2.5% |
| Photosensitive member 29 | (13-1)/(13-8) = 8/2 | Resin A9 | (9-1)/(9-2) = 5/5 | 40,000 | 5.0% |
| Photosensitive member 30 | (13-5) = 10 | Resin A10 | (9-12) | 35,000 | 1.0% |
| Photosensitive member 31 | (13-5) = 10 | Resin A11 | (9-12) | 35,000 | 0.3% |
| Photosensitive member 32 | (13-1)/(13-8) = 8/2 | Resin A12 | (11-2)/(11-3) = 7/3 | 32,000 | 2.5% |
| Photosensitive member 33 | (13-5) = 10 | Resin A13 | (11-1) | 40,000 | 10.0% |
| Photosensitive member 34 | (13-5) = 10 | Resin A14 | (11-2)/(11-3) = 7/3 | 32,000 | 1.0% |
| Photosensitive member 35 | (13-5) = 10 | Resin B10 | (9-12) | 35,000 | 1.5% |
| Photosensitive member 36 | (13-1)/(13-8) = 8/2 | Resin B10 | (9-1)/(9-2) = 5/5 | 40,000 | 5.0% |
| Photosensitive member 37 | (13-5) = 10 | Resin B10 | (11-2)/(11-3) = 7/3 | 32,000 | 2.5% |
| Photosensitive member 38 | (13-4) = 10 | Resin B10 | (11-1)/(11-15) = 8/2 | 30,000 | 1.0% |
| Photosensitive member 39 | (13-5) = 10 | Resin B11 | (9-12) | 35,000 | 10.0% |
| Photosensitive member 40 | (13-1)/(13-8) = 8/2 | Resin B12 | (11-2)/(11-3) = 7/3 | 32,000 | 2.5% |
| Photosensitive member 41 | (13-5) = 10 | Resin B13 | (11-1) | 40,000 | 2.5% |
| Photosensitive member 42 | (13-5) = 10 | Resin B14 | (11-2)/(11-3) = 7/3 | 32,000 | 2.5% |
| Photosensitive member 43 | (13-5) = 10 | Resin B15 | (9-12) | 35,000 | 2.5% |
| Photosensitive member 44 | (13-5) = 10 | Resin B15 | (11-2)/(11-3) = 7/3 | 32,000 | 2.5% |
| Photosensitive member 45 | (13-4) = 10 | Resin B15 | (11-1)/(11-15) = 8/2 | 30,000 | 1.5% |
| Photosensitive member 46 | (13-5) = 10 | Resin B16 | (11-2)/(11-3) = 7/3 | 32,000 | 0.3% |

TABLE 14

| | Charge transporting substance | Resin | | | |
|---|---|---|---|---|---|
| | | Resin A or resin B | Other resin | Viscosity-average molecular weight of other resin | Ratio of resin A or resin B |
| Photosensitive member 47 | (13-1)/(13-8) = 8/2 | Resin A15 | (11-1) | 40,000 | 5.0% |
| Photosensitive member 48 | (13-5) = 10 | Resin A16 | (9-12) | 35,000 | 7.5% |
| Photosensitive member 49 | (13-1)/(13-8) = 8/2 | Resin A17 | (11-1) | 40,000 | 2.5% |
| Photosensitive member 50 | (13-1)/(13-8) = 8/2 | Resin A18 | (11-1) | 40,000 | 10.0% |
| Photosensitive member 51 | (13-1)/(13-8) = 8/2 | Resin A19 | (11-1) | 40,000 | 5.0% |
| Photosensitive member 52 | (13-1)/(13-8) = 8/2 | Resin A20 | (11-1) | 40,000 | 1.0% |
| Photosensitive member 53 | (13-1)/(13-8) = 8/2 | Resin A21 | (11-1) | 40,000 | 2.5% |
| Photosensitive member 54 | (13-1)/(13-8) = 8/2 | Resin B17 | (11-1) | 40,000 | 2.5% |
| Photosensitive member 55 | (13-4) = 10 | Resin B17 | (11-1)/(11-15) = 8/2 | 30,000 | 5.0% |
| Photosensitive member 56 | (13-5) = 10 | Resin B18 | (9-12) | 35,000 | 2.5% |
| Photosensitive member 57 | (13-1)/(13-8) = 8/2 | Resin B19 | (11-1) | 40,000 | 10.0% |
| Photosensitive member 58 | (13-1)/(13-8) = 8/2 | Resin B20 | (11-1) | 40,000 | 0.2% |
| Photosensitive member 59 | (13-5) = 10 | Resin B21 | (9-12) | 35,000 | 2.5% |
| Photosensitive member 60 | (13-5) = 10 | Resin B21 | (11-2)/(11-3) = 7/3 | 32,000 | 1.0% |
| Photosensitive member 61 | (13-4) = 10 | Resin B21 | (11-1)/(11-15) = 8/2 | 30,000 | 5.0% |
| Photosensitive member 62 | (13-5) = 10 | Resin B22 | (9-12) | 35,000 | 2.5% |
| Photosensitive member 63 | (13-10) = 10 | Resin A22 | (11-2)/(11-13) = 1/9 | 28,000 | 5.0% |
| Photosensitive member 64 | (13-1)/(13-8) = 8/2 | Resin A22 | (9-1)/(9-2) = 5/5 | 40,000 | 0.3% |
| Photosensitive member 65 | (13-10) = 10 | Resin A23 | (11-2)/(11-13) = 1/9 | 28,000 | 30.0% |
| Photosensitive member 66 | (13-1)/(13-8) = 8/2 | Resin A24 | (11-1) | 40,000 | 5.0% |
| Photosensitive member 67 | (13-11) = 10 | Resin A25 | (11-2)/(11-13) = 1/9 | 28,000 | 10.0% |
| Photosensitive member 68 | (13-5) = 10 | Resin A26 | (9-12) | 35,000 | 5.0% |
| Photosensitive member 69 | (13-10) = 10 | Resin B23 | (11-2)/(11-13) = 1/9 | 28,000 | 2.5% |
| Photosensitive member 70 | (13-1)/(13-8) = 8/2 | Resin B23 | (11-1) | 40,000 | 5.0% |
| Photosensitive member 71 | (13-5) = 10 | Resin B23 | (9-12) | 35,000 | 2.5% |
| Photosensitive member 72 | (13-5) = 10 | Resin B23 | (11-2)/(11-3) = 7/3 | 32,000 | 2.5% |
| Photosensitive member 73 | (13-4) = 10 | Resin B23 | (11-1)/(11-15) = 8/2 | 30,000 | 2.5% |
| Photosensitive member 74 | (13-10) = 10 | Resin B24 | (11-2)/(11-13) = 1/9 | 28,000 | 10.0% |
| Photosensitive member 75 | (13-10) = 10 | Resin B25 | (11-2)/(11-13) = 1/9 | 28,000 | 2.5% |
| Photosensitive member 76 | (13-11) = 10 | Resin B26 | (11-2)/(11-13) = 1/9 | 28,000 | 0.1% |
| Photosensitive member 77 | (13-10) = 10 | Resin B27 | (11-2)/(11-13) = 1/9 | 28,000 | 30.0% |
| Photosensitive member 78 | (13-11) = 10 | Resin B28 | (11-1) | 40,000 | 20.0% |
| Photosensitive member 79 | (13-11) = 10 | Resin B28 | (11-2)/(11-13) = 1/9 | 28,000 | 30.0% |
| Photosensitive member 80 | (13-10) = 10 | Resin B29 | (11-2)/(11-13) = 1/9 | 28,000 | 2.5% |
| Photosensitive member 81 | (13-5) = 10 | Resin B29 | (9-12) | 35,000 | 2.5% |
| Photosensitive member 82 | (13-10) = 10 | Resin B30 | (11-2)/(11-13) = 1/9 | 28,000 | 2.5% |
| Photosensitive member 83 | (13-10) = 10 | Resin B31 | (11-2)/(11-13) = 1/9 | 28,000 | 2.5% |

The column "Charge transporting substance" in each of Table 13 and Table 14 represents the kind and number of parts of a charge transporting substance. The column "Resin A or resin B" in each of Table 13 and Table represents resins shown in Table 1 to Table 12. The column "Other resin" in each of Table 13 and Table 14 represents a structural unit of a resin except the resin A or the resin B in a charge transporting layer. When the structural units are used as a mixture, the column represents the kinds of, and a mixing ratio (on a mass basis) between, the structural units. The column "Ratio of resin A or resin B" in each of Table 13 and Table 14 means the content (mass %) of the resin A or the resin B with respect to all solid matters in a charge transporting layer.

TABLE 15

| | Silicon atom ratio |
|---|---|
| Photosensitive member 63 | 12% |
| Photosensitive member 64 | 0.8% |
| Photosensitive member 65 | 25% |
| Photosensitive member 66 | 12% |
| Photosensitive member 67 | 5% |
| Photosensitive member 68 | 10% |
| Photosensitive member 69 | 15% |
| Photosensitive member 70 | 19% |
| Photosensitive member 71 | 16% |
| Photosensitive member 72 | 14% |
| Photosensitive member 73 | 14% |
| Photosensitive member 74 | 20% |
| Photosensitive member 75 | 11% |
| Photosensitive member 76 | 0.4% |
| Photosensitive member 77 | 10% |
| Photosensitive member 78 | 9% |
| Photosensitive member 79 | 12% |
| Photosensitive member 80 | 4% |
| Photosensitive member 81 | 6% |
| Photosensitive member 82 | 12% |
| Photosensitive member 83 | 17% |

The column "Silicon atom ratio" in Table 15 means the abundance ratio (atoms %) of a silicon atom to all atoms except a hydrogen atom in the outermost surface of a charge transporting layer measured by means of ESCA.

[Production Example of Photosensitive Member 84]

A photosensitive member 84 was produced in the same manner as in the photosensitive member 2 except that in the photosensitive member 2, the method of producing the undercoat layer was changed as described below and the ratio of the resin in the charge transporting layer was changed as shown in Table 16.

That is, an undercoat layer was formed as described below. 8.5 Parts of an electron transporting substance represented by the following formula (d-1), 15 parts of a blocked isocyanate compound (trade name: SBN-70D, manufactured by Asahi Kasei Chemicals Corporation), 0.97 part of a polyvinyl alcohol acetal resin (trade name: KS-5Z, manufactured by Sekisui Chemical Co., Ltd.) serving as a resin, and 0.15 part of zinc(II) hexanoate (trade name: Zinc(II) Hexanoate, manufactured by Mitsuwa Chemicals Co., Ltd.) serving as a catalyst were dissolved in a mixed solvent formed of 88 parts of 1-methoxy-2-propanol and 88 parts of tetrahydrofuran. Thus, an undercoat layer coating liquid was prepared. The undercoat layer coating liquid was applied onto the conductive layer by immersion, and the resultant applied film was heated for 20 minutes at 170° C. to be cured (polymerized). Thus, an undercoat layer having a thickness of 0.6 μm was formed.

The constructions of the charge transporting substances and resins to be incorporated into the charge transporting layer of the photosensitive member 84 are shown in Table 16.

(d-1)

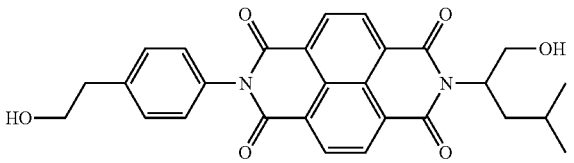

[Production Examples of Photosensitive Members 85 and 86]

Photosensitive members 85 and 86 were produced in the same manner as in the photosensitive member 84 except that in the photosensitive member 84, the charge transporting substances and the resins in the charge transporting layer were changed as shown in Table 16. The constructions of the charge transporting substances and resins to be incorporated into the charge transporting layers of the photosensitive members 85 and 86 are shown in Table 16.

TABLE 16

| | Charge transporting substance | Resin | | | |
|---|---|---|---|---|---|
| | | Resin A or resin B | Other resin | Viscosity-average molecular weight of other resin | Ratio of resin A or resin B |
| Photosensitive member 84 | (13-1)/(13-8) = 8/2 | Resin A2 | (9-1)/(9-2) = 5/5 | 40,000 | 1% |
| Photosensitive member 85 | (13-1)/(13-8) = 8/2 | Resin B2 | (9-1)/(9-2) = 5/5 | 40,000 | 2% |
| Photosensitive member 86 | (13-1)/(13-2) = 5/5 | Resin B2 | (11-1) | 40,000 | 2% |

The column "Charge transporting substance" in Table 16 represents the kinds and numbers of parts of charge transporting substances. The column "Resin A or resin B" in Table 16 represents a resin shown in any one of Table 1 to Table 10. The column "Other resin" in Table 16 represents a structural unit of a resin except "Resin A or Resin B" described above in a charge transporting layer. When the structural units are used as a mixture, the column represents the kinds of, and a mixing ratio between, the structural units. The column "Ratio of resin A or resin B" in Table 16 means the content (mass %) of "Resin A or Resin B" described above in all solid matters in a charge transporting layer.

[Production Examples of Photosensitive Members 87 and 88]

Photosensitive members 87 and 88 were produced in the same manner as in the photosensitive member 1 except that in the photosensitive member 1, the charge transporting substances and the resins in the charge transporting layer were changed as shown in Table 17. The constructions of the charge transporting substances and resins to be incorporated into the charge transporting layers of the photosensitive members 87 and 88 are shown in Table 17.

TABLE 17

| | Charge transporting substance | Resin: Resin A or resin B | Resin: Other resin | Viscosity-average molecular weight of other resin | Ratio of resin A or resin B |
|---|---|---|---|---|---|
| Photosensitive member 87 | (13-1)/(13-8) = 8/2 | Resin A27 | (9-1)/(9-2) = 5/5 | 40,000 | 3.5% |
| Photosensitive member 88 | (13-11) = 10 | Resin B32 | (11-2)/(11-13) = 1/9 | 28,000 | 10.0% |

The column "Charge transporting substance" in Table 17 represents the kinds and numbers of parts of charge transporting substances. The column "Resin A or resin B" represents a resin shown in any one of Table 1 to Table 12. The column "Other resin" represents a structural unit of a resin except "Resin A or Resin B" described above in a charge transporting layer. When the structural units are used as a mixture, the column represents the kinds of, and a mixing ratio between, the structural units. The column "Ratio of resin A or resin B" means the content (mass %) of "Resin A or Resin B" described above in all solid matters in a charge transporting layer.

[Production Example of Comparative Photosensitive Member 1]

A comparative photosensitive member 1 was produced in the same manner as in the photosensitive member 1 except that in the photosensitive member 1, the resin A1 in the charge transporting layer was changed to a silicone-grafted acrylic resin (GS-101, manufactured by Toagosei Co., Ltd.). The constructions of the charge transporting substances and resins to be incorporated into the charge transporting layer of the comparative photosensitive member 2 are shown in Table 18.

[Production Example of Comparative Photosensitive Member 3]

A comparative photosensitive member 3 was produced in the same manner as in the photosensitive member 1 except that in the photosensitive member 1, the resin A1 in the charge transporting layer was changed to a resin C having a structure represented by the following formula (C-1) and free of any polysiloxane structure at a terminal thereof. The constructions of the charge transporting substances and resins to be incorporated into the charge transporting layer of the comparative photosensitive member 3 are shown in Table 18.

(C-1)

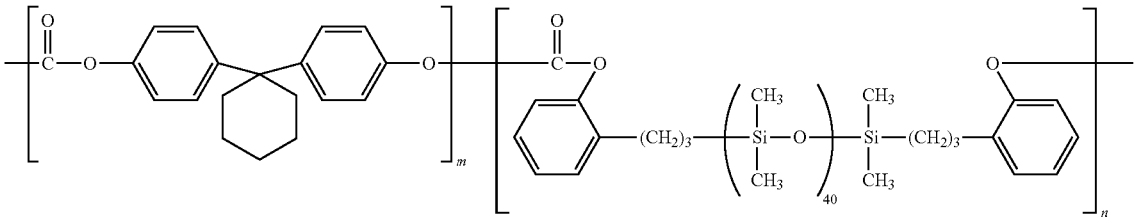

m:n = 8.2

TABLE 18

| | Charge transporting substance | Resin: Siloxane-containing resin | Resin: Other resin | Ratio of siloxane-containing resin |
|---|---|---|---|---|
| Comparative photosensitive member 1 | (13-1)/(13-8) = 8/2 | — | (9-1)/(9-2) = 5/5 | — |
| Comparative photosensitive member 2 | (13-1)/(13-8) = 8/2 | GS-101 | (9-1)/(9-2) = 5/5 | 5% |
| Comparative photosensitive member 3 | (13-1)/(13-8) = 8/2 | Resin C | (9-1)/(9-2) = 5/5 | 2% |

that in the photosensitive member 1, the resin A1 in the charge transporting layer was not used. The constructions of the charge transporting substances and resin to be incorporated into the charge transporting layer of the comparative photosensitive member 1 are shown in Table 18.

[Production Example of Comparative Photosensitive Member 2]

A comparative photosensitive member 2 was produced in the same manner as in the photosensitive member 1 except The column "Charge transporting substance" in Table 18 represents the kinds and numbers of parts of charge transporting substances. The column "Siloxane-containing resin" in Table 18 represents the kind of a resin in a charge transporting layer, the resin having a polysiloxane structure in itself. The column "Other resin" in Table 18 represents the structural units of a resin except "Siloxane-containing resin" described above in a charge transporting layer. When the structural units are used as a mixture, the column represents the kinds of, and a mixing ratio between, the structural units. The column "Ratio of siloxane-containing resin" in Table 18 means the content (mass %) of "Siloxane-containing resin" described above in all solid matters in a charge transporting layer.

[Production of Toner]

Production examples of the toner to be used in the present invention are described below. It should be noted that the term "part(s)" described in each production example of the toner means "part(s) by mass" unless otherwise stated.

[Production Examples of Organic-Inorganic Composite Fine Particles 1 to 6]

Organic-inorganic composite fine particles can be produced in accordance with the description of Examples of International Publication WO2013/063291. Prepared as organic-inorganic composite fine particles 1 to 6 were fine particles produced by using silica shown in Table 19 in accordance with Example 1 of International Publication WO2013/063291. The physical properties of the organic-inorganic composite fine particles 1 to 6 are shown in Table 19. It should be noted that: the organic-inorganic composite fine particles 1 to 6 each had a structure in which inorganic fine particles were embedded in the surface of a resin particle; the inorganic fine particles were exposed to the surface of the resin particle; and the surfaces of the organic-inorganic composite fine particles each had a plurality of protrusions derived from the inorganic fine particles.

[Production Example of Organic-Inorganic Composite Fine Particles 7]

Organic-inorganic composite fine particles 7 can be produced in accordance with the description of Examples of Japanese Patent Application Laid-Open No. 2005-202131. The physical property of the organic-inorganic composite fine particles 7 is shown in Table 19. It should be noted that: the organic-inorganic composite fine particles 7 each had a structure in which inorganic fine particles were embedded in the surface of a resin particle; the inorganic fine particles were exposed to the surface of the resin particle; and the surfaces of the organic-inorganic composite fine particles each had a plurality of protrusions derived from the inorganic fine particles.

TABLE 19

| | Inorganic fine particles in organic-inorganic composite fine particles | |
|---|---|---|
| | Kind | Number-average particle diameter (nm) |
| Organic-inorganic composite fine particles 1 | Colloidal silica | 25 |
| Organic-inorganic composite fine particles 2 | Colloidal silica | 15 |
| Organic-inorganic composite fine particles 3 | Colloidal silica | 25 |
| Organic-inorganic composite fine particles 4 | Colloidal silica | 15 |
| Organic-inorganic composite fine particles 5 | Colloidal silica | 25 |
| Organic-inorganic composite fine particles 6 | Colloidal silica | 60 |
| Organic-inorganic composite fine particles 7 | Colloidal silica | 8 |

[Production Example of Toner 1]

400 Grams of an adduct of bisphenol A with 2 mol of propylene oxide, 280 g of an adduct of bisphenol A with 3 mol of propylene oxide, 120 g of terephthalic acid, and 120 g of isophthalic acid serving as polyester monomers, and 2 g of tetrabutyl titanate serving as a condensation catalyst were mixed, and the mixture was subjected to a reaction in a stream of nitrogen at 220° C. while produced water was removed by distillation. Next, the resultant was cooled to 180° C., 250 g of trimellitic anhydride was added to the resultant, and the mixture was subjected to a reaction. After the completion of the reaction, the resultant was removed from a container, and was cooled and pulverized to provide a polyester resin.

100 Parts of the polyester resin, 75 parts of magnetic iron oxide particles, 4 parts of a polyethylene wax (PW2000: manufactured by Toyo Petrolite, melting point: 120° C.), and 2 parts of a charge control agent (T-77: manufactured by Hodogaya Chemical Co., Ltd.) were premixed with a Henschel mixer. After that, the mixture was melted and kneaded with a biaxial extruder heated to 110° C., and the kneaded product was cooled and then coarsely pulverized with a hammer mill to provide a toner coarsely pulverized product. The resultant coarsely pulverized product was finely pulverized by mechanical pulverization with a mechanical pulverizer Turbo Mill (manufactured by Turbo Kogyo Co., Ltd.; the surfaces of a rotor and a stator were coated with chromium alloy plating containing chromium carbide (plating thickness: 150 μm, surface hardness: HV1050)). Fine powder and coarse powder were simultaneously classified and removed from the resultant finely pulverized product with a multi-division classifying apparatus utilizing a Coanda effect (Elbow Jet Classifier manufactured by Nittetsu Mining Co., Ltd.). After the classification, surface modification and fine powder removal were performed by treating the surfaces of magnetic toner particles with a surface modification apparatus Faculty F-600 (manufactured by Hosokawa Micron Corporation). Toner particles were obtained through the foregoing steps. The weight-average particle diameter (D4) of the resultant toner particles was measured with a precision particle size distribution-measuring apparatus based on a pore electric resistance method "Coulter Counter Multisizer 3" (trademark, manufactured by Beckman Coulter, Inc.). As a result, the weight-average particle diameter was 6.9 μm.

1.1 Parts of the organic-inorganic composite fine particles 1 and 0.2 part of fumed silica (number-average particle diameter: 15 nm) were externally added to and mixed with 100 parts of the toner particles by using a Henschel mixer, and the mixture was sieved with a mesh having an aperture of 100 μm to provide a toner 1. The construction of the toner 1 is shown in Table 20.

[Production Examples of Toners 2 to 7]

Toners 2 to 7 were produced in the same manner as in the toner 1 except that in the toner 1, the kind and number of parts by mass of the organic-inorganic composite fine particles, and the number of parts by mass of the fumed silica were changed as shown in Table 20. The constructions of the toners 2 to 7 are shown in Table 20.

[Production Example of Comparative Toner 1]

A comparative toner 1 was produced in the same manner as in the toner 1 except that in the toner 1, the organic-inorganic composite fine particles 1 were changed to organic fine particles 1, and the numbers of parts by mass of the organic fine particles 1 and the fumed silica were set as shown in Table 20. EPOSTAR series manufactured by Nippon Shokubai Co., Ltd. (number-average particle diameter: 150 nm) was used as the organic fine particles 1. The construction of the comparative toner 1 is shown in Table 20.

[Production Example of Comparative Toner 2]

A comparative toner 2 was produced in the same manner as in the toner 1 except that in the toner 1, the organic-inorganic composite fine particles 1 were changed to inorganic fine particles 1 (colloidal silica, number-average particle diameter: 101 nm), and the numbers of parts by mass of the inorganic fine particles 1 and the fumed silica were set as shown in Table 20. The construction of the comparative toner 2 is shown in Table 20.

[Production Example of Comparative Toner 3]

A comparative toner 3 was produced in the same manner as in the toner 1 except that in the toner 1, the organic-inorganic composite fine particles 1 were not used and the number of parts by mass of the fumed silica was set as shown in Table 20. The construction of the comparative toner 3 is shown in Table 20.

The column "Part(s) by mass" of the column "Organic-inorganic composite fine particles/organic fine particles/inorganic fine particles" in Table 20 means an amount to be mixed with 100 parts by mass of the toner particles in the external addition step of each production example. The column "Organic-inorganic composite fine particle content (part(s) by mass)" in Table 20 means the content of organic-inorganic composite fine particles with respect to 100 parts by mass of the toner particles obtained in the evaluation of a toner by <Method of determining Organic-inorganic Composite Fine Particle in Toner> described in the foregoing. The columns "Number-average particle diameter (nm)" and "Inorganic fine particle surface abundance ratio (%)" of the column "Organic-inorganic composite fine particles" in Table 20 mean values obtained in the evaluations of a toner by <Method of measuring Number-average Particle Diameter of Organic-inorganic Composite Fine Particles> and <Method of measuring Surface Abundance Ratio of Inorganic Fine Particles constituting Organic-inorganic Composite Fine Particle> described in the foregoing, respectively.

TABLE 20

| | Organic-inorganic composite fine particles/organic fine particles/inorganic fine particles | | Organic-inorganic composite fine particle | Organic-inorganic composite fine particles | |
|---|---|---|---|---|---|
| | Kind | Part(s) by mass | content (part(s) by mass) | Number-average particle diameter (nm) | Inorganic fine particle surface abundance ratio (%) |
| Toner 1 | Organic-inorganic composite fine particles 1 | 1.1 | 1.09 | 106 | 65.0 |
| | Fumed silica | 0.2 | | | |
| Toner 2 | Organic-inorganic composite fine particles 2 | 0.8 | 0.80 | 99 | 42.0 |
| | Fumed silica | 1.0 | | | |
| Toner 3 | Organic-inorganic composite fine particles 3 | 1.6 | 1.58 | 130 | 65.0 |
| | Fumed silica | 0.3 | | | |
| Toner 4 | Organic-inorganic composite fine particles 4 | 2.1 | 2.08 | 104 | 63.0 |
| | Fumed silica | 0.3 | | | |
| Toner 5 | Organic-inorganic composite fine particles 5 | 3.5 | 3.50 | 190 | 61.1 |
| | Fumed silica | 0.1 | | | |
| Toner 6 | Organic-inorganic composite fine particles 6 | 1.0 | 1.01 | 335 | 60.5 |
| | Fumed silica | 0.2 | | | |
| Toner 7 | Organic-inorganic composite fine particles 7 | 1.1 | 1.11 | 150 | 80.0 |
| | Fumed silica | 0.2 | | | |
| Comparative toner 1 | Organic fine particles 1 | 3.0 | — | — | — |
| | Fumed silica | 0.5 | | | |
| Comparative toner 2 | Inorganic fine particles 1 | 3.2 | — | — | — |
| | Fumed silica | 0.2 | | | |
| Comparative toner 3 | Fumed silica | 1.8 | — | — | — |

Example 1

Production of Process Cartridge

Monochromatic Laser Toner Printer Cartridge CE390X manufactured by Hewlett-Packard Company (HP) was used. In order for a concern about an influence of a deposit on a cleaning blade on an evaluation to be eliminated, the cleaning blade was sufficiently wiped with a cloth impregnated with ethanol, and was dried over 1 day. The photosensitive member 1 was used as a photosensitive member and a developer container was filled with the toner 1. Thus, a process cartridge having the photosensitive member 1 and the toner 1 was obtained.

<Evaluation>

Used as an evaluation apparatus was HP LaserJet Enterprise 600 M603dn reconstructed so as to have a process speed of 400 mm/s in consideration of an additional increase in speed of a printer in the future. In addition, an evaluation was performed under a low-temperature and low-humidity environment (having a temperature of 10° C. and a humidity of 14% RH) where it became additionally hard to clean out. A possible reason why the cleaning becomes hard under low temperature and low humidity is that the hardness of the cleaning blade increases to reduce its followability to the photosensitive member.

Image Evaluation

20 Charts in each of which a solid black image portion was formed on the entire surface of printing paper were continuously output under a low-temperature and low-humidity environment (having a temperature of 10° C. and a humidity of 14% RH), and were evaluated by the following criteria. The result of the evaluation is shown in Table 21.

A: No white streak-like vertical line is observed in each of the 20 images.

B: About 1 to 2 white streak-like vertical lines are thinly observed in some of the 20 images.

C: A clear white streak-like vertical line is observed, or 3 or more thin vertical lines are observed in some of the 20 images.

Charging Member Contamination

After the performance of the image evaluation, a charging member in the cartridge was recovered, and whether or not its contamination derived from the adhesion of an external additive was observed was visually confirmed and evaluated by the following criteria. The result of the evaluation is shown in Table 21.

A: No white contamination is observed.

B: White contamination is observed to some extent.

C: White contamination is conspicuous.

Examples 2 to 86, 89 and 90

Process cartridges were produced in the same manner as in Example 1 except that in Example 1, the photosensitive member 1 and the toner 1 were changed to photosensitive members and toners shown in Table 21, and the cartridges were subjected to the image evaluation and the evaluation of charging member contamination. The results are shown in Table 21.

Examples 87 and 88

Process cartridges were produced in the same manner as in Examples 11 and 77 except that in Examples 11 and 77, the process speed of the evaluation apparatus was changed to 250 mm/s, and the cartridges were subjected to the image evaluation and the evaluation of charging member contamination. The results are shown in Table 21.

TABLE 21

| | Photosensitive member | Toner | Image evaluation | Charging member contamination |
|---|---|---|---|---|
| Example 1 | Photosensitive member 1 | Toner 1 | A | A |
| Example 2 | Photosensitive member 2 | Toner 1 | A | A |
| Example 3 | Photosensitive member 3 | Toner 2 | A | A |
| Example 4 | Photosensitive member 4 | Toner 3 | A | A |
| Example 5 | Photosensitive member 5 | Toner 1 | A | A |
| Example 6 | Photosensitive member 6 | Toner 7 | A | B |
| Example 7 | Photosensitive member 7 | Toner 4 | A | A |
| Example 8 | Photosensitive member 8 | Toner 5 | A | A |
| Example 9 | Photosensitive member 9 | Toner 1 | A | A |
| Example 10 | Photosensitive member 10 | Toner 2 | A | A |
| Example 11 | Photosensitive member 11 | Toner 1 | A | A |
| Example 12 | Photosensitive member 12 | Toner 1 | A | A |
| Example 13 | Photosensitive member 13 | Toner 3 | A | A |
| Example 14 | Photosensitive member 14 | Toner 5 | A | A |
| Example 15 | Photosensitive member 15 | Toner 6 | A | B |
| Example 16 | Photosensitive member 16 | Toner 1 | A | A |
| Example 17 | Photosensitive member 17 | Toner 4 | A | A |
| Example 18 | Photosensitive member 18 | Toner 3 | A | A |
| Example 19 | Photosensitive member 19 | Toner 1 | A | A |
| Example 20 | Photosensitive member 20 | Toner 7 | A | B |
| Example 21 | Photosensitive member 21 | Toner 2 | A | A |
| Example 22 | Photosensitive member 22 | Toner 4 | A | A |
| Example 23 | Photosensitive member 23 | Toner 5 | A | A |
| Example 24 | Photosensitive member 24 | Toner 3 | A | A |
| Example 25 | Photosensitive member 25 | Toner 1 | A | A |
| Example 26 | Photosensitive member 26 | Toner 6 | A | B |
| Example 27 | Photosensitive member 27 | Toner 1 | A | A |
| Example 28 | Photosensitive member 28 | Toner 2 | A | A |
| Example 29 | Photosensitive member 29 | Toner 1 | A | B |
| Example 30 | Photosensitive member 30 | Toner 4 | A | A |
| Example 31 | Photosensitive member 31 | Toner 6 | B | B |
| Example 32 | Photosensitive member 32 | Toner 5 | A | A |
| Example 33 | Photosensitive member 33 | Toner 7 | A | B |
| Example 34 | Photosensitive member 34 | Toner 2 | A | B |
| Example 35 | Photosensitive member 35 | Toner 1 | A | B |
| Example 36 | Photosensitive member 36 | Toner 7 | B | B |

TABLE 21-continued

| | Photosensitive member | Toner | Image evaluation | Charging member contamination |
|---|---|---|---|---|
| Example 37 | Photosensitive member 37 | Toner 3 | A | A |
| Example 38 | Photosensitive member 38 | Toner 4 | A | A |
| Example 39 | Photosensitive member 39 | Toner 1 | A | A |
| Example 40 | Photosensitive member 40 | Toner 2 | A | A |
| Example 41 | Photosensitive member 41 | Toner 1 | A | B |
| Example 42 | Photosensitive member 42 | Toner 6 | A | B |
| Example 43 | Photosensitive member 43 | Toner 6 | A | B |
| Example 44 | Photosensitive member 44 | Toner 5 | A | A |
| Example 45 | Photosensitive member 45 | Toner 1 | A | B |
| Example 46 | Photosensitive member 46 | Toner 1 | A | A |
| Example 47 | Photosensitive member 47 | Toner 4 | A | A |
| Example 48 | Photosensitive member 48 | Toner 1 | A | A |
| Example 49 | Photosensitive member 49 | Toner 2 | A | A |
| Example 50 | Photosensitive member 50 | Toner 3 | A | A |
| Example 51 | Photosensitive member 51 | Toner 5 | A | B |
| Example 52 | Photosensitive member 52 | Toner 6 | A | B |
| Example 53 | Photosensitive member 53 | Toner 7 | A | A |
| Example 54 | Photosensitive member 54 | Toner 1 | A | A |
| Example 55 | Photosensitive member 55 | Toner 2 | A | A |
| Example 56 | Photosensitive member 56 | Toner 3 | A | A |
| Example 57 | Photosensitive member 57 | Toner 1 | A | A |
| Example 58 | Photosensitive member 58 | Toner 4 | A | B |
| Example 59 | Photosensitive member 59 | Toner 5 | A | A |
| Example 60 | Photosensitive member 60 | Toner 7 | A | B |
| Example 61 | Photosensitive member 61 | Toner 6 | B | B |
| Example 62 | Photosensitive member 62 | Toner 1 | A | A |
| Example 63 | Photosensitive member 63 | Toner 2 | A | A |
| Example 64 | Photosensitive member 64 | Toner 3 | A | A |
| Example 65 | Photosensitive member 65 | Toner 1 | A | A |
| Example 66 | Photosensitive member 66 | Toner 4 | A | A |
| Example 67 | Photosensitive member 67 | Toner 6 | A | B |
| Example 68 | Photosensitive member 68 | Toner 5 | A | A |
| Example 69 | Photosensitive member 69 | Toner 1 | A | A |
| Example 70 | Photosensitive member 70 | Toner 2 | A | A |
| Example 71 | Photosensitive member 71 | Toner 1 | A | A |
| Example 72 | Photosensitive member 72 | Toner 4 | A | A |
| Example 73 | Photosensitive member 73 | Toner 6 | A | B |
| Example 74 | Photosensitive member 74 | Toner 1 | A | A |

TABLE 21-continued

| | Photosensitive member | Toner | Image evaluation | Charging member contamination |
|---|---|---|---|---|
| Example 75 | Photosensitive member 75 | Toner 4 | A | A |
| Example 76 | Photosensitive member 76 | Toner 2 | A | B |
| Example 77 | Photosensitive member 77 | Toner 1 | A | A |
| Example 78 | Photosensitive member 78 | Toner 3 | A | A |
| Example 79 | Photosensitive member 79 | Toner 5 | A | A |
| Example 80 | Photosensitive member 80 | Toner 2 | A | A |
| Example 81 | Photosensitive member 81 | Toner 7 | A | B |
| Example 82 | Photosensitive member 82 | Toner 4 | A | A |
| Example 83 | Photosensitive member 83 | Toner 1 | A | A |
| Example 84 | Photosensitive member 84 | Toner 1 | A | A |
| Example 85 | Photosensitive member 85 | Toner 1 | A | A |
| Example 86 | Photosensitive member 86 | Toner 2 | A | A |
| Example 87 | Photosensitive member 11 | Toner 1 | A | A |
| Example 88 | Photosensitive member 77 | Toner 1 | A | A |
| Example 89 | Photosensitive member 87 | Toner 1 | A | A |
| Example 90 | Photosensitive member 88 | Toner 1 | A | A |

Comparative Examples 1 to 6

Process cartridges were produced in the same manner as in Example 1 except that in Example 1, the photosensitive member 1 and the toner 1 were changed to photosensitive members and toners shown in Table 22, and the cartridges were subjected to the image evaluation and the evaluation of charging member contamination. The results are shown in Table 22.

TABLE 22

| | Photosensitive member | Toner | Image evaluation | Charging member contamination |
|---|---|---|---|---|
| Comparative Example 1 | Photosensitive member 10 | Comparative toner 1 | B | C |
| Comparative Example 2 | Photosensitive member 63 | Comparative toner 2 | B | C |
| Comparative Example 3 | Photosensitive member 69 | Comparative toner 3 | B | C |
| Comparative Example 4 | Comparative photosensitive member 1 | Comparative toner 1 | C | C |
| Comparative Example 5 | Comparative photosensitive member 2 | Comparative toner 2 | C | C |
| Comparative Example 6 | Comparative photosensitive member 3 | Comparative toner 3 | C | C |

As can be seen from comparison between Examples and Comparative Examples, in each of Comparative Examples, a suppressing effect on the charging member contamination is not sufficiently obtained, and hence a reduction in image quality derived from the charging member contamination is observed. The foregoing shows that the present invention has superiority because the present invention has a satisfactory cleaning property even at the initial stage of the use of a brand-new process cartridge or electrophotographic apparatus, and hence can suppress a reduction in image quality due to the contamination of a charging member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-234934, filed Nov. 19, 2014, which is hereby incorporated by reference herein in its entirety.

What is claimed is:

1. A process cartridge detachably mountable to a main body of an electrophotographic apparatus, comprising:

an electrophotographic photosensitive member, the electrophotographic photosensitive member comprising a support, a charge generating layer and a charge transporting layer in this order, the charge transporting layer being adjacent to the charge generating layer and being an outermost surface layer of the electrophotographic photosensitive member;

a charging device configured to contact the electrophotographic photosensitive member to charge the electrophotographic photosensitive member; and a developing device configured to supply a toner onto the electrophotographic photosensitive member to form a toner image, wherein the charge transporting layer contains at least one kind of resin selected from the group consisting of a polyarylate resin and a polycarbonate resin, and containing in a structure thereof a polysiloxane structure represented by formula (1)

(1)

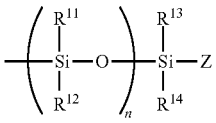

in which $R^{11}$ to $R^{14}$ each independently represent an alkyl group, a fluoroalkyl group, or a phenyl group, Z represents a hydrogen atom, a halogen atom, an alkyl group, or an aryl group, and n represents 10 to 200, the toner comprising a toner particle and an organic-inorganic composite fine particle present on a surface of the toner particle, the organic-inorganic composite fine particle comprising an inorganic fine particle and a resin particle, and the inorganic fine particle is present so that a protrusion derived from a particle shape of the inorganic fine particle is formed on a surface of the resin particle.

2. A process cartridge according to claim 1, wherein a ratio of the polysiloxane structure represented by formula (1) to the polyarylate resin and the polycarbonate resin is 0.5 to 50 mass %.

3. A process cartridge according to claim 1, wherein a polysiloxane structure represented by formula (2) is introduced as the polysiloxane structure represented by formula (1) into at least part of terminals of the polyarylate resin and the polycarbonate resin:

(2)

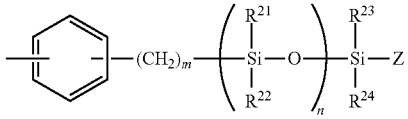

in which $R^{21}$ to $R^{24}$ each independently represent an alkyl group, a fluoroalkyl group, or a phenyl group, Z represents an alkyl group having 1 to 4 carbon atoms or a phenyl group, n represents 10 to 200, and m represents 1 to 3.

4. A process cartridge according to claim 3, wherein the polyarylate resin contains at least one kind of structural unit selected from the group consisting of formula (3), formula (4), and formula (5):

(3)

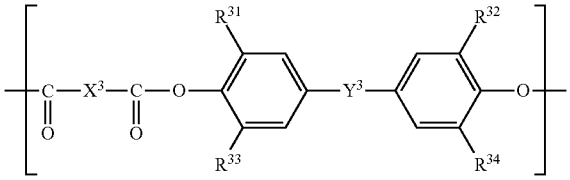

in which at least one group of $R^{31}$ to $R^{34}$ is a polysiloxane structure represented by formula (3-A) and other groups are each independently a hydrogen atom, an alkyl group, or a fluoroalkyl group, $X^3$ represents a m-phenylene group, a p-phenylene group, or a divalent group obtained by bonding two p-phenylene groups through an oxygen atom, and $Y^3$ represents a single bond, a methylene group, an ethylidene group, a propylidene group, or a phenylethylidene group;

(3-A)

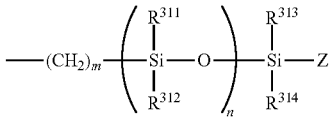

in which $R^{311}$ to $R^{314}$ each independently represent an alkyl group, a fluoroalkyl group, or a phenyl group, Z represents an alkyl group having 1 to 4 carbon atoms or a phenyl group, n represents 10 to 200, and m represents 0 to 5;

(4)

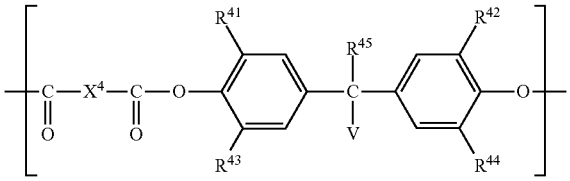

in which $R^{41}$ to $R^{44}$ each independently represent a hydrogen atom, an alkyl group, or a fluoroalkyl group, $R^{45}$ represents a hydrogen atom, an alkyl group, a fluoroalkyl group, or a phenyl group, $X^4$ represents a m-phenylene group, a p-phenylene group, or a divalent group obtained by bonding two p-phenylene groups through an oxygen atom, and V represents a polysiloxane structure represented by the formula (4-A) or a polysiloxane structure represented by formula (4-B);

(4-A)

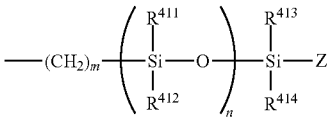

in which $R^{411}$ to $R^{414}$ each independently represent an alkyl group, a fluoroalkyl group, or a phenyl group, Z represents an alkyl group having 1 to 4 carbon atoms or a phenyl group, n represents 10 to 200, and m represents 3 to 20;

(4-B)

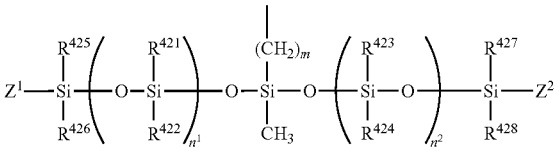

in which $R^{421}$ to $R^{428}$ each independently represent an alkyl group, a fluoroalkyl group, or a phenyl group, $Z^1$ and $Z^2$ each independently represent an alkyl group having 1 to 4 carbon atoms or a phenyl group, $n^1$ and $n^2$ each independently represent 10 to 200, and a total value of $n^1$ and $n^2$ is 20 to 250, and m represents 3 to 20;

(5)

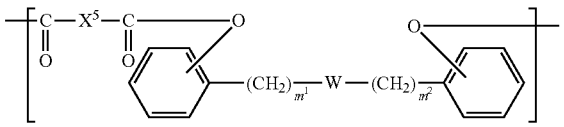

in which $X^5$ represents a m-phenylene group, a p-phenylene group, or a divalent group obtained by bonding two p-phenylene groups through an oxygen atom, $m^1$ and $m^2$ each independently represent 1 to 3, and W represents a polysiloxane structure represented by formula (5-A);

(5-A)

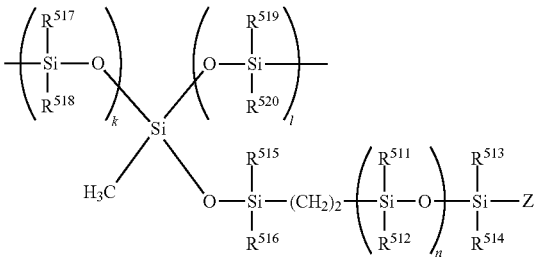

in which $R^{511}$ to $R^{520}$ each independently represent an alkyl group, a fluoroalkyl group, or a phenyl group, Z represents an alkyl group having 1 to 4 carbon atoms or a phenyl group, n represents 10 to 200, and k and l each independently represent 1 to and 10.

5. A process cartridge according to claim 3, wherein the polycarbonate resin contains at least one kind of structural unit selected from the group consisting of formula (6), formula (7), and formula (8):

(6)

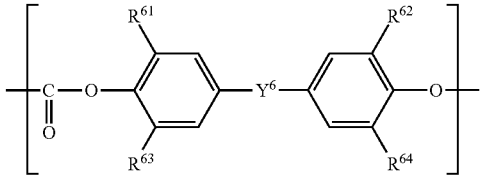

in which at least one group of $R^{61}$ to $R^{64}$ is a polysiloxane structure represented by formula (6-A) and other groups are each independently a hydrogen atom, an alkyl group, a fluoroalkyl group, or a phenyl group, and $Y^6$ represents a single bond, a methylene group, an ethylidene group, a propylidene group, a phenylethylidene group, a cyclohexylidene group, or an oxygen atom;

(6-A)

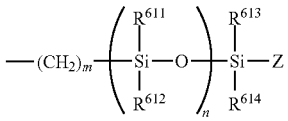

in which $R^{611}$ to $R^{614}$ each independently represent an alkyl group, a fluoroalkyl group, or a phenyl group, Z represents an alkyl group having 1 to 4 carbon atoms or a phenyl group, n represents 10 to 200, and m represents 0 to 5;

(7)

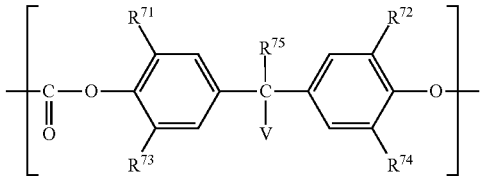

in which $R^{71}$ to $R^{74}$ each independently represent a hydrogen atom, an alkyl group, a fluoroalkyl group, or a phenyl group, $R^{75}$ represents a hydrogen atom, an alkyl group, a fluoroalkyl group, or a phenyl group, and V represents a polysiloxane structure represented by formula (7-A) or a polysiloxane structure represented by formula (7-B);

(7-A)

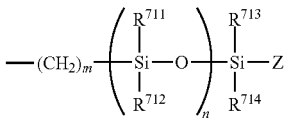

in which $R^{711}$ to $R^{714}$ each independently represent an alkyl group, a fluoroalkyl group, or a phenyl group, Z represents an alkyl group having 1 to 4 carbon atoms or a phenyl group, n represents 10 to 200, and m represents 3 to 20;

(7-B)

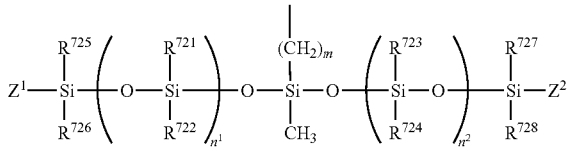

in which $R^{721}$ to $R^{728}$ each independently represent an alkyl group, a fluoroalkyl group, or a phenyl group, $Z^1$ and $Z^2$ each independently represent an alkyl group having 1 to 4 carbon atoms or a phenyl group, $n^1$ and $n^2$ each independently represent 10 to 200, and a total value of $n^1$ and $n^2$ is 20 to 250, and m represents 3 to 20;

(8)

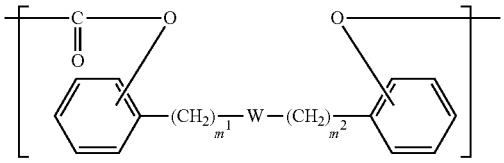

in which $m^1$ and $m^2$ each independently represent 1 to 3, and W represents a polysiloxane structure represented by formula (8-A);

(8-A)

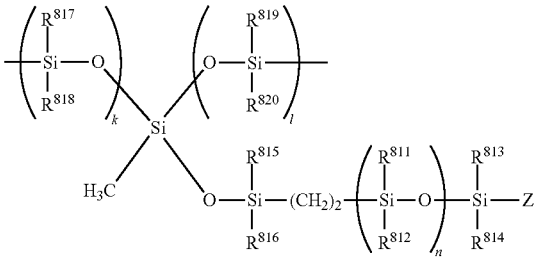

in which $R^{811}$ to $R^{820}$ each independently represent an alkyl group, a fluoroalkyl group, or a phenyl group, Z represents an alkyl group having 1 to 4 carbon atoms or a phenyl group, n represents 10 to 200, and k and l each independently represent 1 to 10.

6. A process cartridge according to claim 1, wherein the polyarylate resin contains at least one structural unit selected from the group consisting of formula (3), formula (4), and formula (5):

(3)

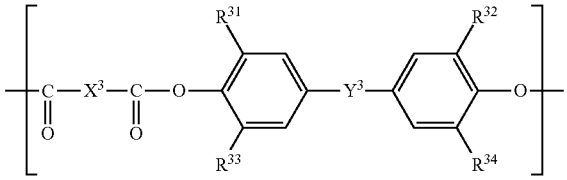

in which at least one group of $R^{31}$ to $R^{34}$ is a polysiloxane structure represented by formula (3-A) and other groups are each independently a hydrogen atom, an alkyl group, or a fluoroalkyl group, $X^3$ represents a m-phenylene group, a p-phenylene group, or a divalent group obtained by bonding two p-phenylene groups through an oxygen atom, and $Y^3$ represents a single bond, a methylene group, an ethylidene group, a propylidene group, or a phenylethylidene group;

(3-A)

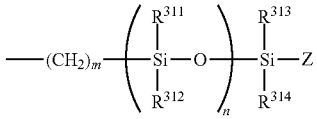

in which $R^{311}$ to $R^{314}$ each independently represent an alkyl group, a fluoroalkyl group, or a phenyl group, Z represents an alkyl group having 1 to 4 carbon atoms or a phenyl group, n represents 10 to 200, and m represents 0 to 5;

(4)

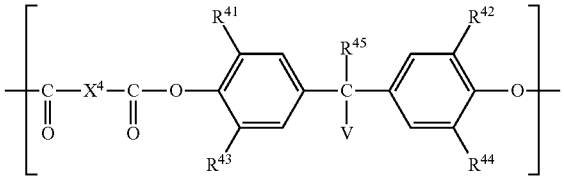

in which $R^{41}$ to $R^{44}$ each independently represent a hydrogen atom, an alkyl group, or a fluoroalkyl group, $R^{45}$ represents a hydrogen atom, an alkyl group, a fluoroalkyl group, or a phenyl group, $X^4$ represents a m-phenylene group, a p-phenylene group, or a divalent group obtained by bonding two p-phenylene groups through an oxygen atom, and V represents a polysiloxane structure represented by formula (4-A) or a polysiloxane structure represented by formula (4-B);

(4-A)

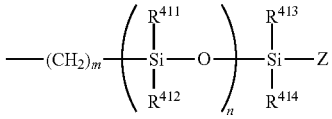

in which $R^{411}$ to $R^{414}$ each independently represent an alkyl group, a fluoroalkyl group, or a phenyl group, Z represents an alkyl group having 1 to 4 carbon atoms or a phenyl group, n represents 10 to 200, and m represents 3 to 20;

(4-B)

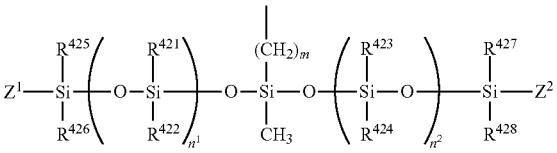

in which $R^{421}$ to $R^{428}$ each independently represent an alkyl group, a fluoroalkyl group, or a phenyl group, $Z^1$ and $Z^2$ each independently represent an alkyl group having 1 to 4 carbon atoms or a phenyl group, $n^1$ and $n^2$ each independently represent 10 to 200, and a total value of $n^1$ and $n^2$ is 20 to 250, and m represents 3 to 20;

(5)

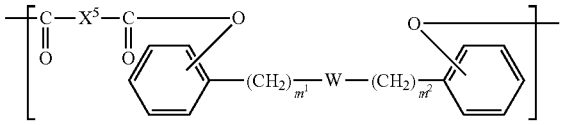

in which $X^5$ represents a m-phenylene group, a p-phenylene group, or a divalent group obtained by bonding two p-phenylene groups through an oxygen atom, $m^1$ and $m^2$ each independently represent 1 to 3, and W represents a polysiloxane structure represented by formula (5-A);

(5-A)

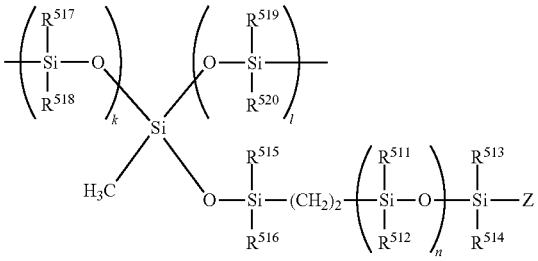

in which $R^{511}$ to $R^{520}$ each independently represent an alkyl group, a fluoroalkyl group, or a phenyl group, Z represents an alkyl group having 1 to 4 carbon atoms or a phenyl group, n represents 10 to 200, and k and l each independently represent 1 to 10.

7. A process cartridge according to claim 1, wherein the polyarylate resin contains a structural unit represented by formula (5):

(5)

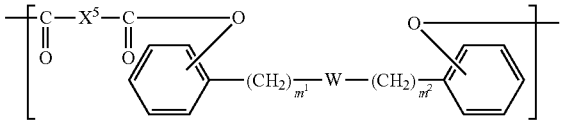

in which $X^5$ represents a m-phenylene group, a p-phenylene group, or a divalent group obtained by bonding two p-phenylene groups through an oxygen atom, $m^1$ and $m^2$ each independently represent 1 to 3, and W represents a polysiloxane structure represented by formula (5-A);

(5-A)

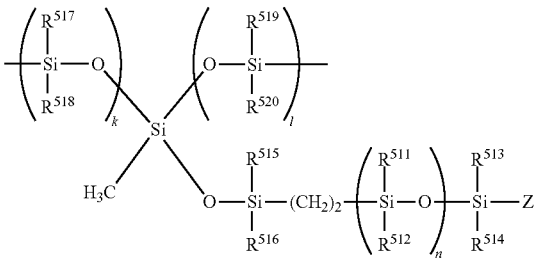

in which $R^{511}$ to $R^{520}$ each independently represent an alkyl group, a fluoroalkyl group, or a phenyl group, Z represents an alkyl group having 1 to 4 carbon atoms or a phenyl group, n represents 10 to 200, and k and l each independently represent 1 to 10.

8. A process cartridge according to claim 7, wherein an abundance ratio of a silicon atom to all atoms except a hydrogen atom in an outermost surface of the charge transporting layer measured by Electron spectroscopy for chemical analysis is 0.6 atoms % or more.

9. A process cartridge according to claim 1, wherein the polycarbonate resin contains at least one kind of structural unit selected from the group consisting of formula (6), formula (7), and formula (8):

(6)

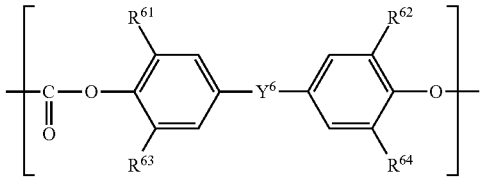

in which at least one group of $R^{61}$ to $R^{64}$ is a polysiloxane structure represented by formula (6-A) and other groups are each independently a hydrogen atom, an alkyl group, a fluoroalkyl group, or a phenyl group, and $Y^6$ represents a single bond, a methylene group, an ethylidene group, a propylidene group, a phenylethylidene group, a cyclohexylidene group, or an oxygen atom;

(6-A)

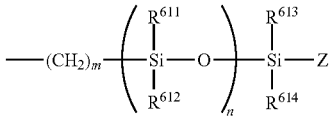

in which $R^{611}$ to $R^{614}$ each independently represent an alkyl group, a fluoroalkyl group, or a phenyl group, Z represents an alkyl group having 1 to 4 carbon atoms or a phenyl group, n represents 10 to 200, and m represents 0 to 5;

(7)

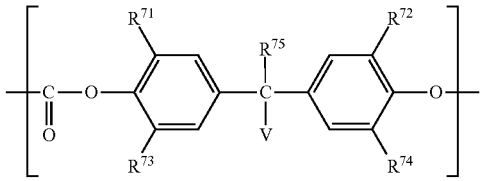

in which $R^{71}$ to $R^{74}$ each independently represent a hydrogen atom, an alkyl group, a fluoroalkyl group, or a phenyl group, $R^{75}$ represents a hydrogen atom, an alkyl group, a fluoroalkyl group, or a phenyl group, and V represents a polysiloxane structure represented by formula (7-A) or a polysiloxane structure represented by formula (7-B);

(7-A)

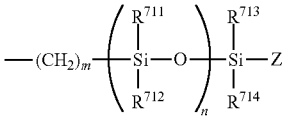

in which $R^{711}$ to $R^{714}$ each independently represent an alkyl group, a fluoroalkyl group, or a phenyl group, Z represents an alkyl group having 1 to 4 carbon atoms or a phenyl group, n represents 10 to 200, and m represents 3 to 20;

(7-B)

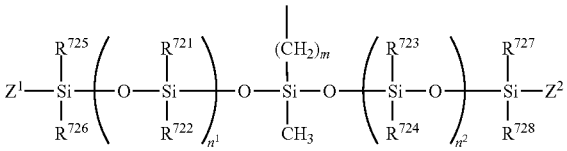

in which $R^{721}$ to $R^{728}$ each independently represent an alkyl group, a fluoroalkyl group, or a phenyl group, $Z^1$ and $Z^2$ each independently represent an alkyl group having 1 to 4 carbon atoms or a phenyl group, $n^1$ and $n^2$ each independently represent 10 to 200, and a total value of $n^1$ and $n^2$ is 20 to 250, and m represents 3 to 20;

(8)

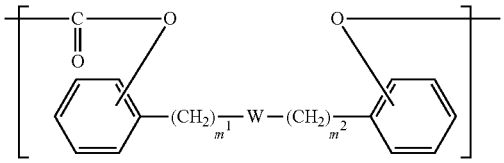

in which $m^1$ and $m^2$ each independently represent 1 to 3, and W represents a polysiloxane structure represented by formula (8-A);

(8-A)

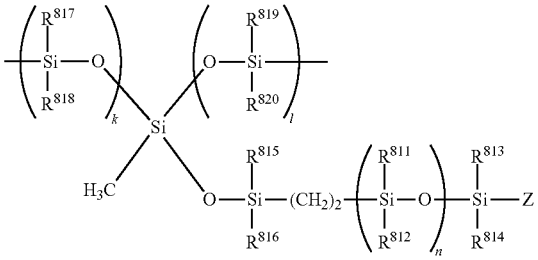

in which $R^{811}$ to $R^{820}$ each independently represent an alkyl group, a fluoroalkyl group, or a phenyl group, Z represents an alkyl group having 1 to 4 carbon atoms or a phenyl group, n represents 10 to 200, and k and l each independently represent 1 to 10.

10. A process cartridge according to claim 1, wherein the polycarbonate resin is a resin containing a structural unit represented by formula (8):

(8)

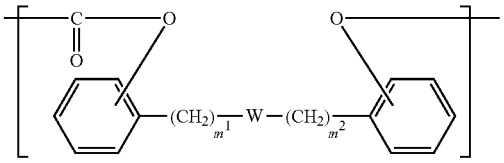

in which $m^1$ and $m^2$ each independently represent 1 to 3, and W represents a polysiloxane structure represented by formula (8-A);

(8-A)

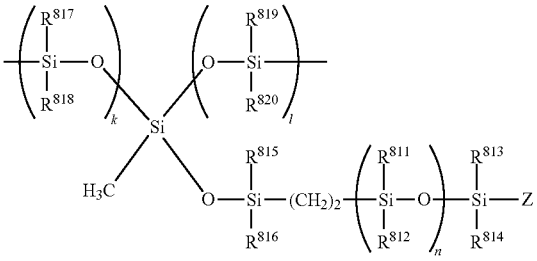

in which $R^{811}$ to $R^{820}$ each independently represent an alkyl group, a fluoroalkyl group, or a phenyl group, Z represents an alkyl group having 1 to 4 carbon atoms or a phenyl group, n represents 10 to 200, and k and l each independently represent 1 to 10.

11. A process cartridge according to claim 10, wherein an abundance ratio of a silicon atom to all atoms except a hydrogen atom in an outermost surface of the charge transporting layer measured by Electron spectroscopy for chemical analysis is 0.6 atoms % or more.

12. A process cartridge according to claim 1, wherein the inorganic fine particle is silica or a metal oxide particle.

13. A process cartridge according to claim 1, wherein a content of the organic-inorganic composite fine particle is 0.5 to 5.0 mass % with respect to a content of the toner particle.

14. An image-forming method, comprising:

a charging step of charging an electrophotographic photosensitive member;

an electrostatic latent image-forming step of forming an electrostatic latent image on a surface of the charged electrophotographic photosensitive member;

a developing step of developing the electrostatic latent image with a toner to form a toner image on the surface of the electrophotographic photosensitive member, the toner comprising a toner particle and an organic-inorganic composite fine particle present on a surface of the toner particle, the organic-inorganic composite fine particle contains an inorganic fine particle and a resin particle, and the inorganic fine particle is present so that a protrusion derived from a particle shape of the inorganic fine particle is formed on a surface of the resin particle;

a transferring step of transferring the toner image on the surface of the electrophotographic photosensitive member onto a transfer material through or without through an intermediate transfer member; and a cleaning step of removing a transfer residual toner from the surface of the electrophotographic photosensitive member, wherein the electrophotographic photosensitive member comprises a support, a charge generating layer, and a charge transporting layer in this order, the charge transporting layer being adjacent to the charge generating layer and being an outermost surface layer of the electrophotographic photosensitive member, and the charge transporting layer contains at least one kind of resin selected from the group consisting of a polyarylate resin and a polycarbonate resin, and containing in a structure thereof a polysiloxane structure represented by formula (1)

(1)

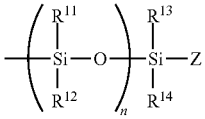

in which $R^{11}$ to $R^{14}$ each independently represent an alkyl group, a fluoroalkyl group, or a phenyl group, Z represents a hydrogen atom, a halogen atom, an alkyl group, or an aryl group, and n represents 10 to 200.

15. An image-forming method according to claim 14, wherein a ratio of the polysiloxane structure represented by formula (1) to the polyarylate resin and the polycarbonate resin is 0.5 to 50 mass %.

16. An image-forming method according to claim 14, wherein a polysiloxane structure represented by formula (2) is introduced as the polysiloxane structure represented by formula (1) into at least part of terminals of the polyarylate resin and the polycarbonate resin:

(2)

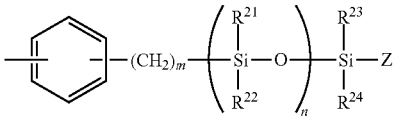

in which $R^{21}$ to $R^{24}$ each independently represent an alkyl group, a fluoroalkyl group, or a phenyl group, Z represents an alkyl group having 1 to 4 carbon atoms or a phenyl group, n represents 10 to 200, and m represents 1 to 3.

17. An image-forming method according to claim 14, wherein the polyarylate resin contains at least one kind of structural unit selected from the group consisting of formula (3), formula (4), and formula (5):

(3)

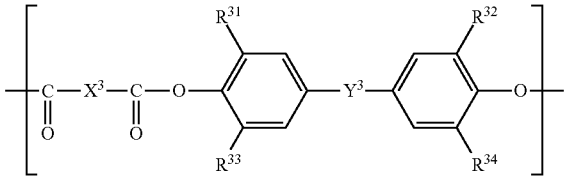

in which at least one group of $R^{31}$ to $R^{34}$ is a polysiloxane structure represented by formula (3-A) and other groups are each independently a hydrogen atom, an alkyl group, or a fluoroalkyl group, $X^3$ represents a m-phenylene group, a p-phenylene group, or a divalent group obtained by bonding two p-phenylene groups through an oxygen atom, and $Y^3$ represents a single bond, a methylene group, an ethylidene group, a propylidene group, or a phenylethylidene group;

(3-A)

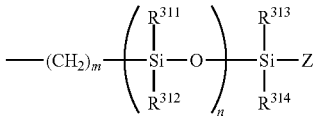

in which $R^{311}$ to $R^{314}$ each independently represent an alkyl group, a fluoroalkyl group, or a phenyl group, Z represents an alkyl group having 1 to 4 carbon atoms or a phenyl group, n represents 10 to 200, and m represents 0 to 5;

(4)

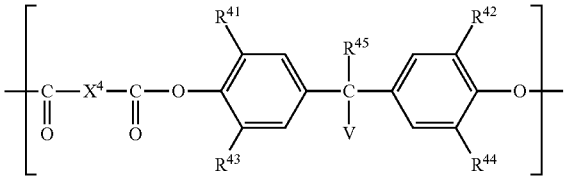

in which $R^{41}$ to $R^{44}$ each independently represent a hydrogen atom, an alkyl group, or a fluoroalkyl group, $R^{45}$ represents a hydrogen atom, an alkyl group, a fluoroalkyl group, or a phenyl group, $X^4$ represents a m-phenylene group, a p-phenylene group, or a divalent group obtained by bonding two p-phenylene groups through an oxygen atom, and V represents a polysiloxane structure represented by formula (4-A) or a polysiloxane structure represented by formula (4-B);

(4-A)

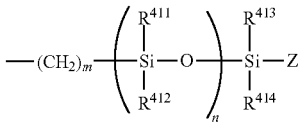

in which $R^{411}$ to $R^{414}$ each independently represent an alkyl group, a fluoroalkyl group, or a phenyl group, Z represents an alkyl group having 1 to 4 carbon atoms or a phenyl group, n represents 10 to 200, and m represents 3 to 20;

(4-B)

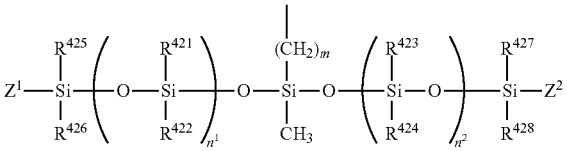

in which $R^{421}$ to $R^{428}$ each independently represent an alkyl group, a fluoroalkyl group, or a phenyl group, $Z^1$ and $Z^2$ each independently represent an alkyl group having 1 to 4 carbon atoms or a phenyl group, $n^1$ and $n^2$ each independently represent 10 to 200, and a total value of $n^1$ and $n^2$ is 20 to 250, and m represents 3 to 20;

(5)

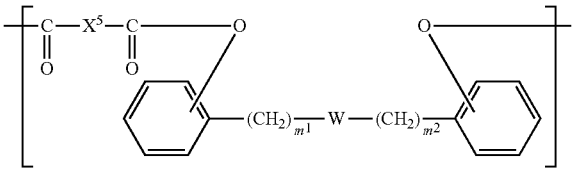

in which $X^5$ represents a m-phenylene group, a p-phenylene group, or a divalent group obtained by bonding two p-phenylene groups through an oxygen atom, $m^1$ and $m^2$ each independently represent 1 to 3, and W represents a polysiloxane structure represented by formula (5-A);

(5-A)

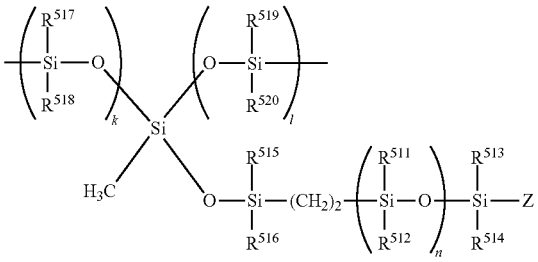

in which $R^{511}$ to $R^{520}$ each independently represent an alkyl group, a fluoroalkyl group, or a phenyl group, Z represents an alkyl group having 1 to 4 carbon atoms or a phenyl group, n represents 10 to 200, and k and l each independently represent 1 to 10.

18. An image-forming method according to claim 14, wherein the polycarbonate resin contains at least one kind of structural unit selected from the group consisting of formula (6), formula (7), and formula (8):

(6)

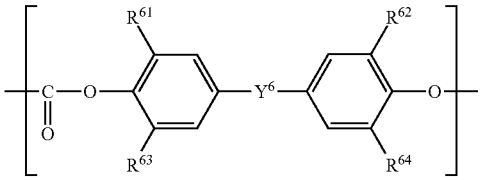

in which at least one group of $R^{61}$ to $R^{64}$ is a polysiloxane structure represented by formula (6-A) and other groups are each independently a hydrogen atom, an alkyl group, a fluoroalkyl group, or a phenyl group, and $Y^6$ represents a single bond, a methylene group, an ethylidene group, a propylidene group, a phenylethylidene group, a cyclohexylidene group, or an oxygen atom;

(6-A)

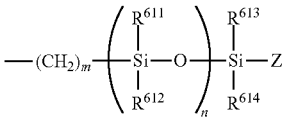

in which $R^{611}$ to $R^{614}$ each independently represent an alkyl group, a fluoroalkyl group, or a phenyl group, Z represents an alkyl group having 1 to 4 carbon atoms or a phenyl group, n represents 10 to 200, and m represents 0 to 5;

(7)

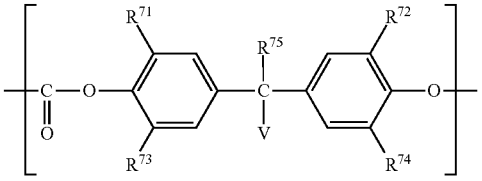

in which $R^{71}$ to $R^{74}$ each independently represent a hydrogen atom, an alkyl group, a fluoroalkyl group, or a phenyl group, $R^{75}$ represents a hydrogen atom, an alkyl group, a fluoroalkyl group, or a phenyl group, and V represents a polysiloxane structure represented by formula (7-A) or a polysiloxane structure represented by formula (7-B);

(7-A)

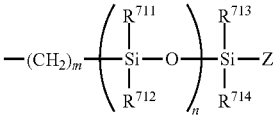

in which $R^{711}$ to $R^{714}$ each independently represent an alkyl group, a fluoroalkyl group, or a phenyl group, Z represents an alkyl group having 1 to 4 carbon atoms or a phenyl group, n represents 10 to 200, and m represents 3 to 20;

(7-B)

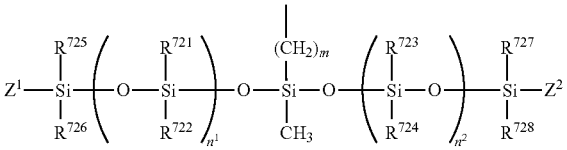

in which $R^{721}$ to $R^{728}$ each independently represent an alkyl group, a fluoroalkyl group, or a phenyl group, $Z^1$ and $Z^2$ each independently represent an alkyl group having 1 to 4 carbon atoms or a phenyl group, $n^1$ and $n^2$ each independently represent 10 to 200, and a total value of $n^1$ and $n^2$ is 20 to 250, and m represents 3 to 20;

(8)

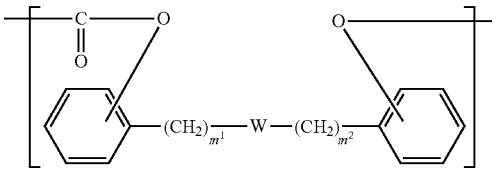

in which $m^1$ and $m^2$ each independently represent 1 to 3, and W represents a polysiloxane structure represented by formula (8-A);

(8-A)

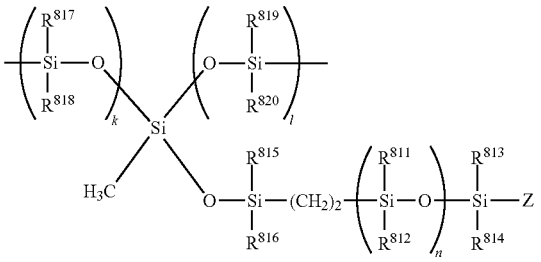

in which $R^{811}$ to $R^{820}$ each independently represent an alkyl group, a fluoroalkyl group, or a phenyl group, Z represents an alkyl group having 1 to 4 carbon atoms or a phenyl group, n represents 10 to 200, and k and l each independently represent 1 to 10.

19. An image-forming method according to claim 14, wherein an abundance ratio of a silicon atom to all atoms except a hydrogen atom in an outermost surface of the charge transporting layer measured by Electron spectroscopy for chemical analysis is 0.6 atoms % or more.

20. An image-forming method according to claim 14, wherein a content of the organic-inorganic composite fine particle is 0.5 to 5.0 mass % with respect to a content of the toner particle.

* * * * *